US008773334B2

(12) United States Patent
Yamamoto et al.

(10) Patent No.: US 8,773,334 B2
(45) Date of Patent: Jul. 8, 2014

(54) EL DISPLAY PANEL, ELECTRONIC APPARATUS AND EL DISPLAY PANEL DRIVING METHOD

(71) Applicant: Sony Corporation, Tokyo (JP)

(72) Inventors: Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 13/626,925

(22) Filed: Sep. 26, 2012

(65) Prior Publication Data

US 2013/0069851 A1 Mar. 21, 2013

Related U.S. Application Data

(63) Continuation of application No. 12/379,027, filed on Feb. 11, 2009.

(30) Foreign Application Priority Data

Feb. 28, 2008 (JP) ..... 2008-048258

(51) Int. Cl.
*G09G 3/30* (2006.01)

(52) U.S. Cl.
USPC ..... 345/76; 345/77; 345/78

(58) Field of Classification Search
USPC ..... 345/76
See application file for complete search history.

(56) References Cited

U.S. PATENT DOCUMENTS

| | | | | |
|---|---|---|---|---|
| 5,101,116 | A * | 3/1992 | Morokawa | 327/126 |
| 7,057,588 | B2 | 6/2006 | Asano et al. | |
| 7,102,202 | B2 | 9/2006 | Kobayashi et al. | |
| 7,109,952 | B2 | 9/2006 | Kwon | |
| 7,928,951 | B2 | 4/2011 | Fujita | |
| 2004/0007989 | A1 | 1/2004 | Li | |
| 2004/0174349 | A1 | 9/2004 | Libsch et al. | |
| 2005/0206590 | A1 | 9/2005 | Sasaki et al. | |
| 2006/0279504 | A1 * | 12/2006 | Fujita | 345/98 |
| 2007/0115225 | A1 * | 5/2007 | Uchino et al. | 345/76 |
| 2007/0268210 | A1 * | 11/2007 | Uchino et al. | 345/55 |
| 2008/0084370 | A1 * | 4/2008 | Wang et al. | 345/87 |
| 2009/0015575 | A1 * | 1/2009 | Le Roy et al. | 345/209 |
| 2009/0115709 | A1 * | 5/2009 | Yamashita et al. | 345/76 |
| 2010/0149158 | A1 * | 6/2010 | Lee | 345/211 |

FOREIGN PATENT DOCUMENTS

| | | | |
|---|---|---|---|
| JP | 2003-255856 | A | 9/2003 |
| JP | 2003-271095 | A | 9/2003 |
| JP | 2004-029791 | A | 1/2004 |
| JP | 2004-093682 | A | 3/2004 |
| JP | 2004-133240 | A | 4/2004 |
| JP | 2007-108378 | A | 4/2007 |
| JP | 2008-026468 | A | 2/2008 |
| WO | WO-2008/152817 | A1 | 12/2008 |

OTHER PUBLICATIONS

Japanese Office Action issued May 22, 2012 for corresponding Japanese Application No. 2008-048258.

* cited by examiner

*Primary Examiner* — Joe H Cheng
*Assistant Examiner* — Benyam Ketema
(74) *Attorney, Agent, or Firm* — Rader, Fishman & Grauer PLLC

(57) ABSTRACT

An electro luminescence display panel adopting an active-matrix driving method and including pixel circuits, a capacitor control line, a coupling capacitor, and a pulse voltage source.

24 Claims, 47 Drawing Sheets

RELATED ART

RELATED ART

141

EL DISPLAY PANEL, ELECTRONIC APPARATUS AND EL DISPLAY PANEL DRIVING METHOD

CROSS REFERENCES TO RELATED APPLICATIONS

This is a Continuation application of U.S. patent application Ser. No. 12/379,027, filed Feb. 11, 2009, which in turn claims priority from Japanese Application No.: 2008-048258 filed in the Japan Patent Office on Feb. 28, 2008, the entire contents of which being incorporated herein by reference.

BACKGROUND OF THE INVENTION

1. Field of the Invention

The present invention described in this patent specification relates to an organic EL (Electro Luminescence) display panel driven/controlled by adoption of an active matrix driving system and relates to a driving technology for driving the organic EL display panel. It is to be noted that the present invention described in this patent specification has three modes, i.e., an organic EL display panel, an electronic apparatus employing the organic EL display panel and a method for driving the organic EL display panel.

2. Description of the Related Art

FIG. 1 is a general circuit block diagram showing an organic EL display panel 1 driven/controlled by adoption of an active matrix driving method. As shown in the circuit block diagram of FIG. 1, the organic EL display panel 1 employs a pixel array section 3, a signal-write control line driving section 5 and a horizontal selector 7. It is to be noted that the pixel array section 3 includes pixel circuits 9 each located at an intersection of a signal line DTL and a write control line WSL.

Incidentally, an organic EL device employed in each of the pixel circuits 9 is a light emitting device which emits light in accordance with a current flowing thereto. Thus, the organic EL display panel 1 adopts a driving method for controlling gradations of pixels by adjustment of a current flowing through the organic EL device. FIG. 2 is a block diagram showing a simplest circuit configuration of a pixel circuit 9 connected to the horizontal selector 7 by a signal line DTL and the signal-write control line driving section 5 by a write control line WSL. As shown in the block diagram of FIG. 2, the pixel circuit 9 includes a sampling transistor T1, a driving transistor T2 and a signal holding capacitor Cs in addition to the organic EL device OLED.

It is to be noted that the sampling transistor T1 is a TFT (Thin Film Transistor) for controlling an operation to store a signal electric potential Vsig corresponding to the gradation value of the pixel circuit 9 into the signal holding capacitor Cs. On the other hand, the driving transistor T2 is a thin-film transistor for supplying a driving current Ids to the organic EL device OLED on the basis of a gate-source voltage Vgs of the driving transistor T2, and the gate-source voltage Vgs of the driving transistor T2 is determined by the signal electric potential Vsig stored in the signal holding capacitor Cs. The driving current Ids is a current flowing between the drain and source electrodes of the driving transistor T2 whereas the gate-source voltage Vgs is a voltage appearing between the gate and source electrodes of the driving transistor T2. In the case of the pixel circuit 9 shown in the block diagram of FIG. 2, the sampling transistor T1 is a thin-film transistor of an N-channel type whereas the driving transistor T2 is a thin-film transistor of a P-channel type.

In the case of the pixel circuit 9 shown in the block diagram of FIG. 2, the source electrode of the driving transistor T2 is connected to a fixed power-supply electric potential Vcc by a current supply line which is also referred to as a power-supply line in this patent specification. The driving transistor T2 typically operates in a saturated region. That is to say, the driving transistor T2 functions as a constant-current source for supplying a driving current Ids having a magnitude determined by the signal electric potential Vsig to the organic EL device OLED. The driving current Ids is expressed by the following equation:

$$Ids=k\cdot\mu\cdot(Vgs-Vth)^2/2$$

In the above equation, reference notation μ denotes the mobility of majority carriers in the driving transistor T2 whereas reference notation Vth denotes the threshold voltage of the driving transistor T2. On the other hand, reference notation k denotes a coefficient represented by an expression (W/L)·Cox where reference notation W denotes a channel width of the driving transistor T2, reference notation L denotes a channel length of the driving transistor T2 and reference notation Cox denotes a gate capacitance per unit area of the driving transistor T2.

It is to be noted that the driving transistor T2 employed in the pixel circuit 9 with a configuration shown in the block diagram of FIG. 2 is known to exhibit a drain-voltage characteristic which changes due to a process of aging in accordance with changes shown in a diagram of FIG. 3 as changes in I-V characteristic which represents a relation between the driving current Ids mentioned above and a voltage applied between the anode and cathode electrodes of the organic EL device OLED as a relation changing with the lapse of time due to a process of aging. Since the gate-source voltage Vgs of the driving transistor T2 is held at a fixed level by the signal holding capacitor Cs, however, the magnitude of the driving current Ids supplied to the organic EL device OLED does not change, allowing the luminance of light emitted by the organic EL device OLED to be kept at a constant value.

Documents used in this patent specification to serve as documents relevant to the organic EL panel display adopting the active-matrix driving method are listed as follows: Japanese Patent Laid-open Nos. 2003-255856, 2003-271095, 2004-133240, 2004-029791, and 2004-093682.

SUMMARY OF THE INVENTION

Incidentally, depending on the type of a thin film process for creating the pixel circuit 9, the pixel circuit 9 may not adopt the typical circuit configuration shown in the block diagram of FIG. 2 in some cases. That is to say, in the contemporary thin film process, a thin-film transistor of the P-channel type may not be created in some cases. In such a case, a thin-film transistor of the N-channel type is used instead as the driving transistor T2.

FIG. 4 is a block diagram showing a typical circuit configuration of a pixel circuit 9 connected to the horizontal selector 7 by a signal line DTL and the signal-write control line driving section 5 by a write control line WSL to serve as a pixel circuit 9 employing two thin-film transistors of the N-channel type to serve as the sampling transistor T1 and the driving transistor T2 respectively. In the case of this circuit configuration, the source electrode of the driving transistor T2 is connected to the anode electrode of the organic EL device OLED. However, the pixel circuit 9 shown in the block diagram of FIG. 4 raises a problem that the gate-source voltage Vgs of the driving transistor T2 varies with the lapse of time due to the changes exhibited by the organic EL device OLED with the lapse of time due to a process of aging as shown in the diagram of FIG. 3. These changes in gate-source voltage Vgs vary the magnitude of the driving current Ids so that the luminance of light exhibited by the organic EL device OLED also varies undesirably.

In addition, the threshold voltage and mobility of the driving transistor T2 employed in each of the pixel circuits 9 also vary from pixel to pixel. Variations of the threshold voltage and mobility of the driving transistor T2 from pixel to pixel appear as variations of the magnitude of the driving current Ids flowing to the organic EL device and the variations of the magnitude of the driving current Ids flowing to the organic EL device appear as variations of the value of the luminance of light exhibited by the organic EL device OLED from pixel to pixel.

Thus, if the pixel circuit 9 of the typical configuration shown in the block diagram of FIG. 4 is employed, it is necessary to establish a method for driving the pixel circuit 9 to serve as a driving method that gives a stable light emission characteristic independent of characteristic variations exhibited by the organic EL device OLED as variations with the lapse of time.

In order to solve the problems described above, inventors of the present invention have innovated an organic EL display panel employing: (a): pixel circuits each including at least a driving transistor for drawing a driving current from a fixed-voltage power-supply line and supplying the driving current to an organic EL device, a signal holding capacitor connected between the gate and source electrodes of the driving transistor, a sampling transistor for controlling an operation to store a signal electric potential into the signal holding capacitor and the organic EL device; (b): a capacitor control line connected as a line common to all the pixel circuits or common to a plurality of aforementioned pixel circuits; (c): a coupling capacitor connected between the anode electrode of the organic EL device and the capacitor control line in each of the pixel circuits; and (d): a pulse voltage source for raising an electric potential appearing on the capacitor control line from a low level to a high level and lowering the electric potential from the high level back to the low level after the lapse of time determined in advance since the rising edge of the electric potential at least one time during one field period.

Incidentally, it is desirable to drive the pulse voltage source in such a way that, while a reference electric potential for compensating for effects of variations of a threshold voltage of the driving transistor is being applied to any one of the pixel circuits, the pulse voltage source raises the electric potential appearing on the capacitor control line from a low level to a high level and lowers the electric potential from the high level back to the low level after the lapse of time determined in advance since the end of the application of the reference electric potential to the pixel circuit.

In addition, it is also desirable to drive the pulse voltage source in such a way that the pulse voltage source raises the electric potential appearing on the capacitor control line from a low level to a high level and lowers the electric potential from the high level back to the low level periodically for every horizontal scan period. Incidentally, it is desirable to employ a thin-film transistor of the N-channel type as the driving transistor.

In addition, the inventors of the present invention have also innovated a variety of electronic apparatus each employing the organic EL display panel having the panel structure described above. Each of the innovated electronic apparatus employs the organic EL display panel, a system control section for controlling the entire organic EL display system and an operation input section for receiving operation inputs entered to the system control section.

In the inventions innovated by the inventors of the present invention, an electric potential appearing on the capacitor control line is raised from a low level to a high level and lowered from the high level back to the low level after the lapse of time determined in advance since the rising edge of the electric potential at least one time during one field period in order to carry out a coupling driving operation on an electric potential appearing on the anode electrode of the organic EL device and an electric potential appearing on the gate electrode of the driving transistor.

By adoption of this driving method, it is possible to control each of the electric potential appearing on the anode electrode of the organic EL device and the electric potential appearing on the gate electrode of the driving transistor to a proper driving electric potential without driving a current supply line for supplying the driving current to the organic EL device by making use of an electric potential that has two levels. Thus, in comparison with a configuration in which the electric potential of the current supply line is supplied for each horizontal line as an electric potential that has two levels, the number of operation timings to be managed can be reduced to a fraction equal to a quotient obtained as a result of dividing 1 by the number of aforementioned horizontal lines because the capacitor control line CNTL employed in the innovated organic EL display panel is a line common to all the horizontal lines.

As a result, a driving signal conveyed by the current supply line can be shared by all horizontal lines as a driving signal common to all the horizontal lines or common to a plurality of horizontal lines. By sharing the driving signal in this way, the circuit configuration of the driving section can be made simpler and the size of the circuit can also be reduced as well. In this way, the cost of manufacturing the organic EL display panel can be decreased.

DETAILED DESCRIPTION OF THE PREFERRED EMBODIMENTS

The following description explains cases in which embodiments of the present invention are applied to an organic EL display panel of the active-matrix driving type. It is to be noted that any portion not shown in figures of the patent specification or any portion not described in the patent specification can be assumed to be a portion known in the field of the related technology or a portion according to a known technology. In addition, every embodiment explained in the following description is a typical implementation of the embodiments of the present invention and, thus, the embodiments of the present invention are by no means limited to the embodiments explained in the following description.

(A): External Configuration

It is to be noted that the organic EL display panel described in this patent specification is not merely a display panel obtained by creating a pixel array section and every driving circuit for driving the pixel array section on the same substrate in the same semiconductor process, but also an organic EL display panel obtained by implementing each driving circuit manufactured typically as a specific application IC on a substrate on which a pixel array section is created.

Figure 5:
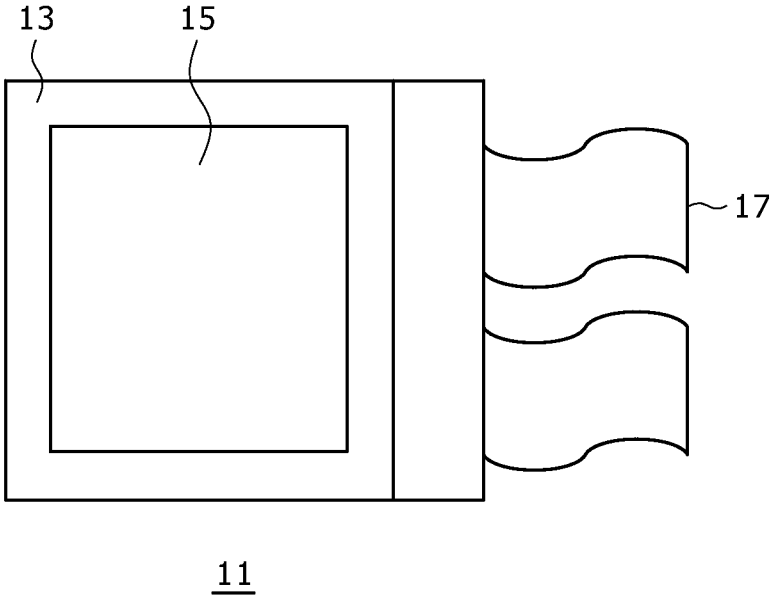
FIG. 5 is a diagram showing a typical external configuration of an organic EL display panel.

FIG. 5 is a diagram showing a typical external configuration of an organic EL display panel 11. As shown in the diagram of FIG. 5, the organic EL display panel 11 has a structure constructed by attaching a facing section 15 to an area included in a support substrate 13 to serve as an area in which a pixel array section is created.

The support substrate 13 is made from a material such as the glass, the plastic or another substance. The support substrate 13 has a structure built by laminating an organic EL layer or a protection film on the surface of the support substrate 13. By the same token, the facing section 15 is made from a material such as the glass, the plastic or another substance. It is to be noted that the organic EL display panel 11 also includes an FPC (Flexible Print Circuit) 17 for supplying typically signals to the support substrate 13 from external sources and outputting signals or the like from the support substrate 13 to external destinations.

(B): First Embodiment

(B-1): System Configuration

The following description explains a typical system configuration of the organic EL display panel 11 that is capable of avoiding the effects of characteristic variations of the driving transistor T2 from pixel and pixel and has fewer elements which compose each pixel circuit 9.

Figure 6:
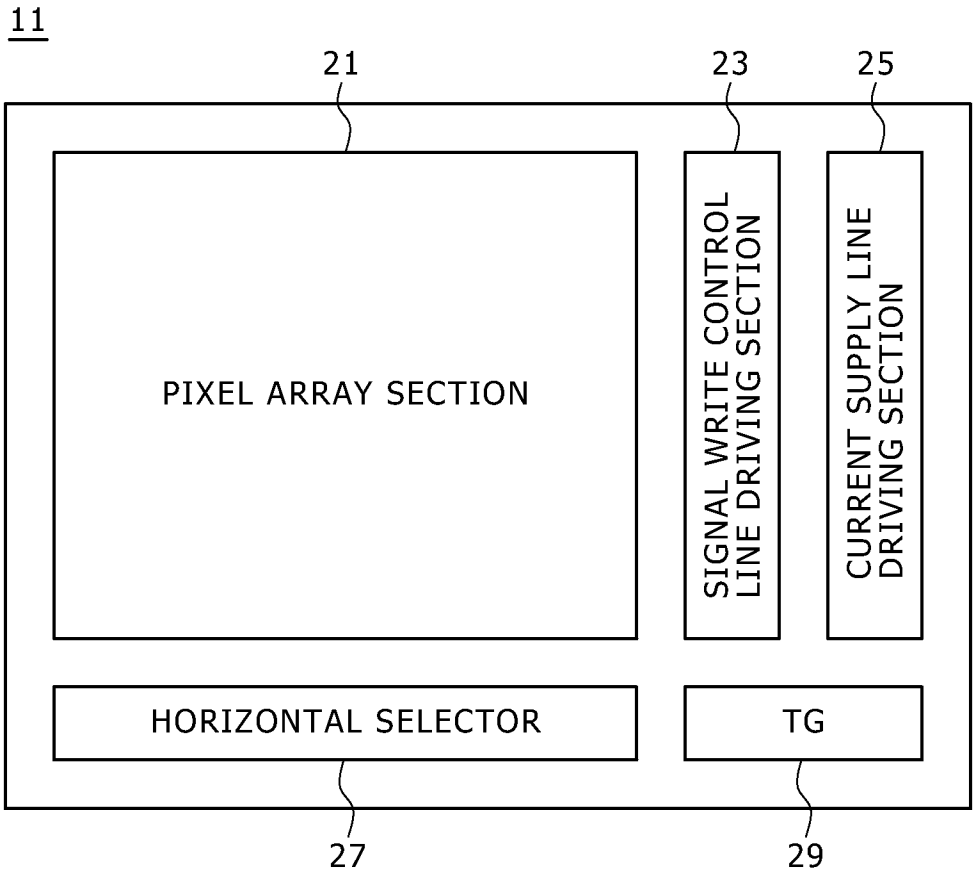
FIG. 6 is a block diagram showing a typical system configuration of an organic EL display panel according to a first embodiment.

FIG. 6 is a block diagram showing the typical system configuration of the organic EL display panel 11. The organic EL display panel 11 shown in the block diagram of FIG. 6 employs a pixel array section 21, a signal-write control line driving section 23, a current supply line driving section 25, a horizontal selector 27 and a timing generator 29. In particular, each of the signal-write control line driving section 23, the current supply line driving section 25 and the horizontal selector 27 serves as a driving circuit of the pixel array section 21.

The pixel array section 21 has a matrix structure including sub-pixel circuits each located at an intersection of a signal line DTL and a write control line WSL. Incidentally, the sub-pixel circuit is the smallest unit of the pixel structure of one pixel. For example, one pixel serving as a white unit is configured to include three different sub-pixel circuits, i.e., R (red), G (green) and B (blue) sub-pixel circuits.

Figure 7:
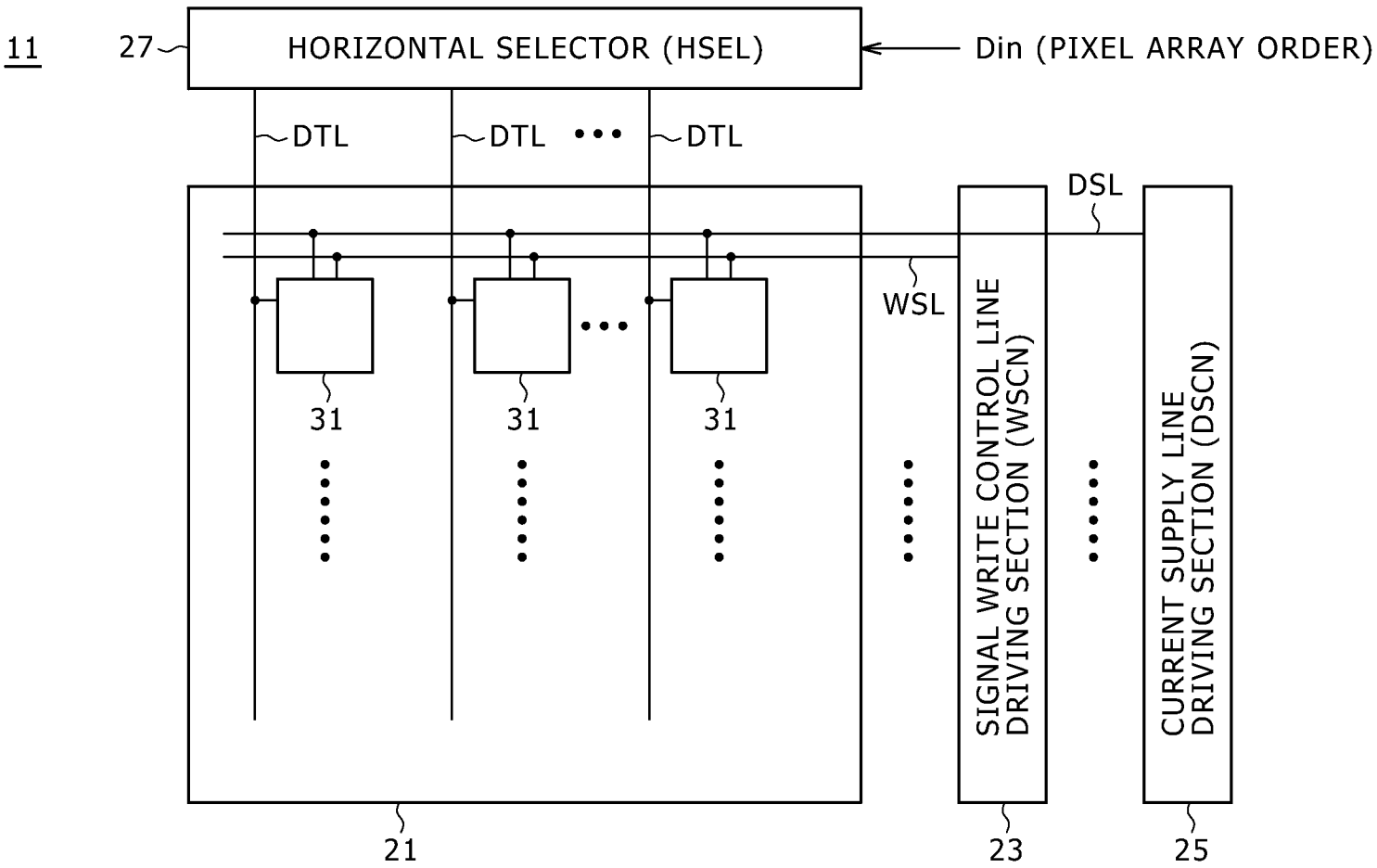
FIG. 7 is a block diagram showing wiring connections between pixel circuits each serving as a sub-pixel circuit in a pixel array section and a signal-write control line driving section, a current supply line driving section as well as a horizontal selector which each function as a driving circuit in the organic EL display panel according to the first embodiment.

FIG. 7 is a block diagram showing wiring connections between pixel circuits 31 each serving as a sub-pixel circuit in the pixel array section 21 and the signal-write control line driving section 23, the current supply line driving section 25 as well as the horizontal selector 27 which each function as a driving circuit.

Figure 8:
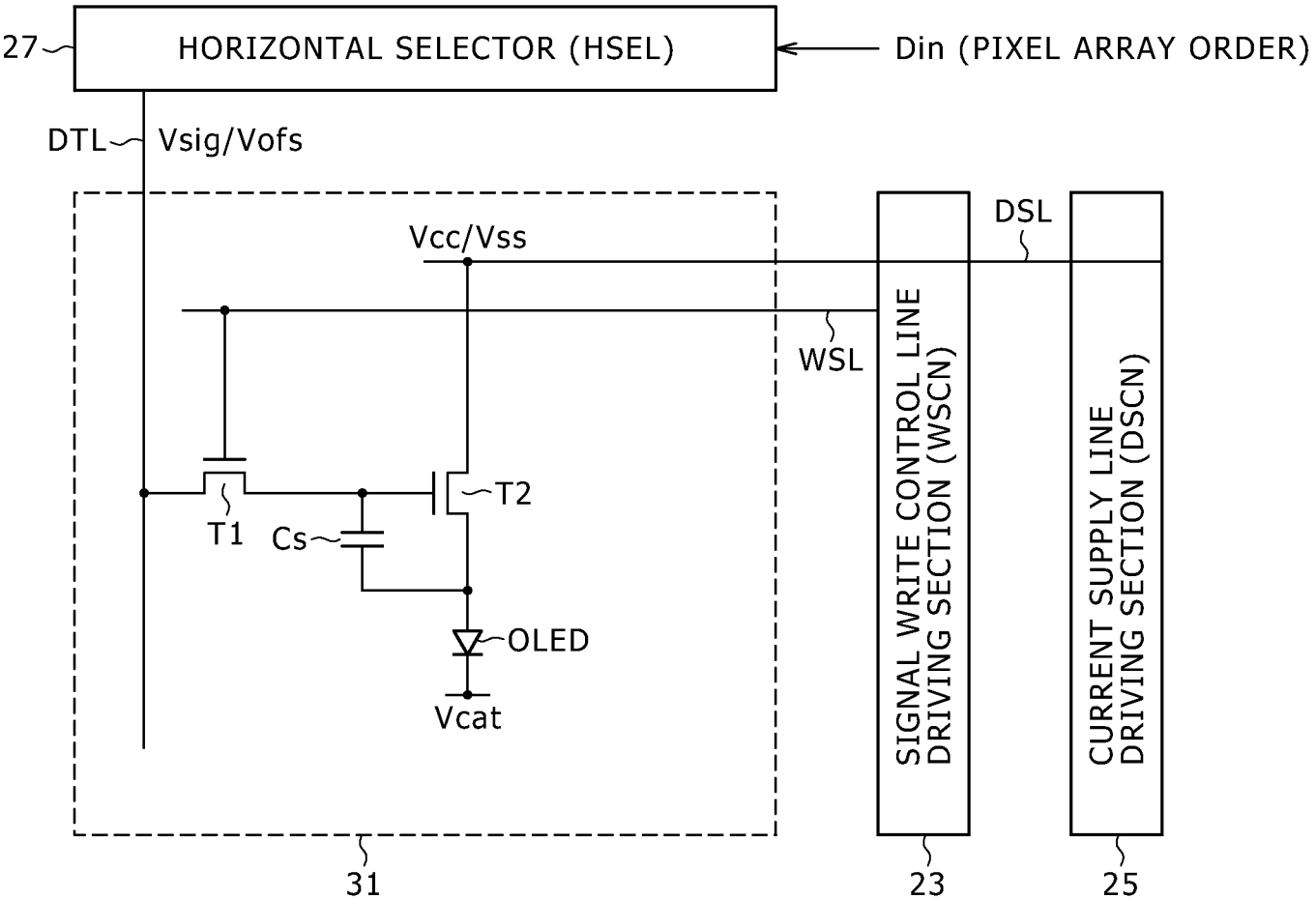
FIG. 8 is a block diagram showing wiring connections between the pixel circuit according to the first embodiment and the signal-write control line driving section, the current supply line driving section as well as the horizontal selector by focusing on the internal configuration of the pixel circuit.

FIG. 8 is a block diagram showing wiring connections between a pixel circuit 31 and the signal-write control line driving section 23, the current supply line driving section 25 as well as the horizontal selector 27 by focusing on the internal configuration of the pixel circuit 31. As shown in the block diagram of FIG. 8, the pixel circuit 31 employs a sampling transistor T1, a driving transistor T2, a signal holding capacitor Cs and an organic EL device OLED. Each of the sampling transistor T1 and the driving transistor T2 is a thin-film transistor of the N-channel type.

Also in the case of this circuit configuration, the signal-write control line driving section 23 controls an operation to put the sampling transistor T1 in a state of being turned on or turned off through the write control line WSL. The sampling transistor T1 is put in a state of being turned on or turned off in order to control an operation to store an electric potential appearing on the signal line DTL into the signal holding capacitor Cs. Incidentally, the signal-write control line driving section 23 is configured to employ a shift register which has as many output stages as vertical resolution granularities.

The current supply line driving section 25 sets an electric potential appearing on the current supply line DSL at one of two levels Vcc and Vss which are determined in advance as described later. The current supply line DSL is connected to specific one of main electrodes of the driving transistor T2 in order to control operations carried out by the pixel circuit 31 in collaborations with the other driving circuits which are the signal-write control line driving section 23 and the horizontal selector 27. The main electrodes of the driving transistor T2 are the source and drain electrodes of the driving transistor T2. The operations carried out by the pixel circuit 31 include not merely operations to drive the organic EL device OLED to emit light or emit no light, but also operations to compensate the pixel circuit 31 for characteristic variations from pixel to pixel. In the case of the first embodiment, the operations to compensate the pixel circuit 31 for characteristic variations from pixel to pixel include operations to compensate for threshold-voltage and mobility variations of the driving transistor T2 in order to get rid of uniformity deteriorations caused by the variations in threshold voltage and mobility.

The horizontal selector 27 asserts a signal electric potential Vsig representing pixel data Din or a reference electric potential Vofs for compensating the driving transistor T2 for effects of threshold-voltage variations from pixel to pixel on the signal line DTL. In the following description, the reference electric potential Vofs is also referred to as an offset electric potential Vofs. It is to be noted that the horizontal selector 27 is configured to include a shift register having as many output stages as horizontal resolution granularities. The horizontal selector 27 also employs a latch circuit, a D/A conversion circuit, a buffer circuit and a selector for each of the output stages.

The timing generator 29 is a circuit device for generating timing pulses desired for driving the write control line WSL, the current supply line DSL and the signal line DTL.

(B-2): Typical Driving Operations

Figures 9A, 9B, 9C, 9D, 9E:
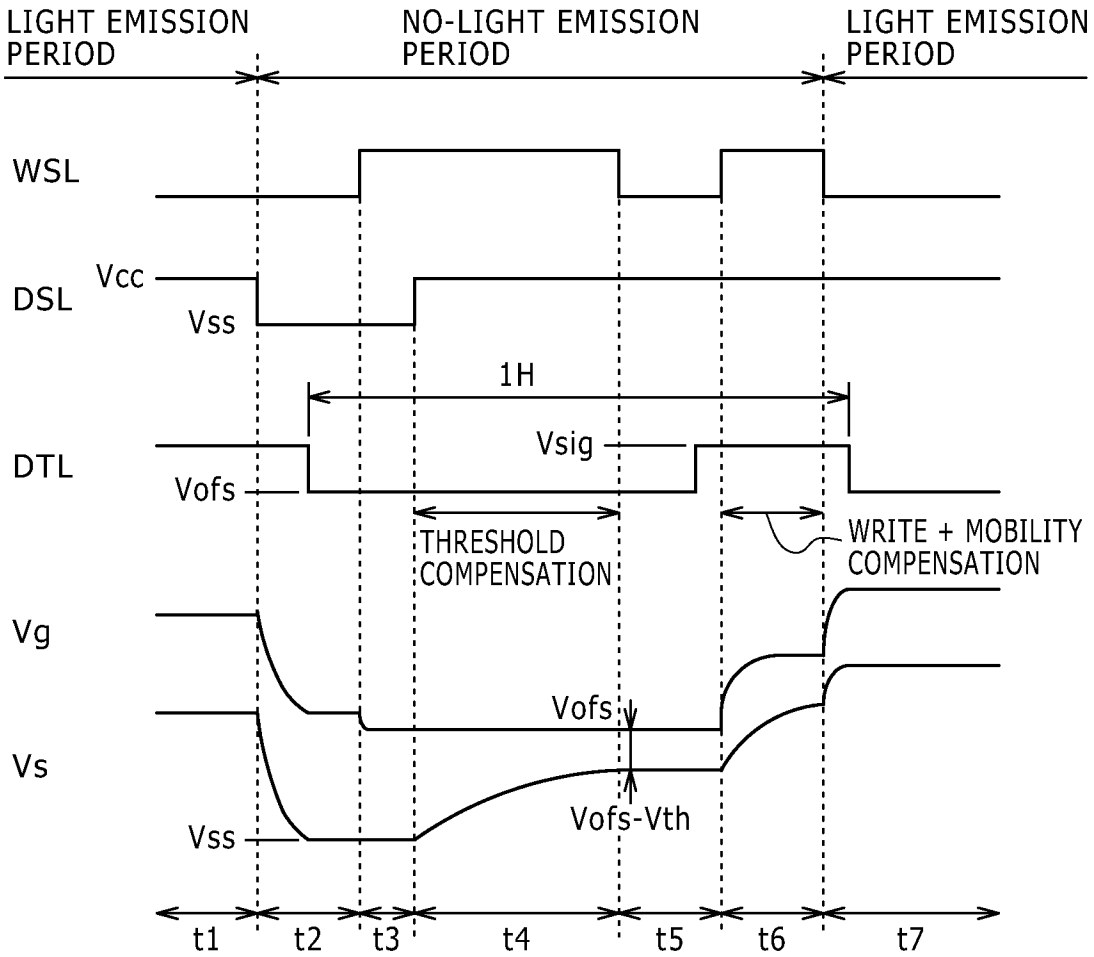
FIGS. 9A, 9B, 9C, 9D, and 9E reflect a timing diagram showing a plurality of timing charts of signals relevant to operations to drive the pixel circuit according to the first embodiment.

FIG. 9 is a timing diagram showing a plurality of timing charts of signals relevant to operations to drive the pixel circuit 31 included in the typical configuration shown in the block diagram of FIG. 8. Incidentally, in the timing diagram of FIG. 9, reference notation Vcc denotes a high-level electric potential asserted on the current supply line DSL to serve as a light emission electric potential whereas reference notation Vss denotes a low-level electric potential asserted on the current supply line DSL to serve as a no-light emission electric potential. As described earlier, the current supply line driving section 25 sets the electric potential appearing on the current supply line DSL at one of the two levels Vcc and Vss.

Figure 10:
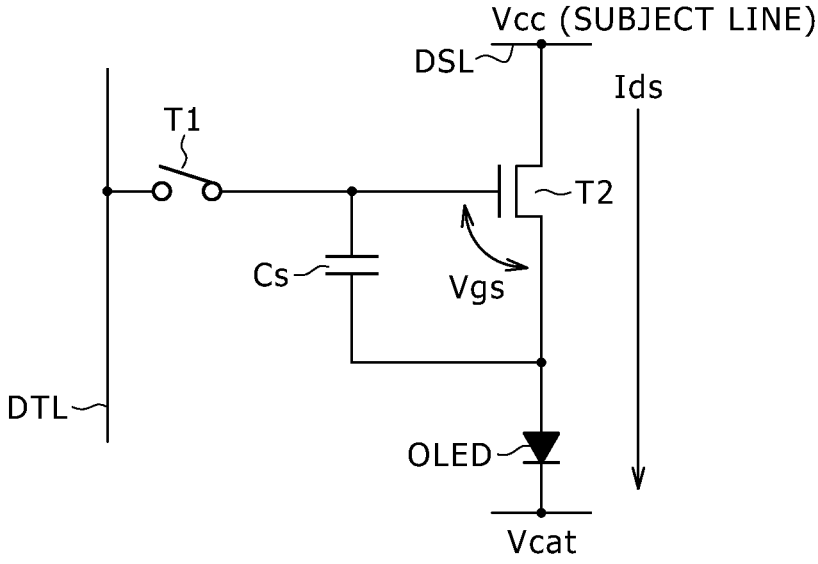
FIG. 10 is an explanatory circuit diagram to be referred to in description of an operating state of the pixel circuit according to the first embodiment.

First of all, the operation of the pixel circuit 31 in a light emission state is explained by referring to a circuit diagram of FIG. 10. In the light emission state, the sampling transistor T1 is in a state of being turned off. On the other hand, the driving transistor T2 is operating in a saturated region, supplying a driving current Ids determined by a gate-source voltage Vgs to the organic EL device OLED in a time period t1 shown in the timing diagram of FIG. 9.

Next, the operation of the pixel circuit 31 in a no-light emission state is explained. The state of the pixel circuit 31 is switched from the light emission state to the no-light emission state by changing the electric potential appearing on the current supply line DSL from the high-level electric potential Vcc to the low-level electric potential Vss in a time period t2 shown in the timing diagram of FIG. 9. In this case, if the low-level electric potential Vss is smaller than the sum of Vthel and Vcath (or Vss<(Vthel+Vcath)) where reference notation Vthel denotes the threshold voltage of the organic EL device OLED whereas reference notation Vcath denotes an electric potential appearing on the cathode electrode of the organic EL device OLED, the organic EL device OLED ceases to emit light.

Figure 11:
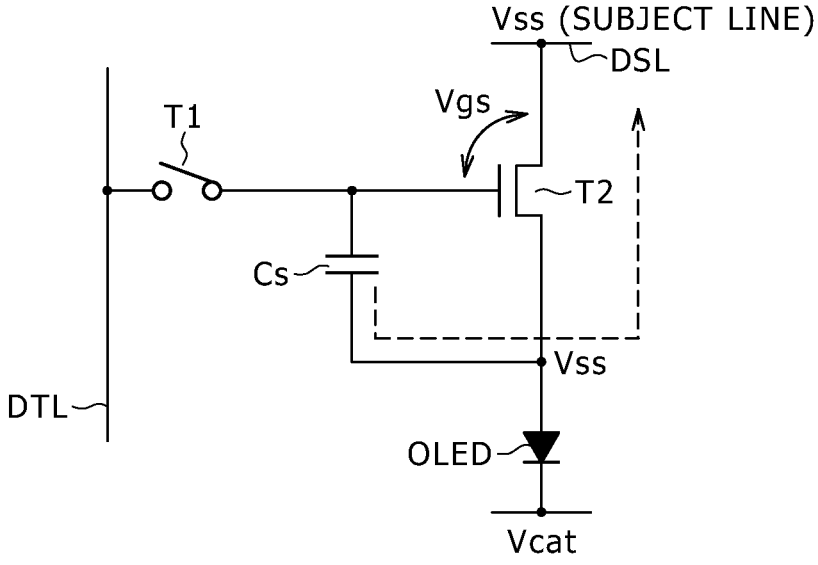
FIG. 11 is an explanatory circuit diagram to be referred to in description of another operating state of the pixel circuit according to the first embodiment.

It is to be noted that the source electric potential Vs of the driving transistor T2 is equal to the electric potential appearing on the current supply line DSL. That is to say, the anode electrode of the organic EL device OLED is electrically charged to the low-level electric potential Vss. FIG. 11 is a circuit diagram showing an operating state of the pixel circuit 31. As shown by a dashed-line arrow in the circuit diagram of FIG. 11, an electrical charge accumulated in the signal holding capacitor Cs is discharged to the current supply line DSL.

Later on, with an electric potential of the signal line DTL set at the offset electric potential Vofs for compensating the driving transistor T2 for effects of threshold-voltage variations from pixel to pixel, when an electric potential appearing on the write control line WSL is changed to a high level, the sampling transistor T1 is put in a state of being turned on, changing the gate electric potential Vg of the driving transistor T2 to the offset electric potential Vofs in a time period t3 shown in the timing diagram of FIG. 9.

Figure 12:
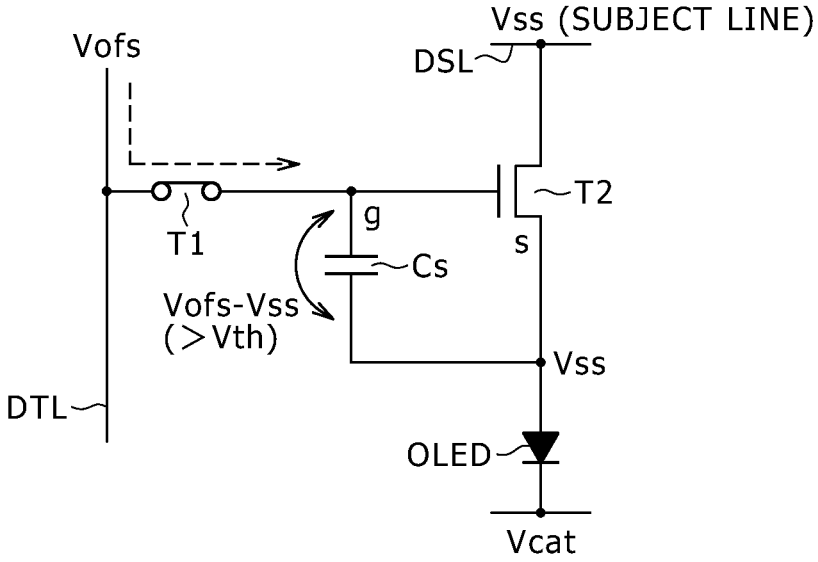
FIG. 12 is an explanatory circuit diagram to be referred to in description of a further operating state of the pixel circuit according to the first embodiment.

FIG. 12 is a circuit diagram showing an operating state of the pixel circuit 31 in this case. At that time, the gate-source voltage Vgs of the driving transistor T2 is set at an electric-potential difference of (Vofs−Vss). This electric-potential difference of (Vofs−Vss) is set at a value greater than the threshold voltage Vth of the driving transistor T2. This is because, if the relation (Vofs−Vss)>Vth is not satisfied, it may be impossible to carry out the operation to compensate the driving transistor T2 for effects of threshold-voltage variations from pixel to pixel.

Figure 13:
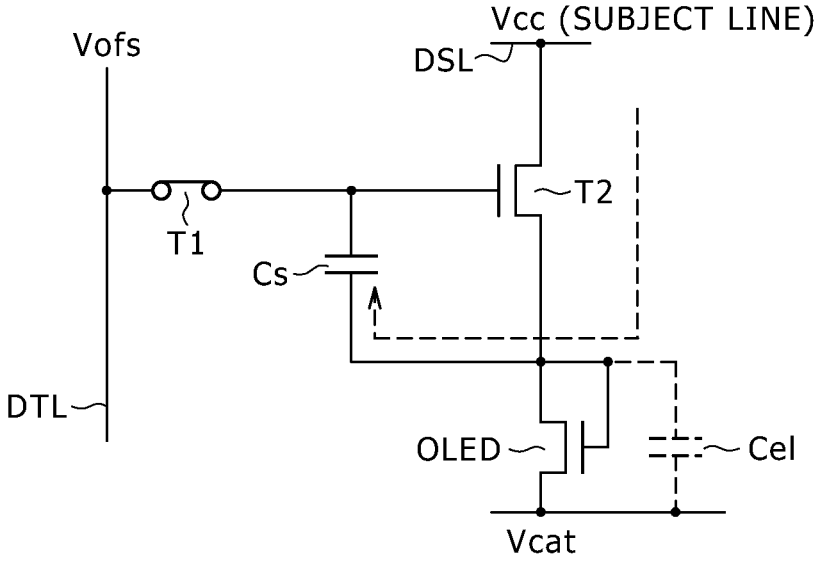
FIG. 13 is an explanatory circuit diagram to be referred to in description of a still further operating state of the pixel circuit according to the first embodiment.

Next, the electric potential appearing on the current supply line DSL is changed from the low-level electric potential Vss back to the high-level electric potential Vcc in a time period t4 shown in the timing diagram of FIG. 9. FIG. 13 is a circuit diagram showing an operating state of the pixel circuit 31 in this case. It is to be noted that, in the circuit diagram of FIG. 13, the organic EL device OLED is shown as an equivalent circuit thereof.

To put in detail, the organic EL device OLED is shown as an equivalent circuit which consists of a diode and a parasitic capacitor Cel. In this case, the driving current Ids flowing through the driving transistor T2 is used for electrically charging the signal holding capacitor Cs and the parasitic capacitor Cel as long as the relation Vel≤(Vcat+Vthel) is satisfied provided that the leak current of the organic EL device OLED can be assumed to be smaller than the driving current Ids flowing through the driving transistor T2. In the relation, reference notation Vel denotes an electric potential appearing on the anode electrode of the organic EL device OLED, reference notation Vthel denotes the threshold voltage Vthel of the organic EL device OLED whereas reference notation Vcath denotes an electric potential appearing on the cathode electrode of the organic EL device OLED. The electric potential Vel appearing on the anode electrode of the organic EL device OLED is the source electric potential Vs of the driving transistor T2.

Figure 14:
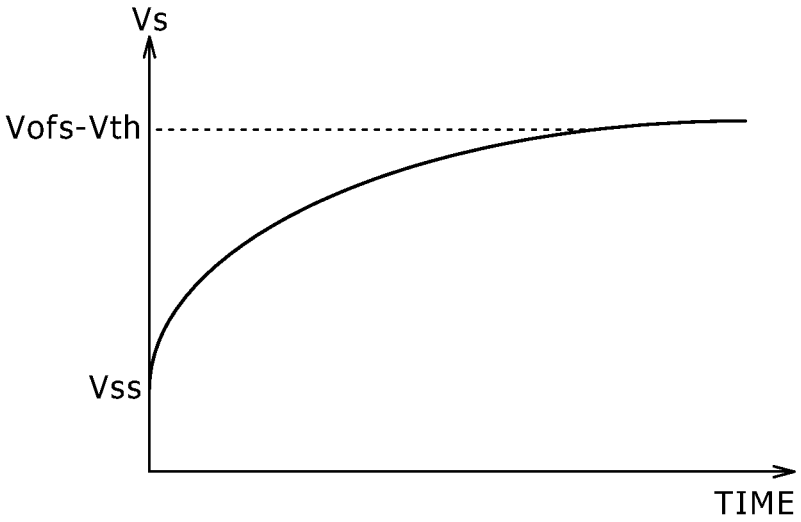
FIG. 14 is a diagram showing a curve representing changes of the source electric potential of the driving transistor with the lapse of time.

As a result, the electric potential Vel appearing on the anode electrode of the organic EL device OLED rises with the lapse of time as shown in a diagram of FIG. 14. That is to say, in a state of fixing the gate electric potential of the driving transistor T2 at the offset electric potential Vofs as it is, the source electric potential Vs of the driving transistor T2 starts to rise. This operation is the operation to compensate the driving transistor T2 for effects of threshold-voltage variations from pixel to pixel.

In due course of time, the gate-source voltage Vgs of the driving transistor T2 attains the threshold voltage Vth of the driving transistor T2. At that time, the relation Vel=(Vofs−Vth)≤(Vcat+Vthel) is satisfied. As the operation to compensate the driving transistor T2 for effects of threshold-voltage variations from pixel to pixel is ended, the sampling transistor T1 is again controlled to enter a state of being turned off in a time period t5 shown in the timing diagram of FIG. 9.

Figure 15:
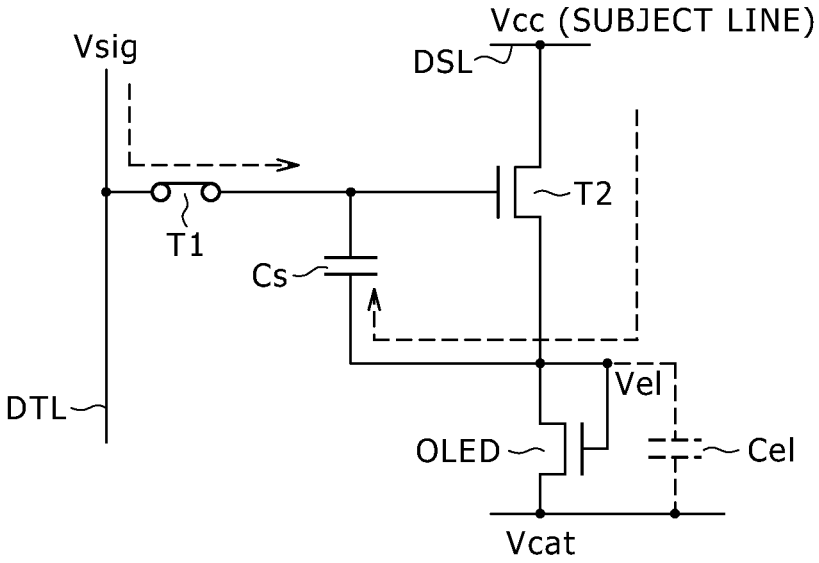
FIG. 15 is an explanatory circuit diagram to be referred to in description of a still further operating state of the pixel circuit according to the first embodiment.

Then, after a timing desired to change the signal line DTL to the signal electric potential Vsig, the sampling transistor T1 is again controlled to enter a state of being turned on in a time period t6 shown in the timing diagram of FIG. 9. FIG. 15 is a circuit diagram showing an operating state of the pixel circuit 31 in this case. Incidentally, the signal electric potential Vsig is an electric potential representing the gradation value of the pixel circuit 31.

At that time, the gate electric potential Vg of the driving transistor T2 is changed to the signal electric potential Vsig. On the other hand, the source electric potential Vs of the driving transistor T2 rises with the lapse of time due to a current flowing to the signal holding capacitor Cs from the current supply line DSL.

At that time, if the source electric potential Vs of the driving transistor T2 does not exceed the sum of the threshold voltage Vthel of the organic EL device OLED and the cathode voltage Vcat of the organic EL device OLED, that is, if the leak current of the organic EL device OLED is much smaller than the driving current Ids flowing through the driving transistor T2, the driving current Ids flowing through the driving transistor T2 is used for electrically charging the signal holding capacitor Cs and the parasitic capacitor Cel.

Figure 16:
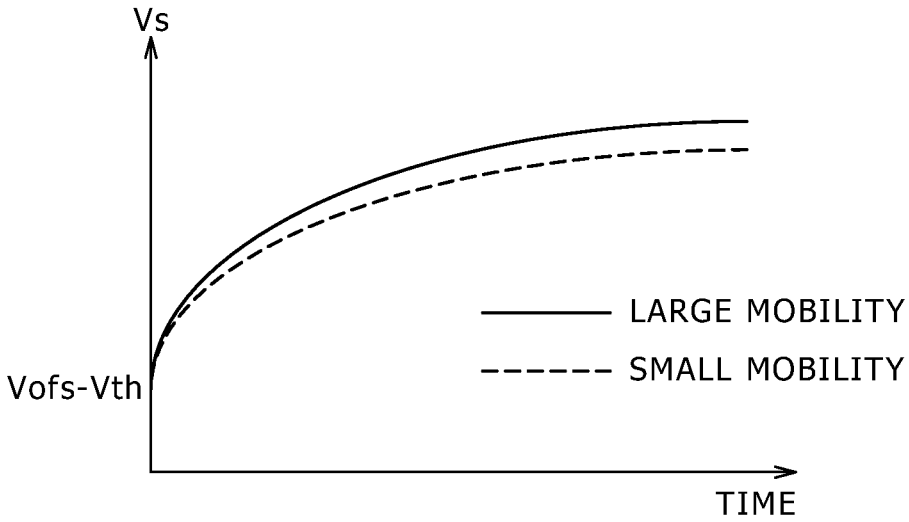
FIG. 16 is a diagram showing curves representing changes of the source electric potential of the driving transistor with the lapse of time for different mobility values.

It is to be noted that, since the operation to compensate the driving transistor T2 for effects of threshold-voltage variations from pixel to pixel has been ended, the driving current Ids flowing through the driving transistor T2 has a magnitude reflecting the mobility μ of the driving transistor T2. To put it concretely, the larger the mobility μ of a driving transistor T2, the larger the driving current Ids flowing through the driving transistor T2 and, hence, the higher the speed at which the source electric potential Vs rises as shown by a solid-line curve in a diagram of FIG. 16. On the contrary, the smaller the mobility μ of a driving transistor T2, the smaller the driving current Ids flowing through the driving transistor T2 and, hence, the lower the speed at which the source electric potential Vs rises as shown by a dashed-line curve in the diagram of FIG. 16.

As a result, a voltage held by the signal holding capacitor Cs is compensated for variations of the mobility μ of the driving transistor T2 from pixel to pixel. That is to say, the gate-source voltage Vgs of the driving transistor T2 changes to a voltage obtained as a result of compensating the driving transistor T2 for effects of variations in mobility μ from pixel to pixel.

Figure 17:
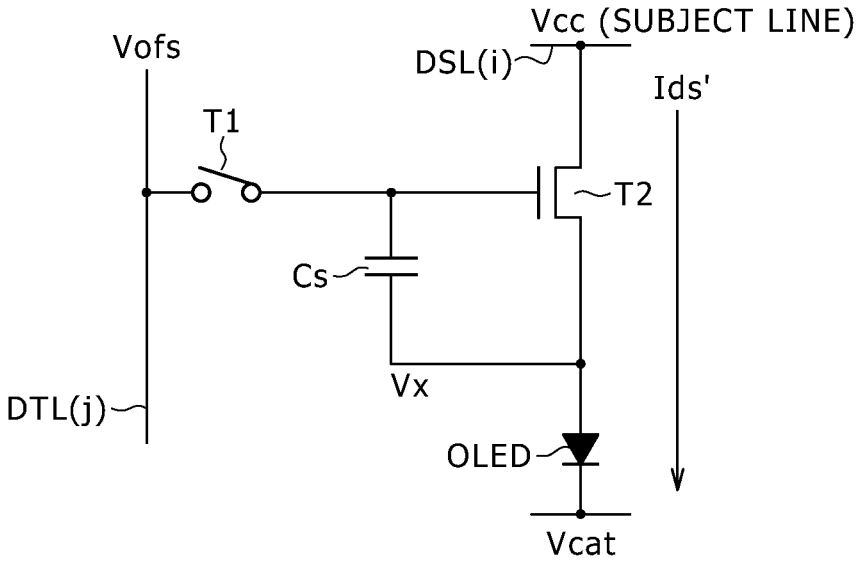
FIG. 17 is an explanatory circuit diagram to be referred to in description of a still further operating state of the pixel circuit according to the first embodiment.

Finally, the sampling transistor T1 is controlled to enter a state of being turned off in order to terminate the operation to store the signal electric potential Vsig in the signal holding capacitor Cs in a time period t7 shown in the timing diagram of FIG. 9, the organic EL device OLED starts an operation to emit light. FIG. 17 is a circuit diagram showing an operating state of the pixel circuit 31 in this case. It is to be noted that the gate-source voltage Vgs of the driving transistor T2 is held at a fixed magnitude. Thus, in this state, the driving transistor T2 outputs a constant driving current Ids' to the organic EL device OLED.

Thus, the anode electric potential Vel appearing on the anode electrode of the organic EL device OLED rises to an electric potential level Vx which causes the driving current Ids' to flow to the organic EL device OLED. As a result, the organic EL device OLED starts to emit light.

Incidentally, also in the case of the pixel circuit 31 according to this first embodiment, as the length of the light emission time period increases, that is, as time goes by, the I-V characteristic of the organic EL device OLED changes as described earlier by referring to the diagram of FIG. 3.

Thus, the source electric potential Vs of the driving transistor T2 also changes. Since the gate-source voltage Vgs of the driving transistor T2 is held at a fixed level by the signal holding capacitor Cs, however, the magnitude of the driving current Ids supplied to the organic EL device OLED does not change, allowing the luminance of light emitted by the organic EL device OLED to be kept at a constant value. Thus, by utilization of the pixel circuit 31 according to the first embodiment and adoption of the driving method for driving the pixel circuit 31, without regard to changes exhibited by the I-V characteristic of the organic EL device OLED with the lapse of time, it is possible to allow the driving current Ids determined by the signal electric potential Vsig to typically continue to flow to the organic EL device OLED. As a result, the luminance of light emitted by the organic EL device OLED can be sustained continuously at a value determined merely by the signal electric potential Vsig without being affected by the changes exhibited by the I-V characteristic of the organic EL device OLED with the lapse of time.

(B-3): Conclusion

As described above, by utilization of the pixel circuit 31 according to the first embodiment and adoption of the driving method for driving the pixel circuit 31, even if a thin-film transistor of the N-channel type is employed to serve as the driving transistor T2 of the pixel circuit 31, it is possible to implement an organic EL display panel which does not have light-luminance variations from pixel to pixel. In addition, all the transistors employed in the pixel circuit 31 can each be created as a thin-film transistor of the N-channel type so that a process of an amorphous silicon family can be utilized as a process of manufacturing the organic EL display panel.

(C): Second Embodiment (C-1): System Configuration

A second embodiment implements a structure of an organic EL display panel that can be manufactured at an even lower cost and implements a method for driving the organic EL devices employed in the organic EL display panel.

Figure 18:
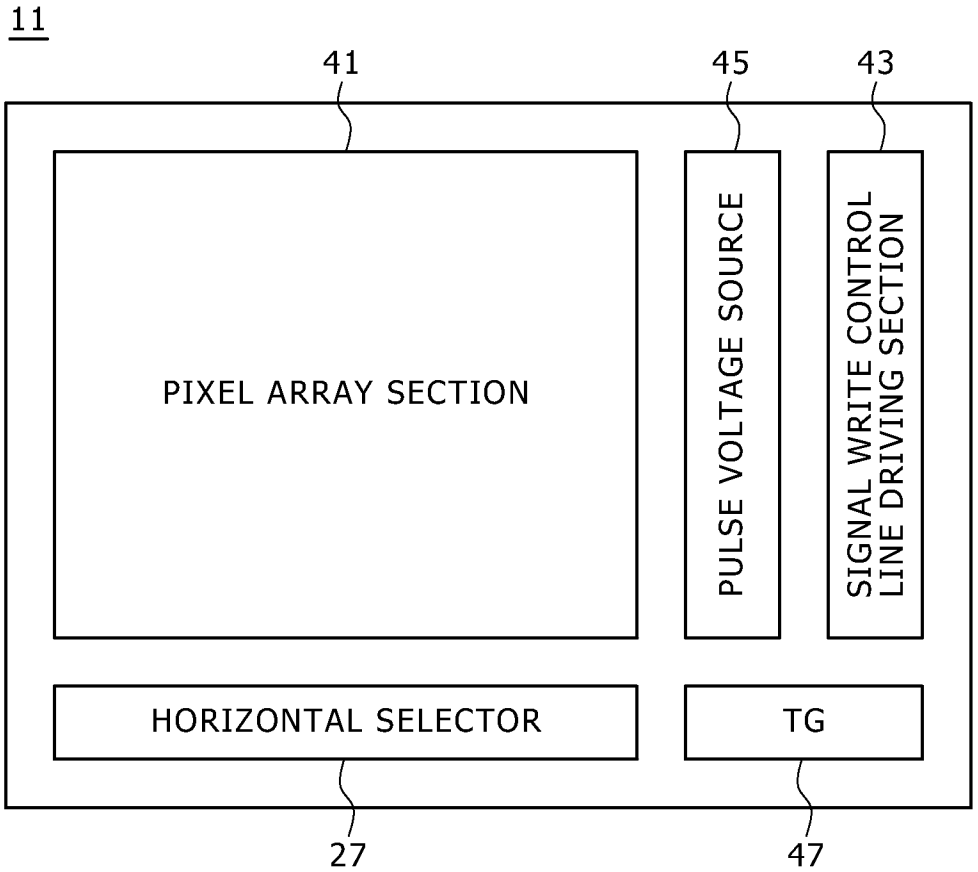
FIG. 18 is a block diagram showing a typical system configuration of an organic EL display panel according to a second embodiment.

FIG. 18 is a block diagram showing a typical system configuration of the organic EL display panel 11. Elements employed in this typical system configuration as elements identical with their respective counterparts included in the system configuration shown in the block diagram of FIG. 6 are denoted by the same reference numerals and reference notations as the counterparts. The organic EL display panel 11 shown in the block diagram of FIG. 18 employs a pixel array section 41, a signal-write control line driving section 43, a pulse voltage source 45, a horizontal selector 27 and a timing generator 47. In particular, each of the signal-write control line driving section 43, the pulse voltage source 45 and the horizontal selector 27 serves as a driving circuit of the pixel array section 41.

The pixel array section 41 also adopts the active-matrix driving method. Thus, the pixel array section 41 also has a matrix structure including sub-pixel circuits each located at an intersection of a signal line DTL and a write control line WSL. In the case of the second embodiment, however, a power-supply electric potential asserted on a power-supply line for supplying the driving current Ids is a fixed high-level electric potential Vcc. Thus, a mechanism capable of controlling the gate electric potential Vg of the driving transistor T2 and the anode electric potential Vel of the organic EL device OLED through other lines is newly added to the configuration of the pixel circuit 51.

Figure 19:
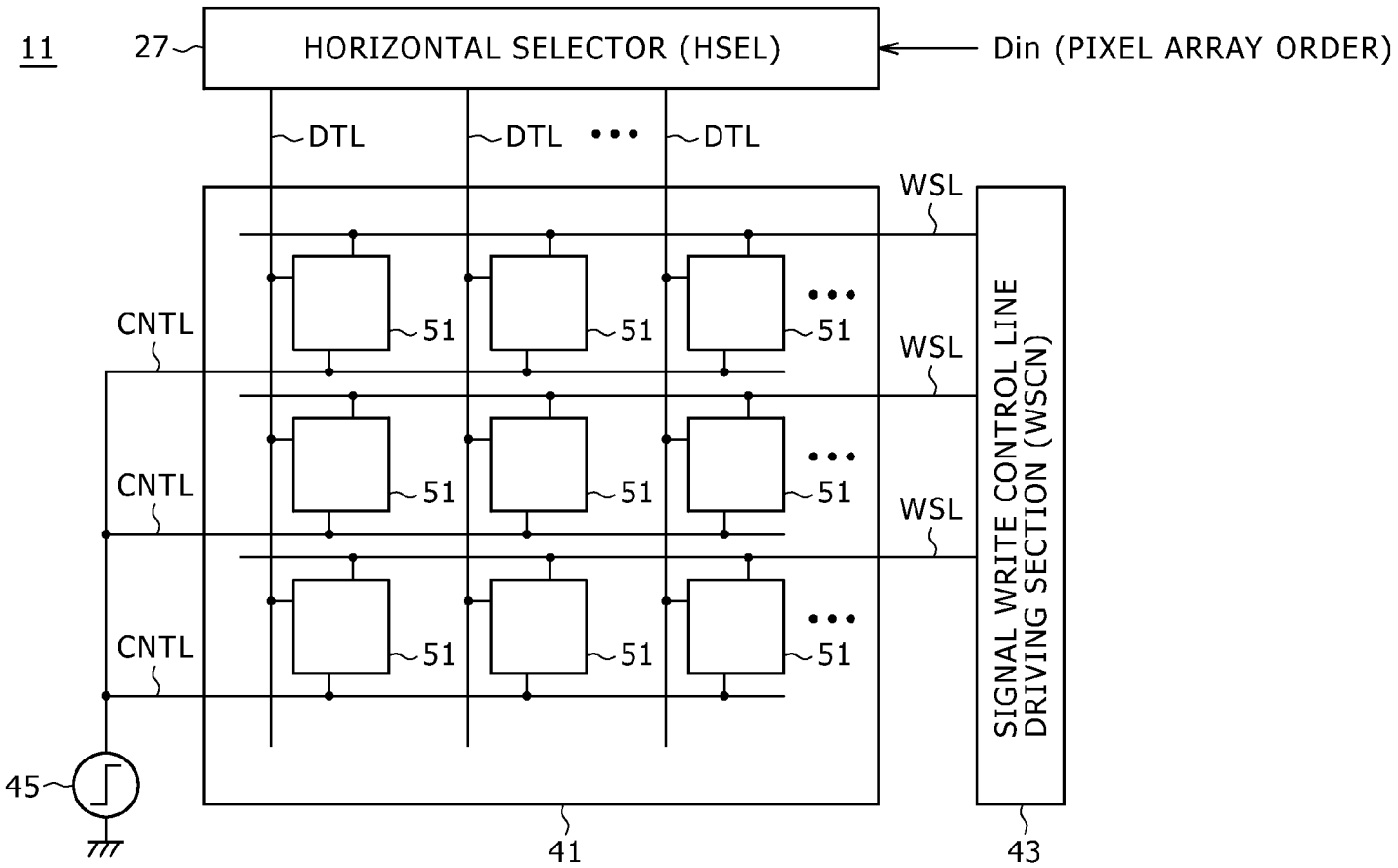
FIG. 19 is a block diagram showing wiring connections between pixel circuits each serving as a sub-pixel circuit in a pixel array section and a signal-write control line driving section, a pulse voltage source as well as a horizontal selector which each function as a driving circuit in the organic EL display panel according to the second embodiment.
Figure 20:
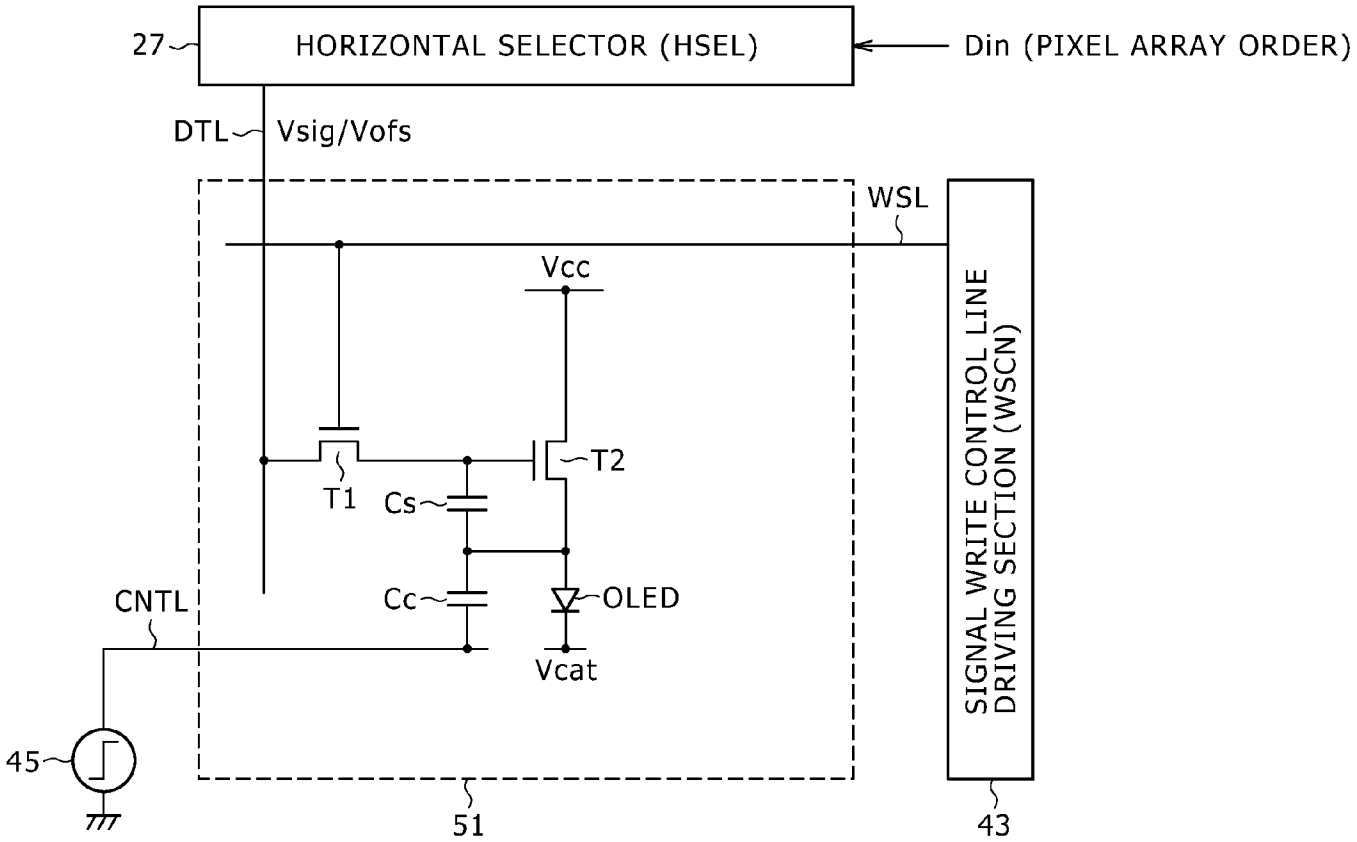
FIG. 20 is a block diagram showing wiring connections between the pixel circuit according to the second embodiment and the signal-write control line driving section, the pulse voltage source as well as the horizontal selector by focusing on the internal configuration of the pixel circuit.

FIG. 19 is a block diagram showing wiring connections between the pixel circuits 51 each serving as a sub-pixel circuit in the pixel array section 41 and the signal-write control line driving section 43, the pulse voltage source 45 as well as the horizontal selector 27 which each function as a driving circuit. FIG. 20 is a block diagram showing wiring connections between a pixel circuit 51 and the signal-write control line driving section 43, the pulse voltage source 45 as well as the horizontal selector 27 by focusing on the internal configuration of the pixel circuit 51. As shown in the block diagram of FIG. 20, the pixel circuit 51 employs a sampling transistor T1, a driving transistor T2, a signal holding capacitor Cs, a coupling capacitor Cc and an organic EL device OLED. Each of the sampling transistor T1 and the driving transistor T2 is a thin-film transistor of the N-channel type.

As shown in the block diagram of FIG. 20, the sampling transistor T1, the driving transistor T2, the signal holding capacitor Cs and the organic EL device OLED are connected to each other in the same way as the first embodiment. The coupling capacitor Cc is a new element employed in the pixel circuit 51. A specific electrode of the coupling capacitor Cc is connected to the source electrode of the driving transistor T2. As described before, the source electrode of the driving transistor T2 is connected to the anode electrode of the organic EL device OLED. The other electrode of the coupling capacitor Cc is connected to a capacitor control line CNTL which is a line common to all pixel circuits 51.

In the case of this embodiment, the capacitor control line CNTL is stretched along a horizontal line. However, the capacitor control line CNTL can also be stretched along a pixel column which is oriented in a direction perpendicular to the horizontal line. In either case, all the capacitor control lines CNTL are connected to each other at a junction point at one end to form a single line which is electrically connected to the output terminal of the pulse voltage source 45.

Also in the case of the second circuit configuration, the signal-write control line driving section 43 controls an operation to put the sampling transistor T1 in a state of being turned on or turned off through the write control line WSL. The sampling transistor T1 is put in a state of being turned on or turned off in order to control an operation to store an electric potential appearing on the signal line DTL into the signal holding capacitor Cs. Incidentally, the signal-write control line driving section 43 is configured to employ a shift register which has as many output stages as vertical resolution granularities.

The pulse voltage source 45 is a circuit device for setting the capacitor control line CNTL electrically connected to each of the pixel circuits 51 at 2 predetermined electric-potential levels, i.e., a high-level electric potential Vdd and a low-level electric potential Vini. The pulse voltage source 45 generates a pulse signal periodically, that is, one pulse every horizontal scan period. The high and low levels of the pulse signal are the high-level electric potential Vdd and the low-level electric potential Vini respectively.

To put it in detail, in the case of the second embodiment, the pulse voltage source 45 generates a pulse at the start of the horizontal scan period and keeps the high-level electric potential of the pulse at the high-level electric potential Vdd for a fixed period. Then, the pulse voltage source 45 pulls down the pulse to the low-level electric potential Vini and sustains the low-level electric potential at the low-level electric potential Vini for the rest of the horizontal scan period. The pulse voltage source 45 carries out this operation repeatedly as long as the power supply is on.

It is to be noted that the width of the pulse is determined by considering the length of time desired for carrying out a threshold-voltage compensation preparation process to be described later. The width of the pulse is the length of a time period during which the electric potential of the pulse is sustained at the high-level electric potential Vdd.

In the case of the second embodiment, changes of an electric potential appearing on the capacitor control line CNTL are shared by all pixel circuits 51 as changes common to all the pixel circuits 51. Thus, the changes of the electric potential appearing on the capacitor control line CNTL also raise and pull down the gate electric potential Vg and the source electric potential Vs, which appear respectively on the gate and source electrodes of the driving transistor T2, by a level difference determined by the quantity of a coupling effect.

Incidentally, if the gate electrode of the driving transistor T2 is in a floating state caused by a turned-off state of the sampling transistor T1 or the opened state of the sampling transistor T1, the gate electric potential Vg of the driving transistor T2 varies in a manner of being interlocked with changes of the source electric potential Vs of the driving transistor T2 while sustaining the gate-source voltage Vgs of the driving transistor T2 at a constant magnitude.

If the gate electrode of the driving transistor T2 is in a fixed state held by a turned-on state of the sampling transistor T1 or the closed state of the sampling transistor T1, on the other hand, merely the source electric potential Vs of the driving transistor T2 varies in a manner of being interlocked with changes of the electric potential appearing on the capacitor control line CNTL. As a result, the gate-source voltage Vgs of the driving transistor T2 varies from a level established before a change of the electric potential appearing on the capacitor control line CNTL to a level prevailing after the change.

In the case of the second embodiment, by setting the capacitor control line CNTL electrically connected to each of the pixel circuits 51 at two predetermined electric-potential levels, i.e., the high-level electric potential Vdd and the low-level electric potential Vini, as described above in collaborations with operations carried out by the other driving circuits to control electric potentials appearing on the other lines, it is possible to correctly carry out a threshold-voltage compensation preparation process, a threshold-voltage compensation process, an operation to store the signal electric potential Vsig into the signal holding capacitor Cs and a mobility compensation process. By correctly carry out the threshold-voltage compensation process and the mobility compensation process, it is possible to compensate the driving transistor T2 for characteristic variations from pixel to pixel and get rid of uniformity deteriorations caused by the characteristic variations representing variations in threshold voltage and mobility in the same way as the first embodiment.

The horizontal selector 27 asserts a signal electric potential Vsig representing pixel data Din or a reference voltage Vofs for compensating the driving transistor T2 for effects of threshold-voltage variations from pixel to pixel on the signal line DTL. In this patent specification, the reference voltage Vofs is also referred to as an offset electric potential Vofs. It is to be noted that the horizontal selector 27 is configured to include a shift register having as many output stages as horizontal resolution granularities. The horizontal selector 27 also employs a latch circuit, a D/A conversion circuit, a buffer circuit and a selector for each of the output stages.

The selector carries out an operation to select the signal electric potential Vsig or the offset electric potential Vofs as an electric potential to be applied to the signal line DTL for the output stage associated with the selector. The timing generator 47 is a circuit device for generating timing pulses desired for driving the write control line WSL, the capacitor control line CNTL and the signal line DTL.

(C-2): Typical Driving Operations

Figures 21A, 21B, 21C, 21D, 21E:
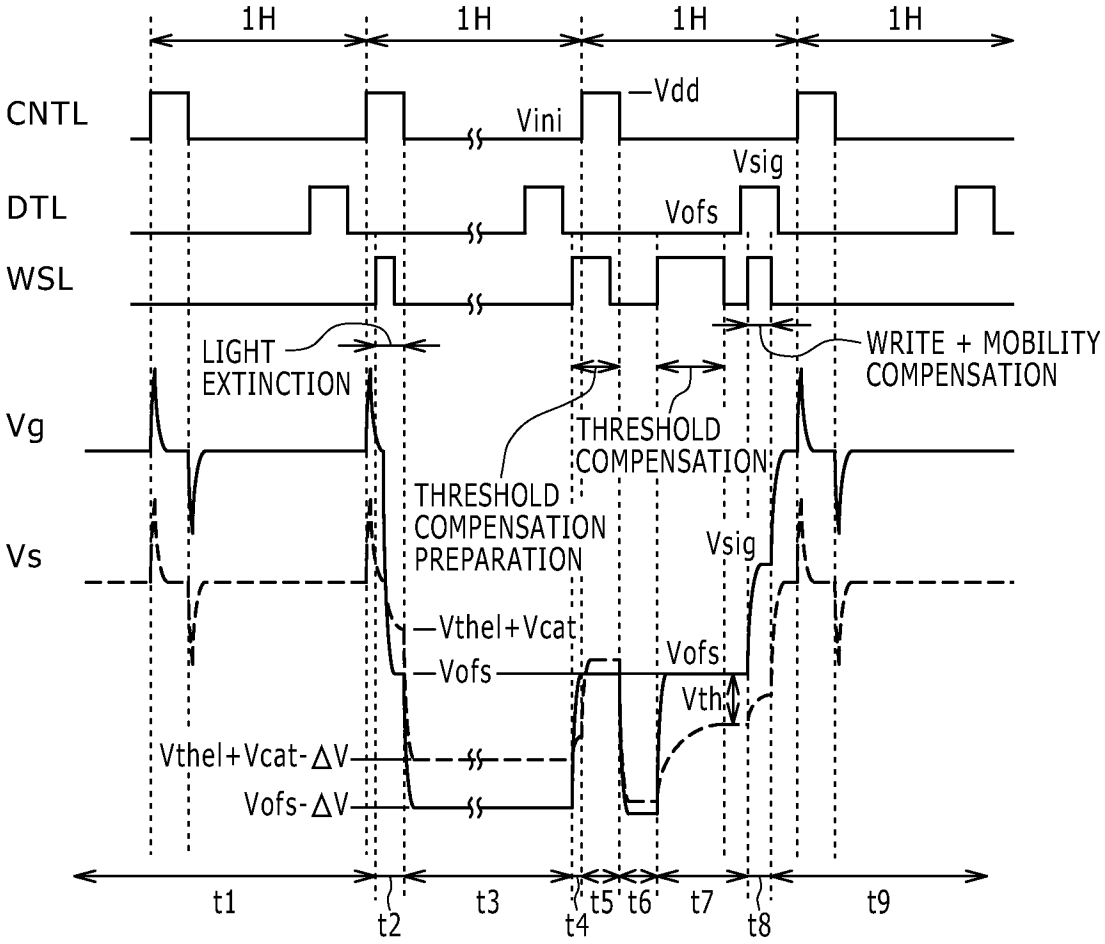
FIGS. 21A, 21B, 21C, 21D, and 21E reflect a timing diagram showing a plurality of timing charts of signals relevant to operations to drive the pixel circuit according to the second embodiment.

FIG. 21 is a timing diagram showing a plurality of timing charts of signals relevant to operations to drive the pixel circuit 51 included in the typical configuration shown in the block diagram of FIG. 20. Incidentally, in the timing diagram of FIG. 21, reference notation Vdd denotes the high-level electric potential of the two power-supply electric potentials applied to the capacitor control line CNTL whereas reference notation Vini denotes the low-level electric potential of the two power-supply electric potentials.

Figure 22:
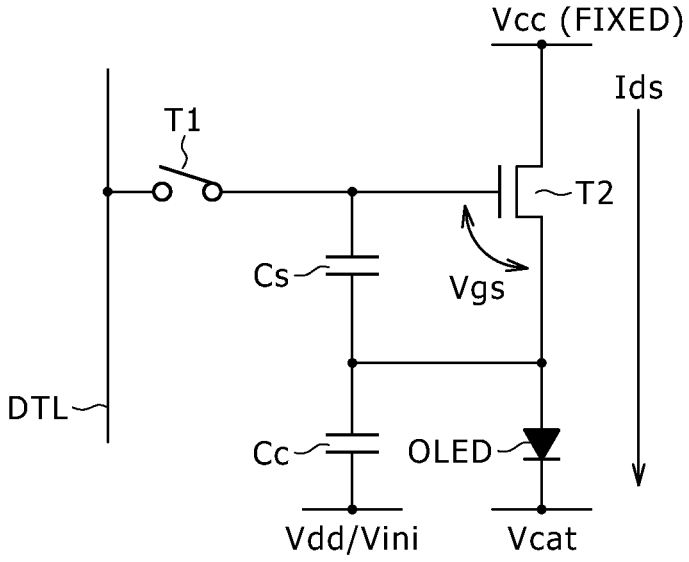
FIG. 22 is an explanatory circuit diagram to be referred to in description of an operating state of the pixel circuit according to the second embodiment.

First of all, the operation of the pixel circuit 51 in a light emission state is explained by referring to a circuit diagram of FIG. 22. At that time, the sampling transistor T1 is in a state of being turned off. Thus, the gate electrode of the driving transistor T2 is in a state of being floated.

As a result, every time the electric potential appearing on the capacitor control line CNTL rises to a high level within a horizontal scan period in a periodical operation, a positive-direction coupling waveform is introduced during a time period t1 shown in the timing diagram of FIG. 21 into a signal shown by a timing chart D of the timing diagram of FIG. 21 to represent the gate electric potential Vg of the driving transistor T2 and a signal shown by a timing chart E of the timing diagram of FIG. 21 to represent the source electric potential Vs of the driving transistor T2. Every time the electric potential appearing on the capacitor control line CNTL falls to a low level within a horizontal scan period in a periodical operation, on the other hand, a negative-direction coupling waveform is introduced during the time period t1 shown in the timing diagram of FIG. 21 into the signal shown by the timing chart D of the timing diagram of FIG. 21 to represent the gate electric potential Vg of the driving transistor T2 and the signal shown by the timing chart E of the timing diagram of FIG. 21 to represent the source electric potential Vs of the driving transistor T2.

It is to be noted that, since the gate electrode of the driving transistor T2 is in a state of being floated, the gate-source voltage Vgs of the driving transistor T2 is sustained at a fixed magnitude as it is in spite of the introduction of the coupling waveforms. Thus, the operation carried out by the driving transistor T2 in the saturated region is continued. As a result, the organic EL device OLED maintains the light emission state of emitting light with a luminance according to the driving current Ids determined by the gate-source voltage Vgs of the driving transistor T2 throughout one horizontal scan period.

Figure 23:
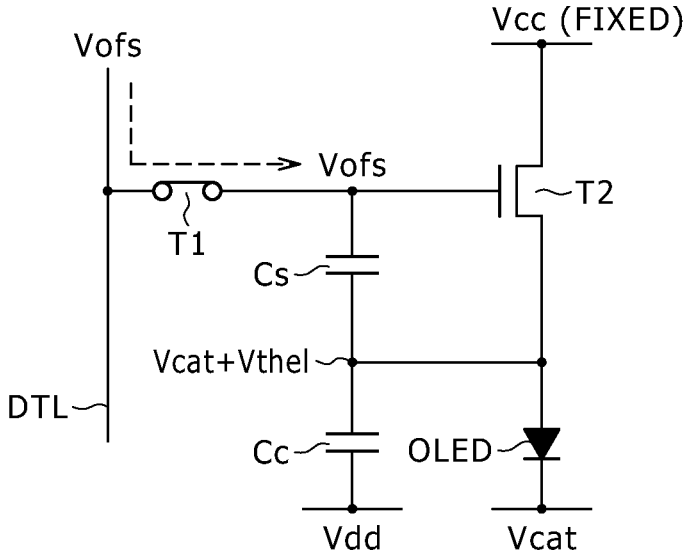
FIG. 23 is an explanatory circuit diagram to be referred to in description of another operating state of the pixel circuit according to the second embodiment.

Next, operations in a no-light emission state are explained. The no-light emission state is started when the electric potential appearing on the write control line WSL is set at a high level while the electric potential appearing on the capacitor control line CNTL is being held at the high-level electric potential Vdd and the electric potential appearing on the signal line DTL is being held at the offset electric potential Vofs in a time period t2 shown in the timing diagram of FIG. 21. FIG. 23 is a circuit diagram showing an operating state of the pixel circuit 51 at this point of time.

At that time, a signal shown by the timing chart D of the timing diagram of FIG. 21 to represent the gate electric potential Vg of the driving transistor T2 is controlled to approach the offset electric potential Vofs.

On the other hand, a signal shown by the timing chart E of the timing diagram of FIG. 21 to represent the source electric potential Vs of the driving transistor T2 is pulled down by a drop corresponding to the quantity of the coupling effect generated by the signal holding capacitor Cs. As a result, if the gate-source voltage Vgs of the driving transistor T2 becomes smaller than the threshold voltage Vth of the driving transistor T2, the organic EL device OLED makes a transition from the light emission state to the no-light emission state.

At that time, if the source electric potential Vs of the driving transistor T2 is equal to or smaller than the sum of the threshold voltage Vthel and cathode voltage Vcat of the organic EL device OLED, no leak current is flowing through the organic EL device OLED so that the voltage after the transition is sustained as it is. It is to be noted that, as described before, the source electric potential Vs of the driving transistor T2 is the anode electric potential Vel appearing on anode electrode of the organic EL device OLED.

If the source electric potential Vs of the driving transistor T2 is equal to or greater than the sum of the threshold voltage Vthel of the organic EL device OLED and the cathode voltage Vcat, on the other hand, an electric charge is discharged from the signal holding capacitor Cs through the organic EL device OLED. As a result, the source electric potential Vs of the driving transistor T2 becomes equal to the sum of the threshold voltage Vthel of the organic EL device OLED and the cathode voltage Vcat (that is, Vthel+Vcat).

FIG. 23 is a circuit diagram showing an operating state of the pixel circuit 51 as a state in which the source electric potential Vs of the driving transistor T2 becomes equal to (Vthel+Vcat). It is to be noted that the offset electric potential Vofs can be set any level as long as the level does not exceed the sum of the cathode voltage Vcat, the threshold voltage Vthel of the organic EL device OLED and the threshold voltage Vth of the driving transistor T2.

When the operation to store the offset electric potential Vofs in the signal holding capacitor Cs is completed, the sampling transistor T1 is controlled to enter a state of being turned off in a time period t3 shown in the timing diagram of FIG. 21. As the sampling transistor T1 enters the state of being turned off, the gate electrode of the driving transistor T2 is put in a state of being floated.

Figure 24:
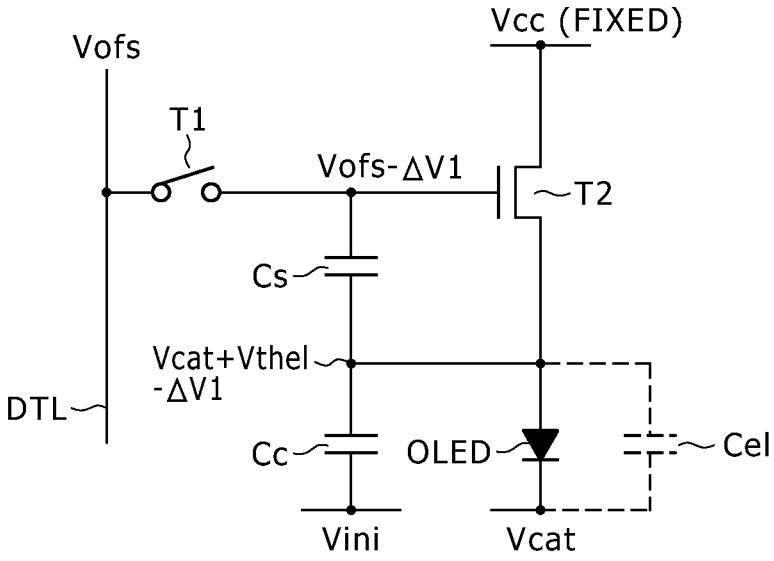
FIG. 24 is an explanatory circuit diagram to be referred to in description of a further operating state of the pixel circuit according to the second embodiment.

Later on, the electric potential appearing on the capacitor control line CNTL is controlled to change from the high-level electric potential Vdd to the low-level electric potential Vini. FIG. 24 is a circuit diagram showing an operating state of the pixel circuit 51 at this point of time.

At that time, a coupling component ΔV1 expressed by an equation given below is superposed on each of the gate electric potential Vg and the source electric potential Vs which respectively appear on the gate and source electrodes of the driving transistor T2.

$$\Delta V1=\{Cc/(Cc+Cel)\}\cdot(Vdd-Vini)$$

Incidentally, in the above equation, reference notation Cc denotes the capacitance of the coupling capacitor Cc whereas reference notation Cel denotes the capacitance of a parasitic capacitor of the organic EL device OLED.

It is to be noted that, during a time period which is ended when a threshold-voltage compensation preparation process is started, the coupling component ΔV1 is superposed on each of the gate electric potential Vg and the source electric potential Vs which respectively appear on the gate and source electrodes of the driving transistor T2 every time the electric potential appearing on the capacitor control line CNTL changes from the high-level electric potential Vdd to the low-level electric potential Vini and from the low-level electric potential Vini to the high-level electric potential Vdd.

Of course, when the electric potential appearing on the capacitor control line CNTL changes from the high-level electric potential Vdd to the low-level electric potential Vini, a negative-direction coupling component ΔV1 is superposed on each of the gate electric potential Vg and the source electric potential Vs which respectively appear on the gate and source electrodes of the driving transistor T2. When the electric potential appearing on the capacitor control line CNTL changes from the low-level electric potential Vini to the high-level electric potential Vdd, on the other hand, a positive-direction coupling component ΔV1 is superposed on each of the gate electric potential Vg and the source electric potential Vs.

Figure 25:
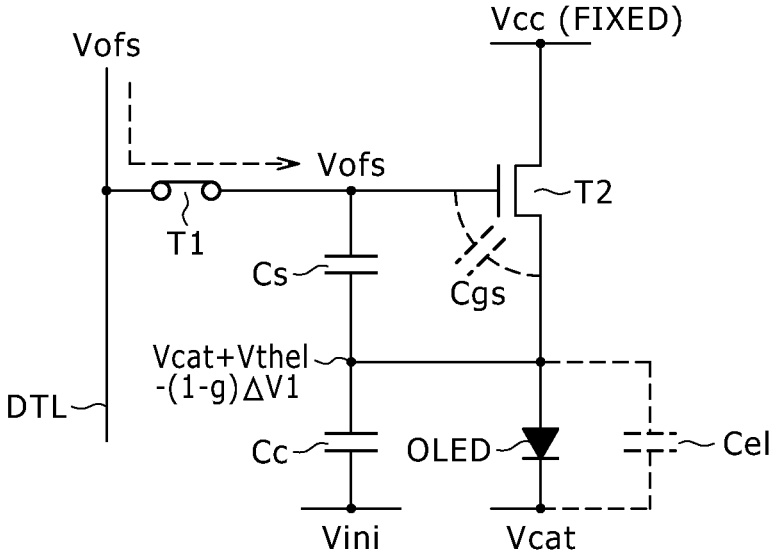
FIG. 25 is an explanatory circuit diagram to be referred to in description of a still further operating state of the pixel circuit according to the second embodiment.

In due course of time, in time periods t4 and t5 shown in the timing diagram of FIG. 21, the period of the threshold-voltage compensation preparation process is commenced. To put it in detail, in the time period t4 shown in the timing diagram of FIG. 21, in a state of setting the electric potential appearing on the capacitor control line CNTL at the low-level electric potential Vini and setting the electric potential appearing on the signal line DTL at the offset electric potential Vofs, the threshold-voltage compensation preparation process is commenced by putting the sampling transistor T1 in a state of being turned on. FIG. 25 is a circuit diagram showing an operating state of the pixel circuit 51 at this point of time.

With the sampling transistor T1 put in a state of being turned on at this point of time, the offset electric potential Vofs is sampled, causing the gate electric potential Vg and the source electric potential Vs which appear respectively on the gate and source electrodes of the driving transistor T2 to change. To put it in detail, the gate electric potential Vg of the driving transistor T2 changes to the offset electric potential Vofs whereas the source electric potential Vs of the driving transistor T2 changes from (Vcat+Vthel−ΔV1) to (Vcat+Vthel−ΔV1+ΔV2). The term ΔV2 representing the change in source electric potential Vs is expressed by the following equation:

$$\Delta V2=\{(Cs+Cgs)/(Cs+Cgs+Cc+Cel)\}\cdot\Delta V1=g\cdot\Delta V1$$

Furthermore, during the period of the threshold-voltage compensation preparation process, with the sampling transistor T1 put in a state of being turned on, the electric potential appearing on the capacitor control line CNTL is controlled to change from the low-level electric potential Vini to the high-level electric potential Vdd to give rise to a positive-direction coupling component ΔV3 superposed on the source electric potential Vs of the driving transistor T2 as described above. Accompanying the superposition of this positive-direction coupling component ΔV3, the source electric potential Vs of the driving transistor T2 changes. To put it in detail, the source electric potential Vs of the driving transistor T2 rises from (Vcat+Vthel−(1−g)·ΔV1) to (Vcat+Vthel−(1−g)·ΔV1+ΔV3).

The positive-direction coupling component ΔV3 representing the change in source electric potential Vs is expressed by the following equation:

$$\Delta V3=\{Cc/(Cs+Cgs+Cc+Cel)\}\cdot(Vdd-Vini)$$

Figure 26:
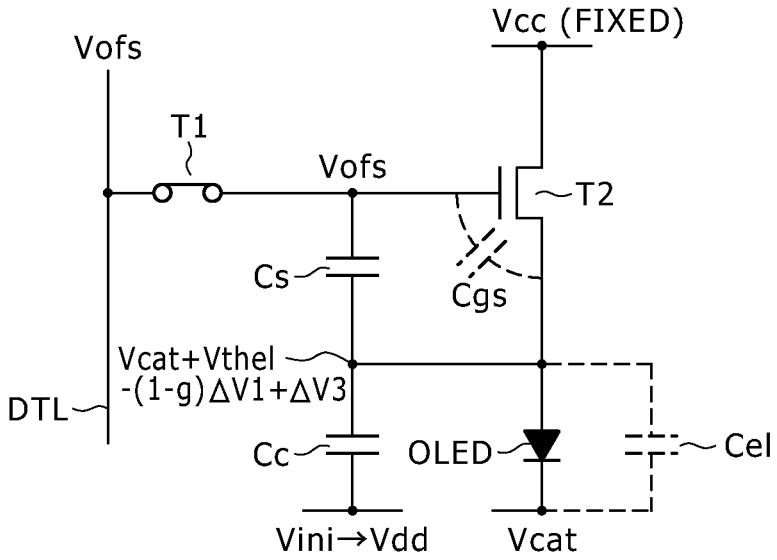
FIG. 26 is an explanatory circuit diagram to be referred to in description of a still further operating state of the pixel circuit according to the second embodiment.

The threshold-voltage compensation preparation process is ended when the positive-direction coupling component ΔV3 is superposed on the source electric potential Vs of the driving transistor T2. In the time period t5 shown in the timing diagram of FIG. 21, the gate-source voltage Vgs of the driving transistor T2 is controlled to enter a reversed-bias state as a result of the superposition of the positive-direction coupling component ΔV3 on the source electric potential Vs of the driving transistor T2. FIG. 26 is a circuit diagram showing an operating state of the pixel circuit 51 at this point of time.

Then, as the threshold-voltage compensation preparation process is ended, with the sampling transistor T1 put in a state of being turned off, the electric potential appearing on the capacitor control line CNTL is controlled to change from the high-level electric potential Vdd to the low-level electric potential Vini. That is to say, with the gate electrode of the driving transistor T2 put in a state of being floated, the electric potential appearing on the capacitor control line CNTL is driven to generate a negative-direction coupling component ΔV1. The negative-direction coupling component ΔV1 generated at this time is the same as that for the case of the time period t3 shown in the timing diagram of FIG. 21.

Figure 27:
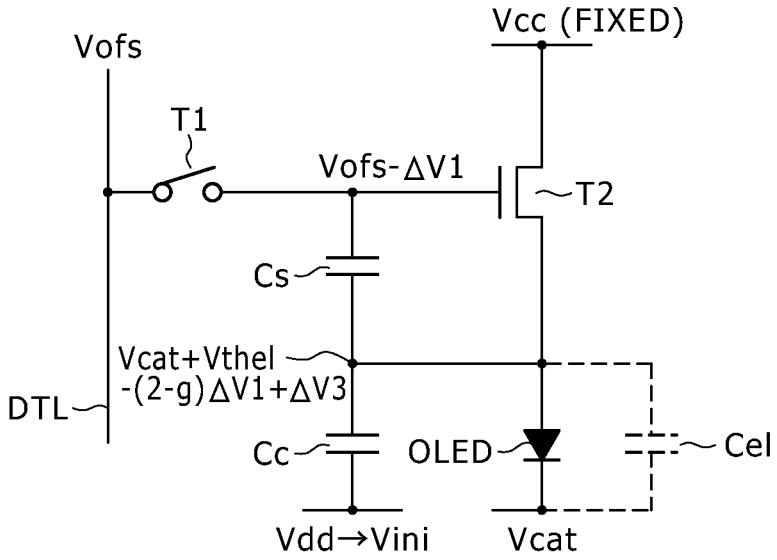
FIG. 27 is an explanatory circuit diagram to be referred to in description of a still further operating state of the pixel circuit according to the second embodiment.

Thus, in a state of sustaining the gate-source voltage Vgs of the driving transistor T2 at a voltage appearing prior to the coupling driving operation as it is, each of the gate electric potential Vg and the source electric potential Vs, which appear respectively on the gate and source electrodes of the driving transistor T2, changes in the negative direction by the negative-direction coupling component ΔV1. FIG. 27 is a circuit diagram showing an operating state of the pixel circuit 51 at this point of time.

Later on, a threshold-voltage compensation process is commenced in a time period t7 shown in the timing diagram of FIG. 21. This threshold-voltage compensation process is commenced by controlling the sampling transistor T1 to enter a state of being turned off at a point of time the electric potential appearing on the capacitor control line CNTL is at the low-level electric potential Vini and the electric potential appearing on the signal line DTL is at the offset electric potential Vofs. Of course, at that time, the gate electric potential Vg of the driving transistor T2 is also controlled to change to the offset electric potential Vofs.

Figure 28:
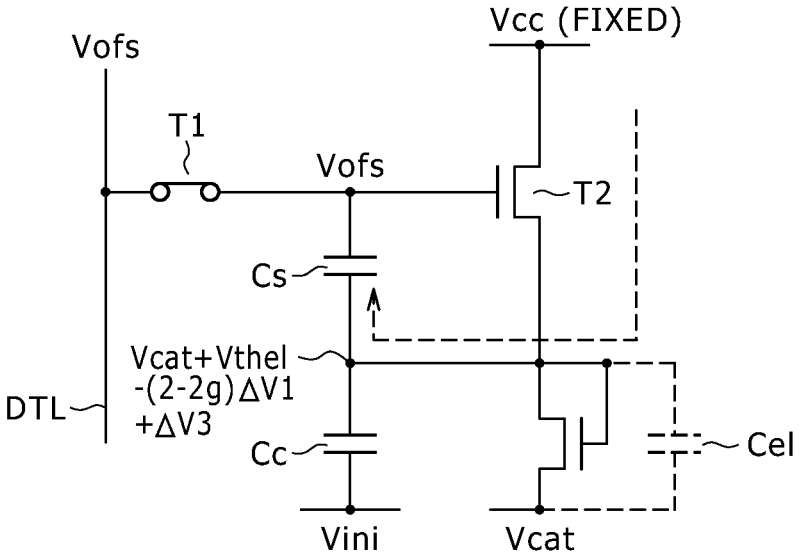
FIG. 28 is an explanatory circuit diagram to be referred to in description of a still further operating state of the pixel circuit according to the second embodiment.

In the mean time, the source electric potential Vs of the driving transistor T2 changes to an electric potential obtained by superposing a coupling component of g·ΔV1 on the electric potential appearing on the source electrode of the driving transistor T2 right before the threshold-voltage compensation process. FIG. 28 is a circuit diagram showing an operating state of the pixel circuit 51 at this point of time. As shown in the circuit diagram of FIG. 28, the source electric potential Vs of the driving transistor T2 changes to Vcat+Vthel−(2−2g)·ΔV1+ΔV3.

As a result, the gate-source voltage Vgs of the driving transistor T2 is expressed by the following equation:

$$Vgs=Vofs-Vcat-Vthel+2(1-g)\cdot\Delta V1-\Delta V3$$

If this gate-source voltage Vgs is greater than the threshold voltage Vth of the driving transistor T2, the threshold-voltage compensation process is commenced. In other words, the gate-source voltage Vgs is desired to have a magnitude greater than the threshold voltage Vth of the driving transistor T2.

If the gate-source voltage Vgs is greater than the threshold voltage Vth of the driving transistor T2, as shown by a dashed-line arrow in the circuit diagram of FIG. 28, a current flows from the current supply line (which serves as a power-supply line) in a direction toward the signal holding capacitor Cs.

It is to be noted that the organic EL device OLED can be represented by an equivalent circuit which consists of a diode and a capacitor. Thus, if the relation Vel≤(Vcat+Vthel) is satisfied, that is, if the leak current of the organic EL device OLED is smaller than the driving current Ids flowing through the driving transistor T2, the driving current Ids flowing through the driving transistor T2 is used for electrically charging the signal holding capacitor Cs.

Figure 29:
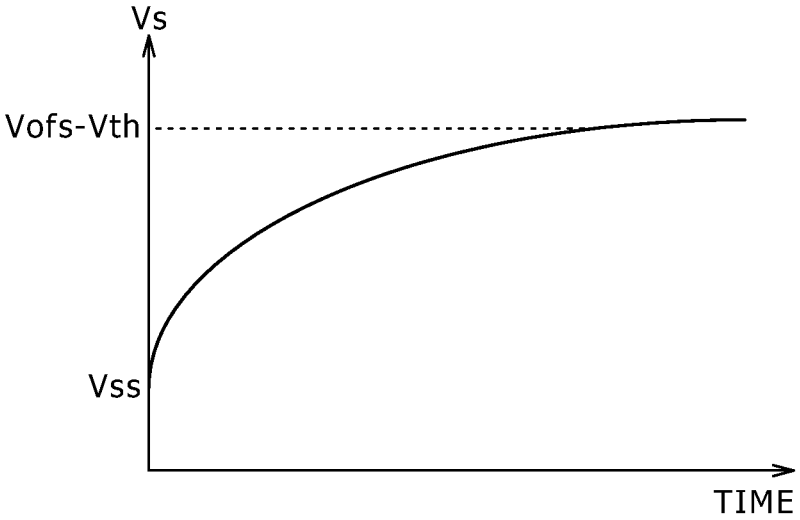
FIG. 29 is a diagram showing a curve representing changes of the source electric potential of the driving transistor with the lapse of time.

At that time, the anode electric potential Vel of the organic EL device OLED starts to rise gradually with the lapse of time as shown in a diagram of FIG. 29. After the lapse of time determined in advance, the gate-source voltage Vgs of the driving transistor T2 becomes equal to the threshold voltage Vth of the driving transistor T2. Later on, the sampling transistor T1 is controlled to enter a state of being turned off in order to end the threshold-voltage compensation process.

At that time, the anode electric potential Vel of the organic EL device OLED can be expressed by the following equation:

$$Vel=Vofs-Vth\leq Vcat+Vthel$$

Figure 30:
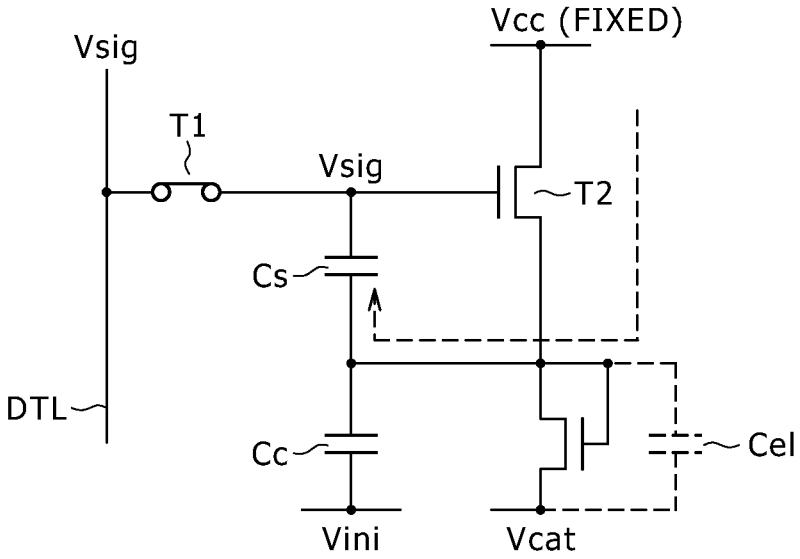
FIG. 30 is an explanatory circuit diagram to be referred to in description of a still further operating state of the pixel circuit according to the second embodiment.

Later on, at a point of time the signal line DTL is set at the signal electric potential Vsig, the sampling transistor T1 is controlled to again enter a state of being turned on in a time period t8 shown in the timing diagram of FIG. 21. FIG. 30 is a circuit diagram showing an operating state of the pixel circuit 51 at this point of time.

The signal electric potential Vsig applied to a pixel circuit 51 is a voltage representing the gradation value for the pixel circuit 51. With the sampling transistor T1 put in a state of being turned on, the gate electric potential Vg of the driving transistor T2 is controlled through the sampling transistor T1 to reach an electric potential equal to the signal electric potential Vsig. In the mean time, the source electric potential Vs of the driving transistor T2 rises with the lapse of time due to a driving current Ids flowing from the power-supply line.

At that time, if the source electric potential Vs of the driving transistor T2 is not greater than the sum of the threshold voltage Vthel and cathode voltage Vcat of the organic EL device OLED, that is, if the leak current of the organic EL device OLED is smaller than the driving current Ids flowing through the driving transistor T2, the driving current Ids flowing through the driving transistor T2 is used for electrically charging the signal holding capacitor Cs.

Figure 31:
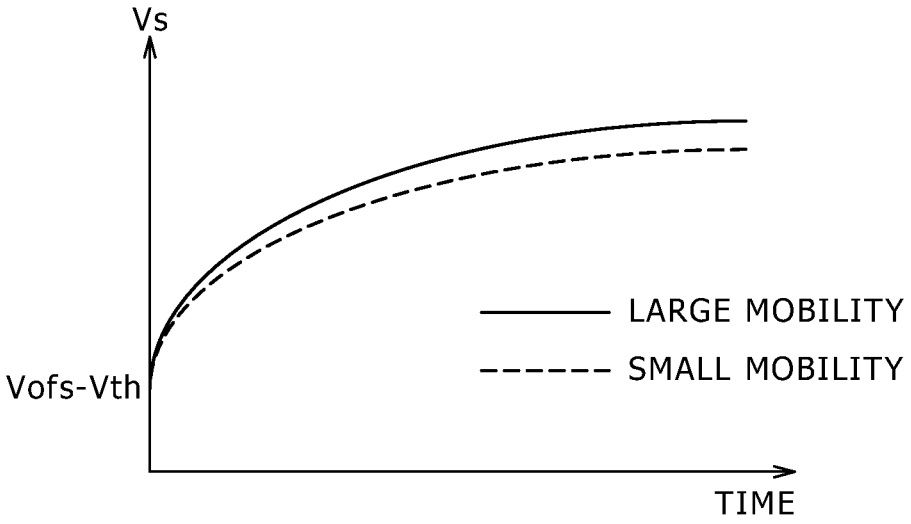
FIG. 31 is a diagram showing curves representing changes of the source electric potential of the driving transistor with the lapse of time for different mobility values.

It is to be noted that, since the threshold-voltage compensation process of the driving transistor T2 has been completed at that time, the driving current Ids flowing through the driving transistor T2 has a magnitude reflecting the mobility μ of the driving transistor T2. That is to say, the larger the mobility μ of a driving transistor T2, the larger the driving current Ids flowing through the driving transistor T2 and, hence, the higher the speed at which the source electric potential Vs rises as shown by a solid-line curve in a diagram of FIG. 31. On the contrary, the smaller the mobility μ of a driving transistor T2, the smaller the driving current Ids flowing through the driving transistor T2 and, hence, the lower the speed at which the source electric potential Vs rises as shown by a dashed-line curve in the diagram of FIG. 31.

Thus, the gate-source voltage Vgs of the driving transistor T2 decreases to a magnitude reflecting the mobility μ of the driving transistor T2. As a result, a voltage held by the signal holding capacitor Cs is compensated for variations of the mobility μ of the driving transistor T2 from pixel to pixel. That is to say, the gate-source voltage Vgs of the driving transistor T2 changes to a voltage obtained as a result of compensating the driving transistor T2 for effects of variations observed after the lapse of time determined in advance as variations in mobility μ of the driving transistor T2 from pixel to pixel.

Finally, when the sampling transistor T1 is controlled to enter a state of being turned off in order to terminate the operation to store the signal electric potential Vsig in the signal holding capacitor Cs in a time period t9 shown in the timing diagram of FIG. 21, the organic EL device OLED starts an operation to emit light. That is to say, a new light emission period is begun.

At that time, the gate-source voltage Vgs' of the driving transistor T2 has a fixed magnitude. Thus, the driving transistor T2 supplies a constant driving current Ids' to the organic EL device OLED.

Figure 32:
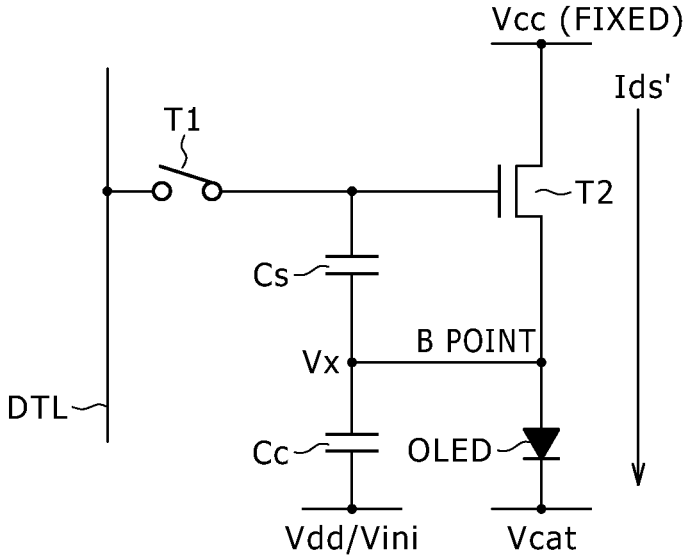
FIG. 32 is an explanatory circuit diagram to be referred to in description of a still further operating state of the pixel circuit according to the second embodiment.

It is to be noted that the anode electric potential Vel appearing on the anode electrode of the organic EL device OLED rises to an electric potential level Vx which causes the driving current Ids' to flow to the organic EL device OLED. As a result, the organic EL device OLED starts to emit light. FIG. 32 is a circuit diagram showing an operating state of the pixel circuit 51 at this point of time.

It is to be noted that, after the lapse of time determined in advance since the start of a light emission process carried out at an initial time, every time the electric potential appearing on the capacitor control line CNTL changes, a coupling component ΔV is superposed on the electric potential appearing on the source electrode of the driving transistor T2. Since the gate electrode of the driving transistor T2 is in a state of being floated during the light emission period, however, the gate-source voltage Vgs' appearing at the start of the light emission is sustained. As a result, in spite of the fact that the pixel circuit 51 is periodically subjected to a coupling driving operation, a light emission state according to the signal electric potential Vsig is maintained.

Figure 1:
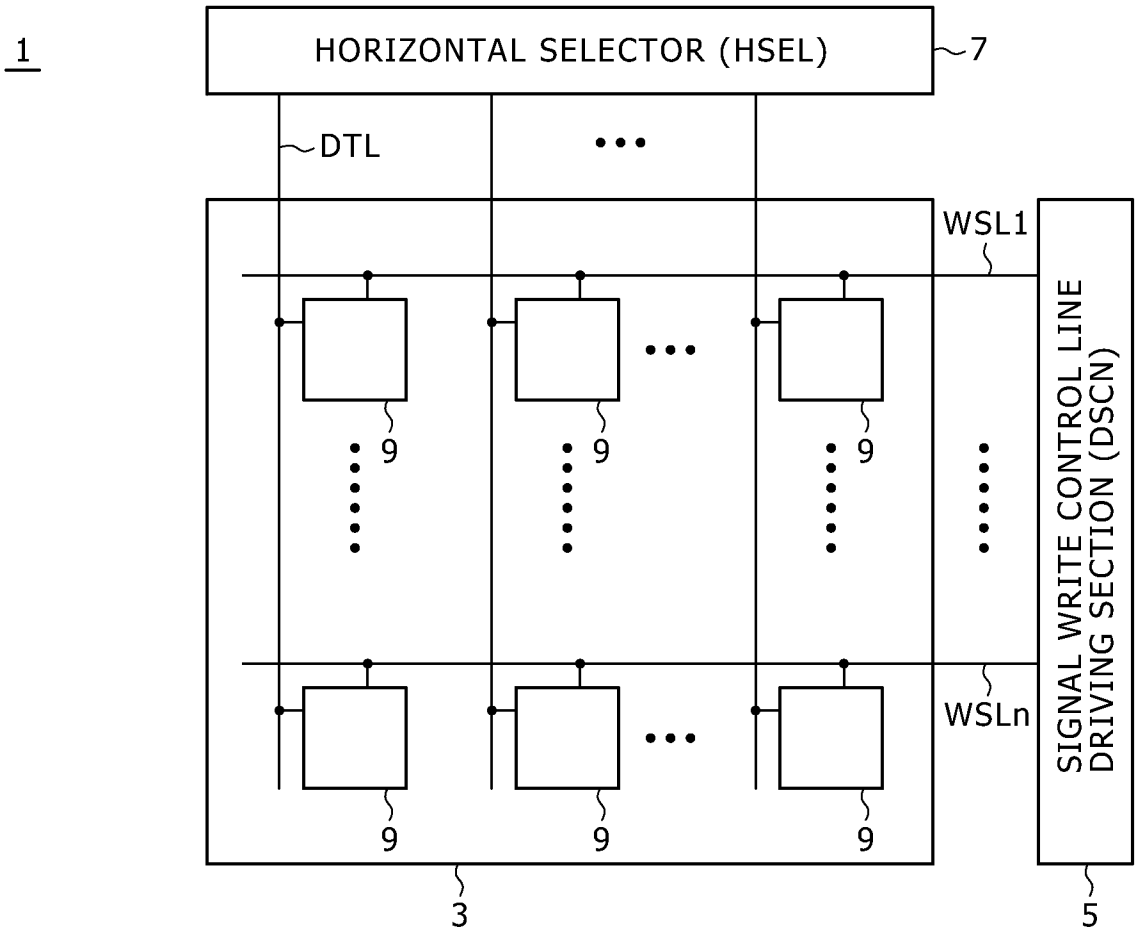
FIG. 1 is a functional circuit block diagram showing an organic EL display panel driven/controlled by adoption of an active matrix driving method.
Figure 2:
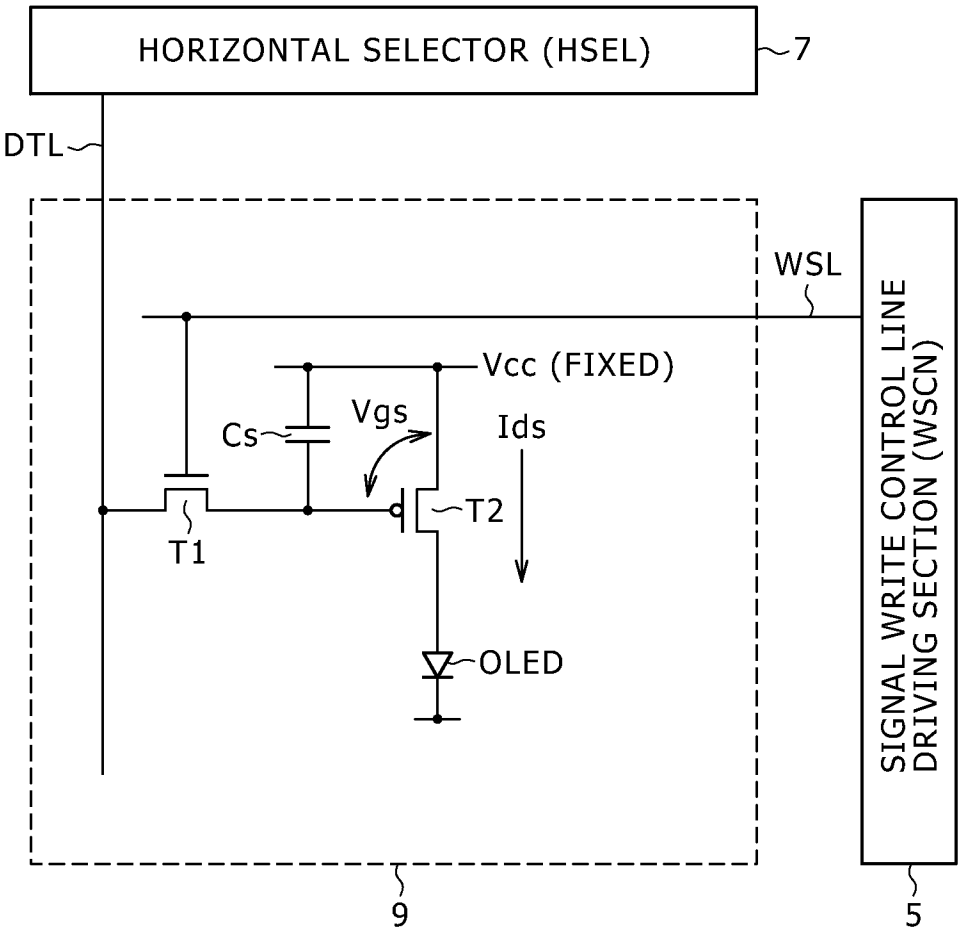
FIG. 2 is a block diagram showing a simplest circuit configuration of a pixel circuit connected to a horizontal selector by a signal line and a signal-write control line driving section by a write control line.
Figure 3:
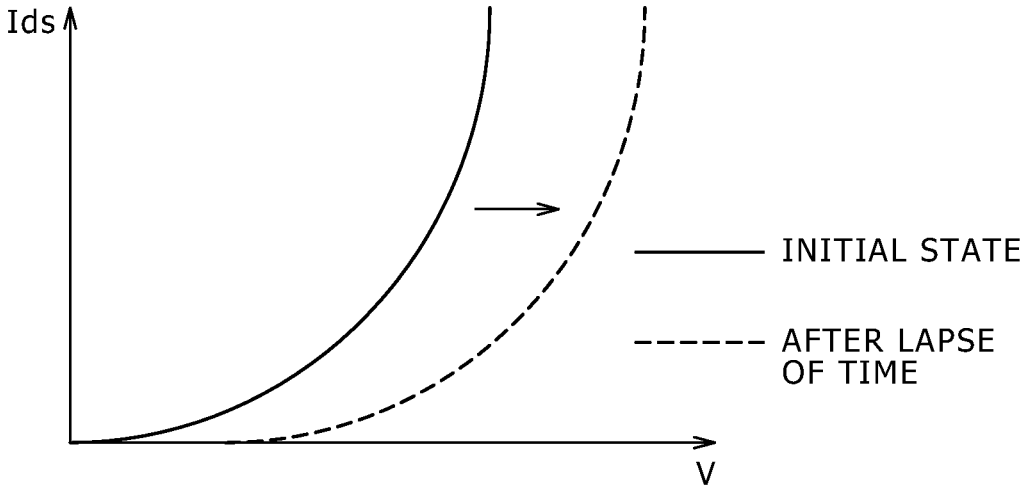
FIG. 3 is a diagram showing changes caused by aging as changes of the I-V characteristic of an organic EL device.
Figure 4:
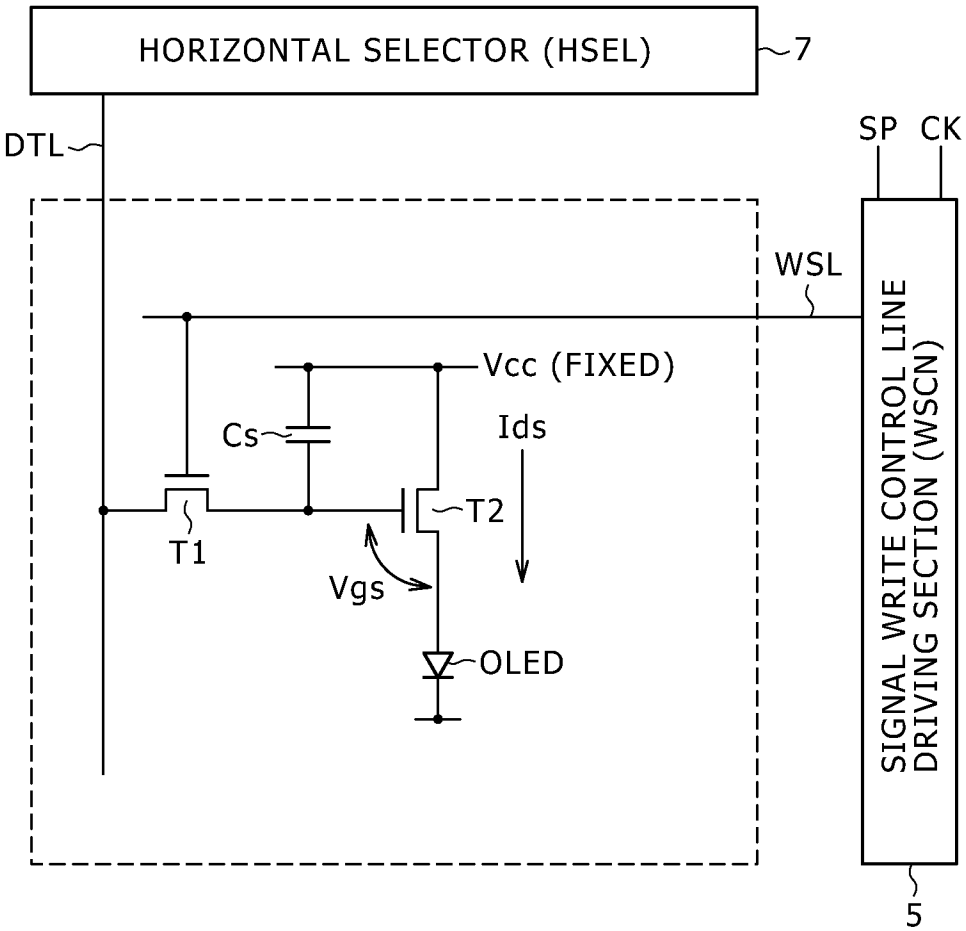
FIG. 4 is a block diagram showing a typical circuit configuration of the pixel circuit connected to the horizontal selector by a signal line and the signal-write control line driving section by a write control line to serve as a pixel circuit employing thin-film transistors of the N-channel type to serve as the sampling transistor and the driving transistor.

It is to be noted that, also in the case of this pixel circuit 51 according to the second embodiment, as the length of the light emission time period increases, that is, as time goes by, it is difficult to prevent the I-V characteristic of the organic EL device OLED from changing due to a process of aging as shown in the diagram of FIG. 3. Thus, an electric potential appearing at a point B shown in the circuit diagram of FIG. 32 also changes as well. Since the gate-source voltage Vgs of the driving transistor T2 is sustained at a constant magnitude, however, the magnitude of the driving current Ids flowing to the organic EL device OLED does not change either.

As described above, without regard to changes exhibited by the I-V characteristic of the organic EL device OLED with the lapse of time due to a process of aging, it is possible to allow the driving current Ids determined by the signal electric potential Vsig to typically continue to flow to the organic EL device OLED. In this way, the luminance of light emitted by the organic EL device OLED can be sustained continuously at a value determined merely by the signal electric potential Vsig without being affected by the changes exhibited by the I-V characteristic of the organic EL device OLED with the lapse of time.

(C-3): Conclusion

By adoption of the driving method according to the second embodiment, even though the current supply line (which serves as a power-supply line) is held at a constant electric potential, each of the pixel circuits 51 can be driven and controlled in the same operating states as the first embodiment.

For example, by storing the offset electric potential Vofs serving as a light extinguishing electric potential into the signal holding capacitor Cs in a state of applying the high-level electric potential Vdd to the capacitor control line CNTL which is a line common to all pixel circuits 51, the pixel circuit 51 can be driven in a control operation to make a transition from a light emission state to a light extinction state (or a no-light emission state).

In addition, by raising the electric potential appearing on the capacitor control line CNTL from the low-level electric potential Vini to the high-level electric potential Vdd while an operation to storing the offset electric potential Vofs into the signal holding capacitor Cs is being carried out for example, it is possible to carry out the threshold-voltage compensation preparation process on the pixel circuit 51.

On top of that, by storing the offset electric potential Vofs or the signal electric potential Vsig into the signal holding capacitor Cs in a state of applying the low-level electric potential Vini to the capacitor control line CNTL for example, the threshold-voltage compensation process and/or the mobility compensation process can be carried out.

As a result, the pixel circuit 51 can be configured to employ the current supply line as a fixed-voltage power-supply line common to all pixel circuits 51. It is thus possible to eliminate the current supply line driving section 25 employed in the first embodiment as a necessary driving section having a configuration of a shift register with a plurality of output stages. In addition, the newly added capacitor control line CNTL can be driven by the pulse voltage source 45 for generating single control pulses common to all pixel circuits 51.

That is to say, the size of a circuit area used for laying out driving sections can be made small in comparison with the circuit area of the first embodiment. In particular, in the case of a large panel size and/or a high display resolution, the effect of the reduction of the circuit-area size is great. The effect of the reduction of the circuit-area size provides a higher degree of layout freedom and the effect of the high degree of layout freedom is much expected. In addition, the effect of reduction of a cost to manufacture the organic EL display panel can also be expected as well.

Of course, the threshold-voltage compensation process and the mobility compensation process can be carried out in the same way as the first embodiment. Thus, it is possible to obtain a picture display having a uniform quality showing no unevenness.

(C-4): Distributed Execution of the Threshold-Voltage Compensation Processing

In accordance with the description given so far, the threshold-voltage compensation process is completed in one horizontal scan period. That is to say, the threshold-voltage compensation process is carried out merely once within one horizontal scan period. With the organic EL device made finer and/or the driving operation carried out at a higher speed, however, the length of one horizontal scan period becomes smaller.

Figures 33A, 33B, 33C, 33D, 33E:
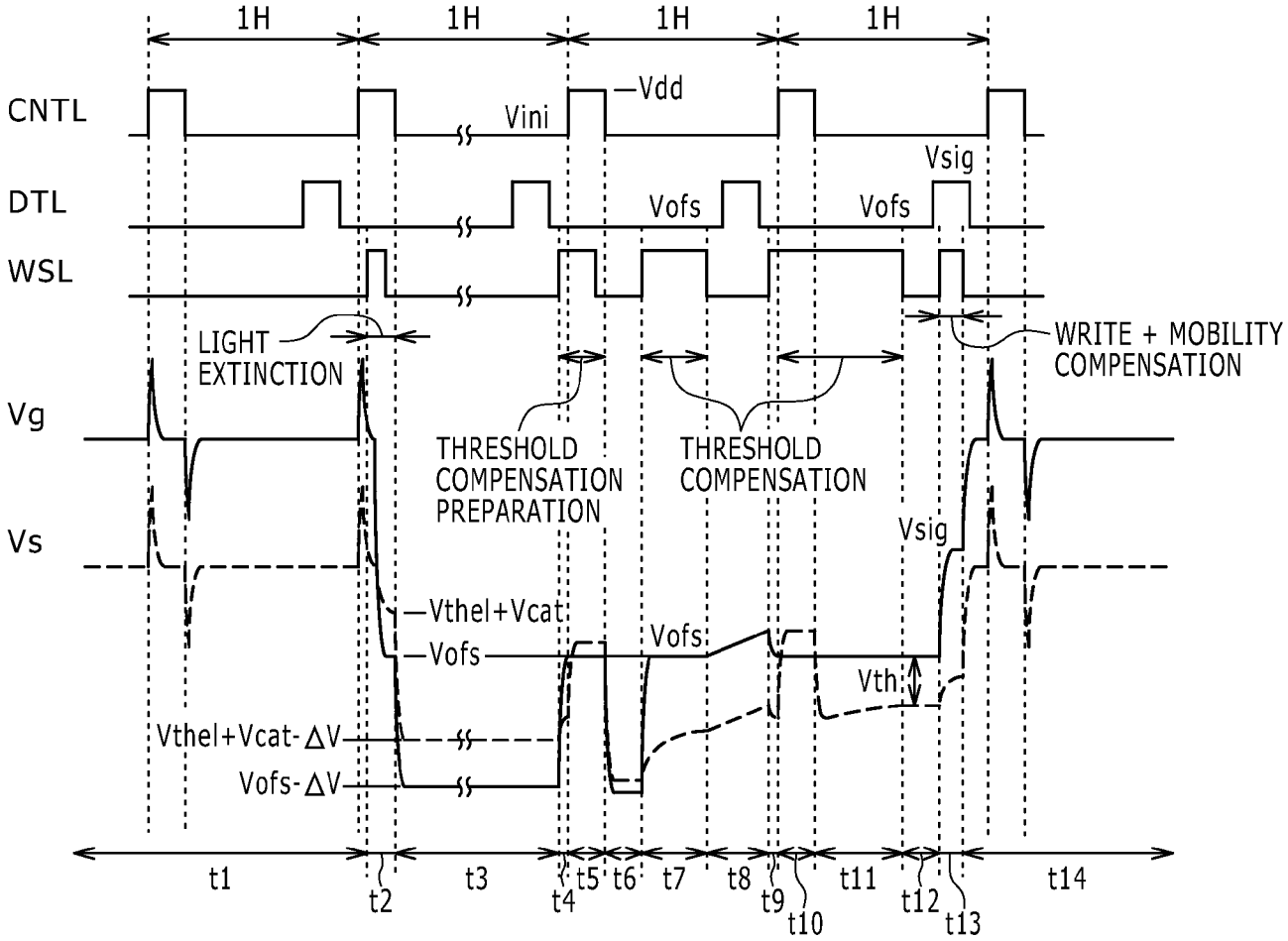
FIGS. 33A, 33B, 33C, 33D, and 33E reflect a timing diagram showing a plurality of timing charts for a typical driving operation in which the threshold-voltage compensation processing is carried out by distributing the threshold-voltage compensation processing into a plurality of threshold-voltage compensation processes each assigned to one of the same plurality of horizontal scan periods in accordance with the second embodiment.

In this case, the threshold-voltage compensation processing needs to be divided into a plurality of threshold-voltage compensation processes to be carried out at different times. FIG. 33 is a timing diagram showing a plurality of timing charts for a typical driving operation in which the threshold-voltage compensation processing is carried out by distributing the threshold-voltage compensation processing into a plurality of threshold-voltage compensation processes each assigned to one of the same plurality of horizontal scan periods. Time charts shown in FIGS. 33A to 33E correspond to the time charts shown in FIGS. 21A to 21E respectively.

First of all, the following description explains operations that start from a point of time at which the threshold-voltage compensation processing is suspended. In a time period t8, a signal electric potential Vsig representing a gradation value for the pixel circuit 51 is asserted on the signal line DTL. Thus, during this time period, the sampling transistor T1 is controlled to enter a state of being turned off. In this state, the gate electrode of the driving transistor T2 is in a state of being floated.

At the point of time at which the threshold-voltage compensation processing is suspended, the gate-source voltage Vgs of the driving transistor T2 is greater than the threshold voltage Vth of the driving transistor T2. Thus, also with the threshold-voltage compensation processing suspended, the driving transistor T2 sustains its state of being turned on. In this state, the driving current Ids flowing from the current supply line is used for electrically charging the signal holding capacitor Cs and the parasitic capacitor Cel. As a result, the source electric potential Vs of the driving transistor T2 rises. Accompanying the increasing level of the source electric potential Vs, the gate electric potential Vg of the driving transistor T2 also rises as well in the so-called bootstrap operation according to a bootstrap effect provided by the signal holding capacitor Cs.

In due course of time, when the application of the signal electric potential Vsig to the signal line DTL is ended, the sampling transistor T1 is controlled to again enter a state of being turned on in order to resume the suspended threshold-voltage compensation processing in a time period t9. At that time, the gate electric potential Vg of the driving transistor T2 is controlled to make a downward transition to the offset electric potential Vofs. In a manner of being interlocked with the downward transition made by the gate electric potential Vg of the driving transistor T2, the source electric potential Vs of the driving transistor T2 is controlled to also make a downward transition.

In a state of fixing the gate electric potential Vg of the driving transistor T2 at the offset electric potential Vofs in this way, control is executed to change the electric potential appearing on the capacitor control line CNTL from the low-level electric potential Vini to the high-level electric potential Vdd and change the electric potential appearing on the capacitor control line CNTL from the high-level electric potential Vdd back to the low-level electric potential Vini after the lapse of time determined in advance in a time period t10.

As a result, while a threshold-voltage compensation process is being carried out in the time period t10, a positive-direction coupling component and a negative-direction coupling component are superposed on the source electric potential Vs of the driving transistor T2 in such a way that the positive-direction coupling component and the negative-direction coupling component cancel each other.

The fact that the positive-direction coupling component and the negative-direction coupling component cancel each other means operations carried out after the resumption of the threshold-voltage compensation processing are not influenced by effects of changes of the electric potential appearing on the capacitor control line CNTL.

However, the source electric potential Vs on which the positive-direction coupling component is superposed is desired to disallow the organic EL device OLED to carry out an on operation. That is to say, the source electric potential Vs of the driving transistor T2 is desired to satisfy the following relation: $Vs \leq (Vthel+Vcat)$.

As described above, even though the threshold-voltage compensation processing is carried out by dividing the threshold-voltage compensation processing into a plurality of threshold-voltage compensation processes to be performed at different times, the structure of the organic EL display panel according to the second embodiment and the method for driving the organic EL display panel work effectively.

(D): Third Embodiment

(D-1): System Configuration

A third embodiment described below implements another typical system configuration of the organic EL display panel 11 employing pixel circuits 71 each having a configuration different from the configuration of each of the pixel circuits 31 and 51 employed respectively in the first and second embodiments explained earlier and implements a driving technology provided for the third embodiment.

The following description places emphasis on differences in pixel circuit and driving method between the third embodiment and the second embodiment explained previously. That is to say, merely the differences in pixel circuit and driving method between the third and the second embodiments are explained.

Figure 34:
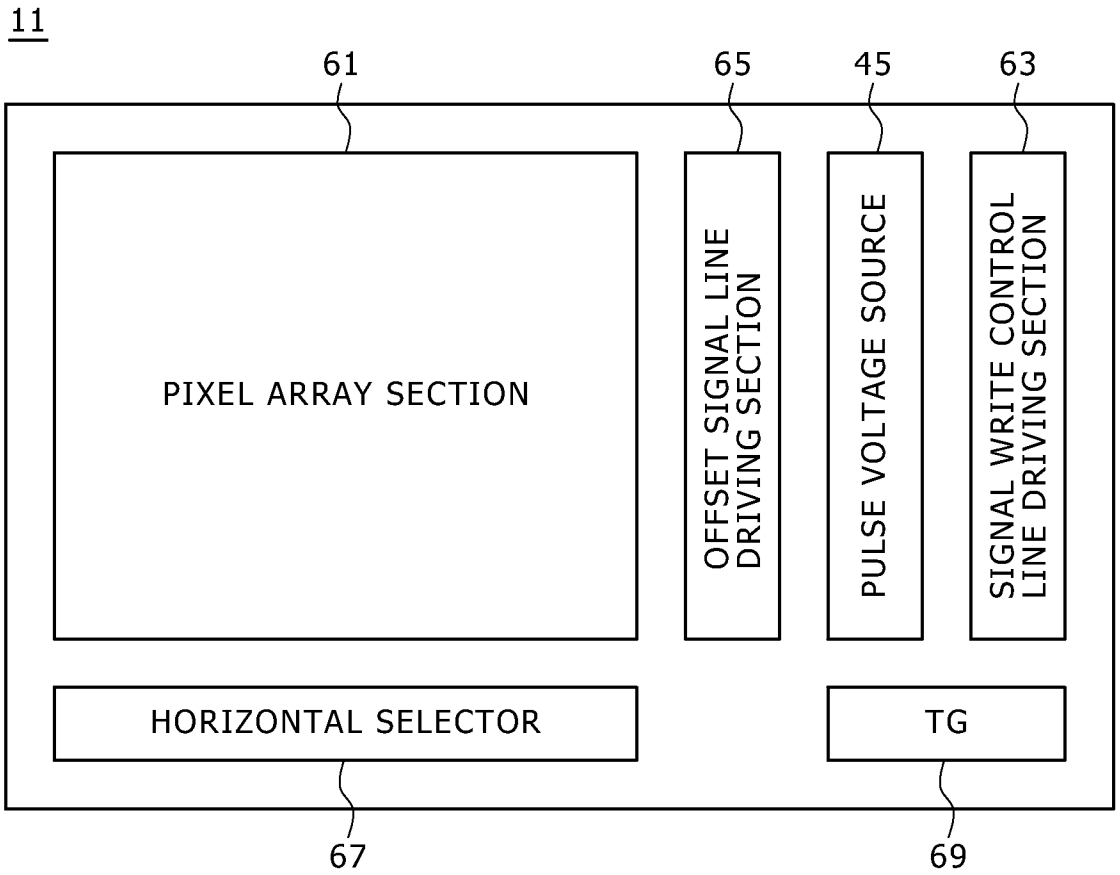
FIG. 34 is a block diagram showing a typical system configuration of an organic EL display panel according to a third embodiment.

FIG. 34 is a block diagram showing the typical system configuration of the organic EL display panel 11 according to the third embodiment. Elements employed in this typical system configuration as elements identical with their respective counterparts included in the system configuration shown in the block diagram of FIG. 18 are denoted by the same reference numerals and reference notations as the counterparts.

The organic EL display panel 11 shown in the block diagram of FIG. 34 employs a pixel array section 61, a signal-write control line driving section 63, a pulse voltage source 45, a horizontal selector 67, an offset signal line driving section 65 and a timing generator 69. In particular, each of the signal-write control line driving section 63, the pulse voltage source 45, the horizontal selector 67 and the offset signal line driving section 65 serves as a driving circuit of the pixel array section 41.

The layout of pixel circuits 71 on the pixel array section 61 is the same as the layout in the second embodiment. That is to say, the pixel array section 61 also has a matrix structure including sub-pixel circuits each located at an intersection of a signal line DTL and a write control line WSL. In the case of the third embodiment, however, the signal line DTL is used as a line for specially supplying the signal electric potential Vsig to the pixel circuit 71. In addition, a newly added offset signal line OFSL driven by the newly provided offset signal line driving section 65 is used as a line for specially supplying the offset electric potential Vofs to the pixel circuit 71.

Figure 35:
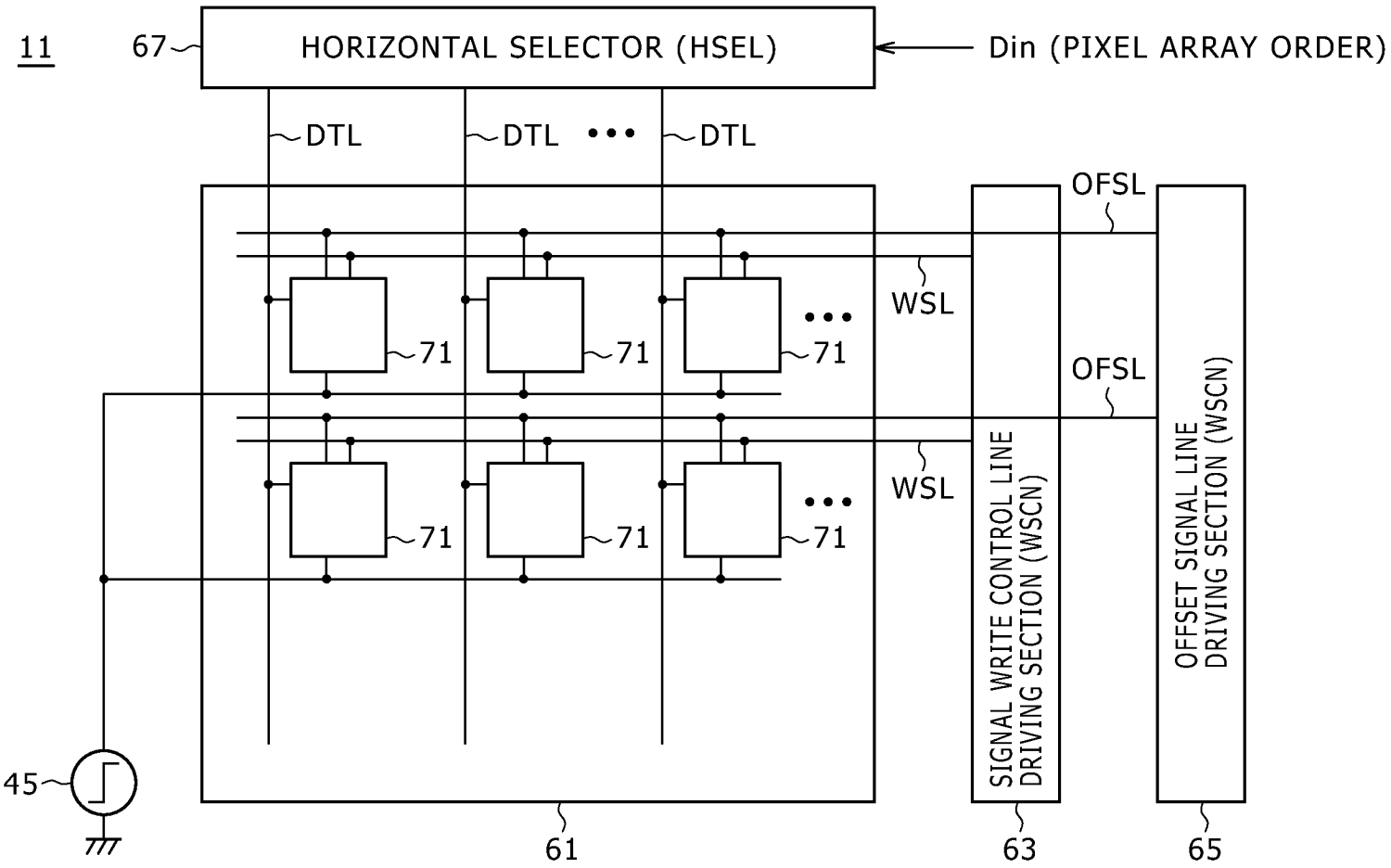
FIG. 35 is a block diagram showing wiring connections between pixel circuits each serving as a sub-pixel circuit in a pixel array section and a pulse voltage source, a signal-write control line driving section, an offset signal line driving section as well as a horizontal selector which each function as a driving circuit in the organic EL display panel according to the third embodiment.
Figure 36:
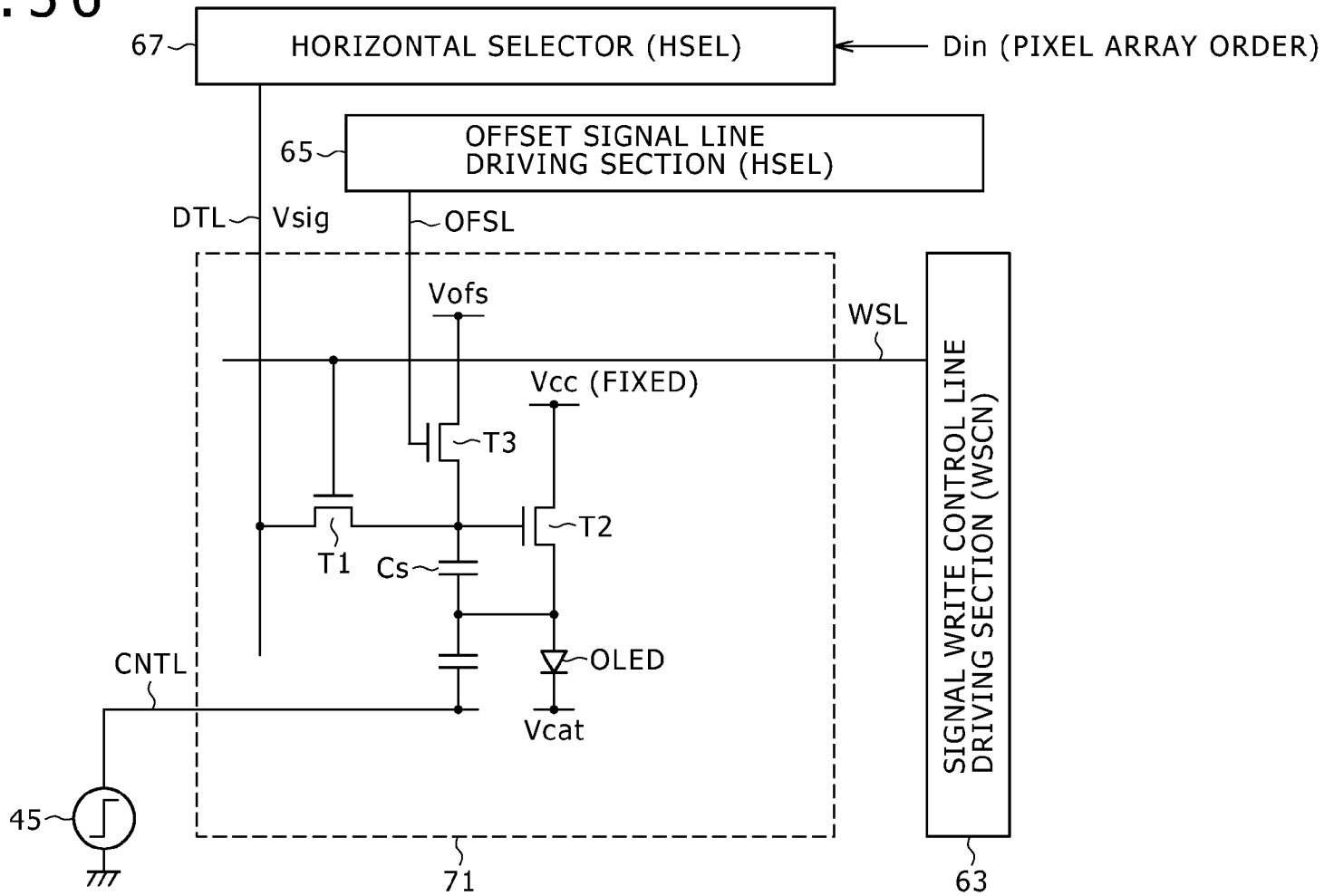
FIG. 36 is a block diagram showing wiring connections between the pixel circuit according to the third embodiment and the pulse voltage source, the signal-write control line driving section, the offset signal line driving section as well as the horizontal selector by focusing on the internal configuration of the pixel circuit.

FIG. 35 is a block diagram showing wiring connections between the pixel circuits 71 each serving as a sub-pixel circuit in the pixel array section 61 and the signal-write control line driving section 63, the pulse voltage source 45, the offset signal line driving section 65 as well as the horizontal selector 67 which each function as a driving circuit. FIG. 36 is a block diagram showing wiring connections between a pixel circuit 71 and the signal-write control line driving section 63, the pulse voltage source 45, the offset signal line driving section 65 as well as the horizontal selector 67 by focusing on the internal configuration of the pixel circuit 71. As shown in the block diagram of FIG. 36, the pixel circuit 71 employs a first sampling transistor T1, a driving transistor T2, a second sampling transistor T3, a signal holding capacitor Cs, a coupling capacitor Cc and an organic EL device OLED. Each of the first sampling transistor T1, the driving transistor T2 and the second sampling transistor T3 is a thin-film transistor of the N-channel type.

In the case of the third embodiment, the signal-write control line driving section 63 controls an operation to put the first sampling transistor T1 in a state of being turned on or turned off through the write control line WSL. The first sampling transistor T1 is put in a state of being turned on or turned off in order to control an operation to store a signal electric potential Vsig appearing on the signal line DTL into the signal holding capacitor Cs.

On the other hand, the offset signal line driving section 65 controls an operation to put the second sampling transistor T3 in a state of being turned on or turned off through the offset signal line OFSL. The second sampling transistor T3 is put in a state of being turned on or turned off in order to control an operation to store the offset electric potential Vofs into the signal holding capacitor Cs.

It is to be noted that the basic structure of the offset signal line driving section 65 is identical to the basic structure of the signal-write control line driving section 63. That is to say, the offset signal line driving section 65 is configured to employ a shift register which has as many output stages as vertical resolution granularities.

The horizontal selector 67 is a driving circuit for applying the signal electric potential Vsig representing pixel data $D_{in}$ to the pixel circuit 71 through the signal line DTL.

The horizontal selector 67 is configured to include a shift register having as many output stages as horizontal resolution granularities. The horizontal selector 67 also employs a latch circuit for latching the pixel data $D_{in}$, a D/A conversion circuit, a buffer circuit. One of the differences between the third and second embodiments is that the horizontal selector 67 employed in the third embodiment asserts merely the signal electric potential Vsig on the signal line DTL whereas the horizontal selector 27 employed in the second embodiment asserts either the signal electric potential Vsig or the offset electric potential Vofs on the signal line DTL.

The timing generator 69 is a section for generating timing pulses desired for driving the write control line WSL, the capacitor control line CNTL, the offset signal line OFSL and the signal line DTL.

(D-2): Typical Driving Operations

FIG. 37 is a timing diagram showing a plurality of timing charts of signals relevant to operations to drive the pixel circuit 71 included in the typical configuration shown in the block diagram of FIG. 36. Incidentally, also in the timing diagram of FIG. 37, reference notation Vdd denotes the high-level electric potential of the two power-supply electric potentials applied to the capacitor control line CNTL whereas reference notation Vini denotes the low-level electric potential of the two power-supply electric potentials.

Figures 37A, 37B, 37C, 37D, 37E:
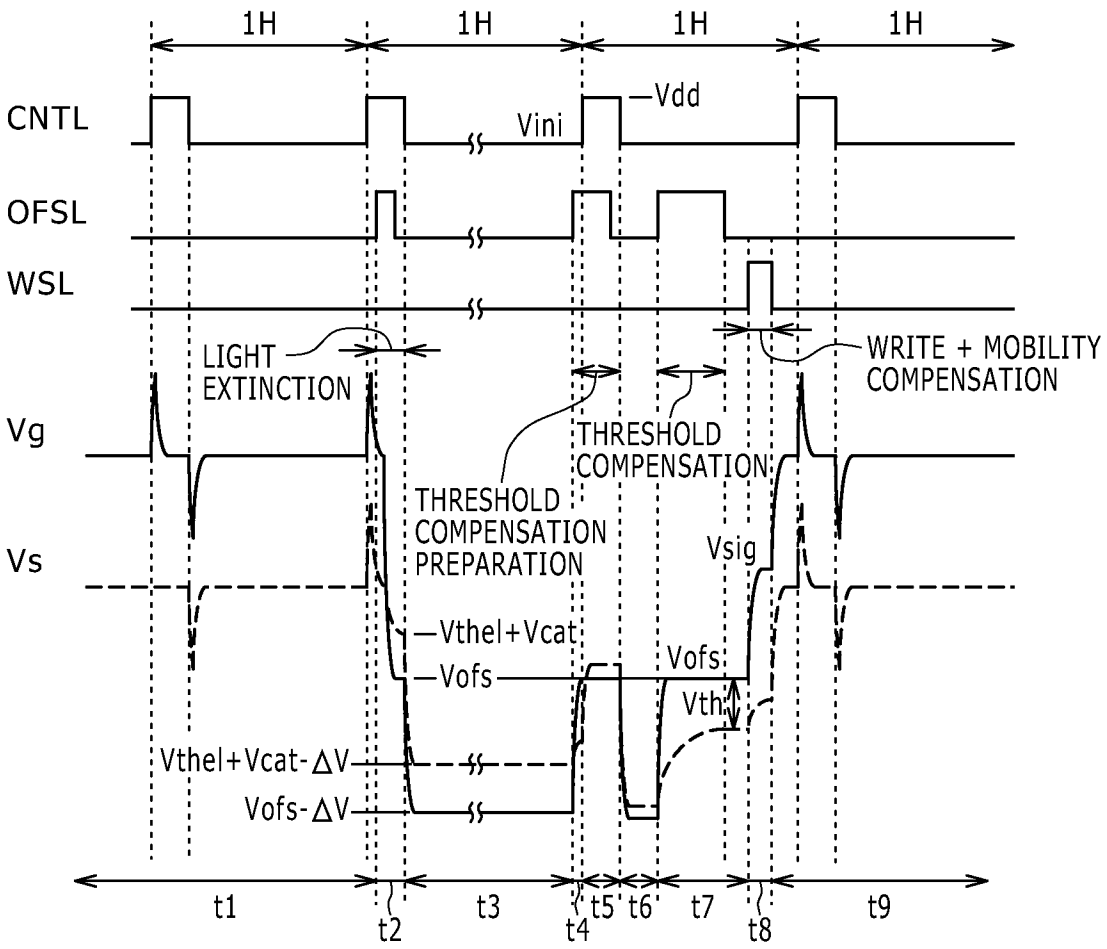
FIGS. 37A, 37B, 37C, 37D, and 37E reflect a timing diagram showing a plurality of timing charts of signals relevant to operations to drive the pixel circuit according to the third embodiment.

To be more specific, FIG. 37A is a diagram showing a waveform representing the timing chart of an electric potential appearing on the capacitor control line CNTL. FIG. 37B is a diagram showing a waveform representing the timing chart of an electric potential appearing on the offset signal line OFSL. FIG. 37C is a diagram showing a waveform representing the timing chart of an electric potential appearing on the write control line WSL. FIG. 37D is a diagram showing a waveform representing the timing chart of the gate electric potential Vg of the driving transistor T2. FIG. 37E is a diagram showing a waveform representing the timing chart of the source electric potential Vs of the driving transistor T2.

Figure 38:
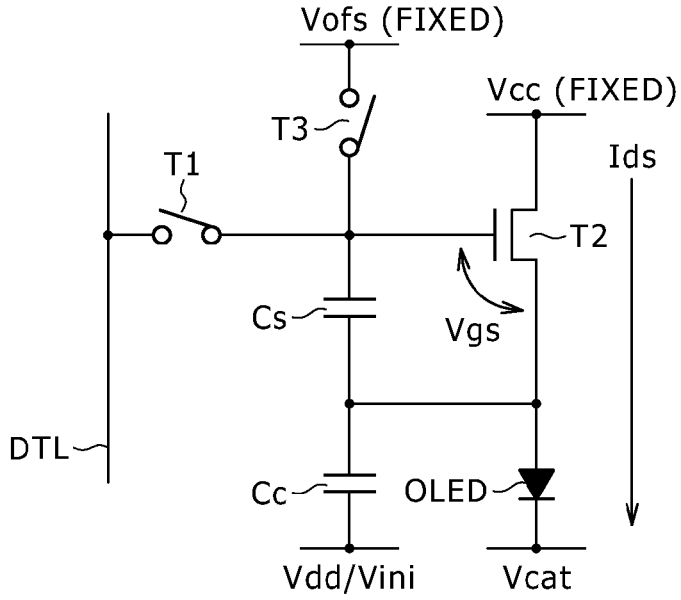
FIG. 38 is an explanatory circuit diagram to be referred to in description of an operating state of the pixel circuit according to the third embodiment.

First of all, the operation of the pixel circuit 71 in a light emission state is explained by referring to a circuit diagram of FIG. 38. At that time, each of the first sampling transistor T1 and the second sampling transistor T3 is in a state of being turned off.

Thus, the gate electrode of the driving transistor T2 is operating as an electrode put in a state of being floated. As a result, every time the electric potential appearing on the capacitor control line CNTL rises to a high level within a horizontal scan period in a periodical operation, a positive-direction coupling waveform is introduced during a time period t1 shown in the timing diagram of FIG. 37 into a signal shown by the timing chart D of the timing diagram of FIG. 37 to represent the gate electric potential Vg of the driving transistor T2 and a signal shown by the timing chart E of the timing diagram of FIG. 37 to represent the source electric potential Vs of the driving transistor T2. Every time the electric potential appearing on the capacitor control line CNTL falls to a low level within a horizontal scan period in a periodical operation, on the other hand, a negative-direction coupling waveform is introduced during the time period t1 shown in the timing diagram of FIG. 37 into the signal shown by the timing chart D of the timing diagram of FIG. 37 to represent the gate electric potential Vg of the driving transistor T2 and the signal shown by the timing chart E of the timing diagram of FIG. 37 to represent the source electric potential Vs of the driving transistor T2.

It is to be noted that, since the gate electrode of the driving transistor T2 is operating as an electrode put in a state of being floated, the gate-source voltage Vgs of the driving transistor T2 is sustained at a fixed magnitude as it is in spite of the introduction of the coupling waveforms. Thus, the operation carried out by the driving transistor T2 in the saturated region is continued. As a result, the organic EL device OLED maintains the light emission state of emitting light with a luminance according to the driving current Ids determined by the gate-source voltage Vgs of the driving transistor T2 throughout one horizontal scan period.

Figure 39:
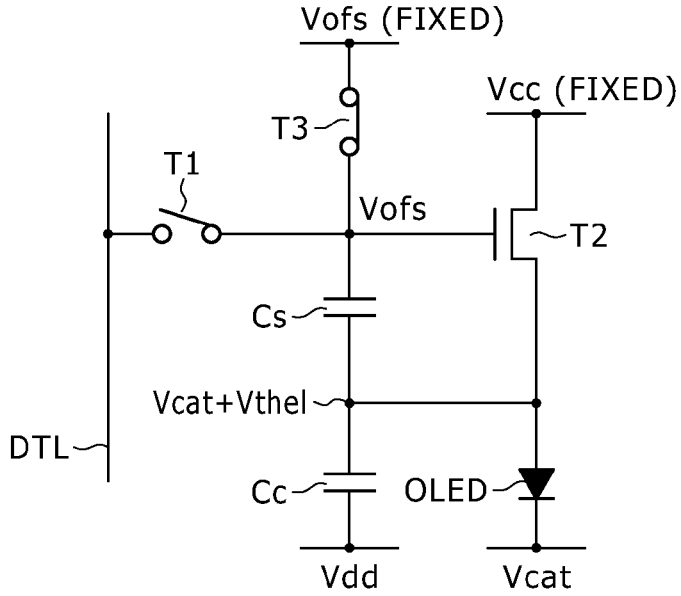
FIG. 39 is an explanatory circuit diagram to be referred to in description of another operating state of the pixel circuit according to the third embodiment.
Figure 40:
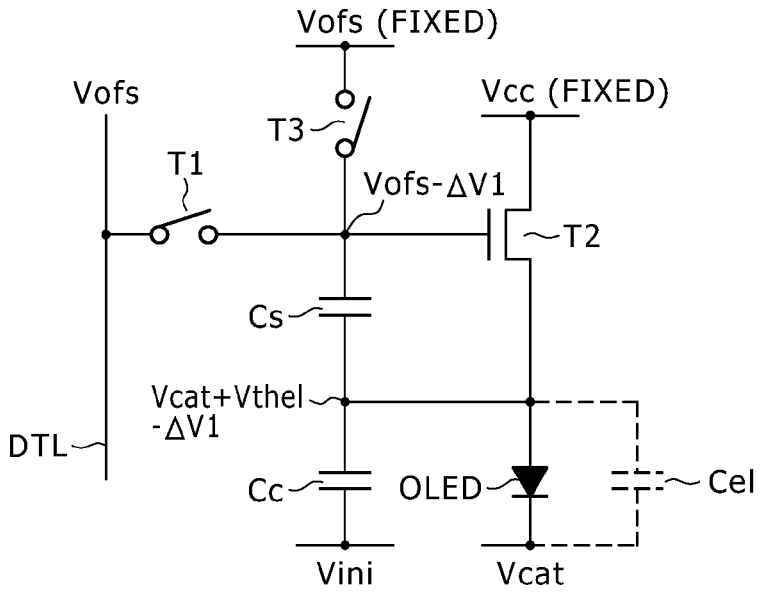
FIG. 40 is an explanatory circuit diagram to be referred to in description of a further operating state of the pixel circuit according to the third embodiment.

Next, operations in a no-light emission state are explained. The no-light emission state is started when the electric potential appearing on the write control line WSL is set at a high level while the electric potential appearing on the capacitor control line CNTL is being held at the high-level electric potential Vdd and the second sampling transistor T3 is in a state of being turned on in a time period t2 shown in the timing diagram of FIG. 37. FIG. 39 is a circuit diagram showing an operating state of the pixel circuit 71 at this point of time.

At that time, the first sampling transistor T1 has been controlled to enter a state of being turned off. Thus, a signal shown by a timing chart D of the timing diagram of FIG. 37 to represent the gate electric potential Vg of the driving transistor T2 makes a transition to approach the offset electric potential Vofs.

When the signal shown by a timing chart D of the timing diagram of FIG. 37 to represent the gate electric potential Vg of the driving transistor T2 makes a transition to approach the offset electric potential Vofs, a signal shown by a timing chart E of the timing diagram of FIG. 37 to represent the source electric potential Vs of the driving transistor T2 also falls due to a coupling effect provided by the signal holding capacitor Cs.

As a result, if the gate-source voltage Vgs of the driving transistor T2 is equal to or smaller than the threshold voltage Vth of the driving transistor T2, the organic EL device OLED enters a state of emitting no light. At that time, if the source electric potential Vs of the driving transistor T2 is equal to or smaller than the sum of the threshold voltage Vthel and cathode voltage Vcat of the organic EL device OLED, the gate-source voltage Vgs is held. As described earlier, the source electric potential Vs of the driving transistor T2 is the voltage appearing on the anode electrode of the organic EL device OLED.

If the source electric potential Vs of the driving transistor T2 is equal to or greater than the sum of the threshold voltage Vthel and cathode voltage Vcat of the organic EL device OLED, on the other hand, a process of electrically discharging the electric charge from the signal holding capacitor Cs by way of the organic EL device OLED is continued. As a result, the source electric potential Vs of the driving transistor T2 becomes equal to the sum of the threshold voltage Vthel and the cathode voltage Vcat (Vthel+Vcat).

FIG. 39 is a circuit diagram showing an operating state of the pixel circuit 71 in which the source electric potential Vs of the driving transistor T2 becomes equal to the sum of the threshold voltage Vthel and the cathode voltage Vcat (Vthel+Vcat). It is to be noted that the offset electric potential Vofs is not greater than the sum of the threshold voltage Vthel of the organic EL device OLED, the cathode voltage Vcat of the organic EL device OLED and the threshold voltage Vth of the driving transistor T2.

When the operation to store the offset electric potential Vofs in the signal holding capacitor Cs is completed, the second sampling transistor T3 is controlled to again enter a state of being turned off in a time period t3 of the timing diagram of FIG. 37. With the second sampling transistor T3 put in the state of being turned off, the gate electrode of the driving transistor T2 is put in a state of being floated.

Later on, the electric potential appearing on the capacitor control line CNTL is controlled to change from the high-level electric potential Vdd to the low-level electric potential Vini. At that time, a negative-direction coupling component ΔV1 is superposed on each of the gate electric potential Vg and the source electric potential Vs which appear respectively on the gate and source electrodes of the driving transistor T2. FIG.

40 is a circuit diagram showing an operating state of the pixel circuit 71 at this point of time.

Figure 41:
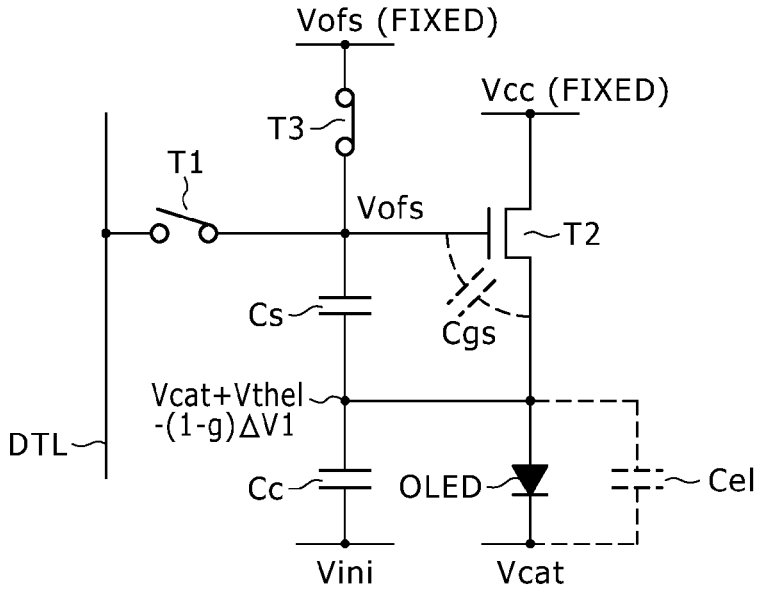
FIG. 41 is an explanatory circuit diagram to be referred to in description of a still further operating state of the pixel circuit according to the third embodiment.

In due course of time, in time periods t4 and t5 shown in the timing diagram of FIG. 37, the period of the threshold-voltage compensation preparation process is commenced. To put it in detail, in the time period t4 shown in the timing diagram of FIG. 37, in a state of setting the electric potential appearing on the capacitor control line CNTL at the low-level electric potential Vini, the threshold-voltage compensation preparation process is commenced by putting the second sampling transistor T3 in a state of being turned on. FIG. 41 is a circuit diagram showing an operating state of the pixel circuit 71 at this point of time.

Figure 42:
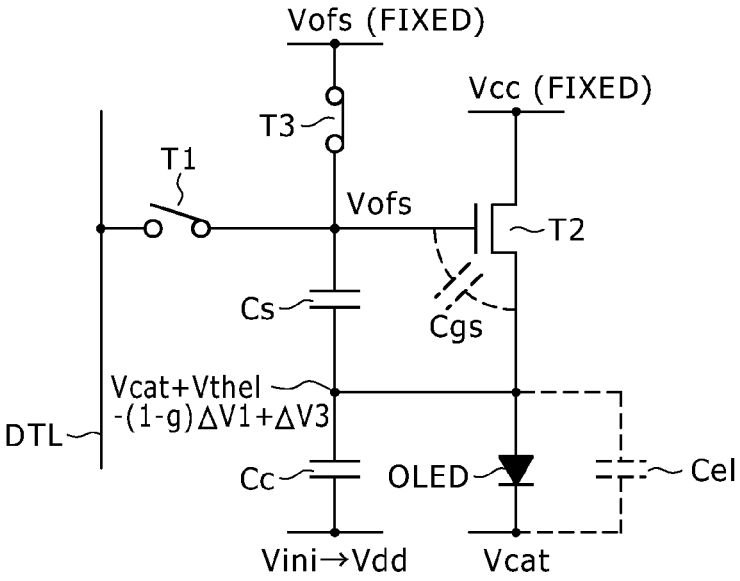
FIG. 42 is an explanatory circuit diagram to be referred to in description of a still further operating state of the pixel circuit according to the third embodiment.

In this case, in the time period t5 shown in the timing diagram of FIG. 37, the electric potential appearing on the capacitor control line CNTL is controlled to change from the low-level electric potential Vini back to the high-level electric potential Vdd. FIG. 42 is a circuit diagram showing an operating state of the pixel circuit 71 at this point of time.

As a result, in a state of fixing the gate electric potential Vg of the driving transistor T2 at the offset electric potential Vofs, the source electric potential Vs of the driving transistor T2 is subjected to a coupling driving operation. Thus, the gate-source voltage Vgs of the driving transistor T2 is controlled to enter a reversed-bias state.

Figure 43:
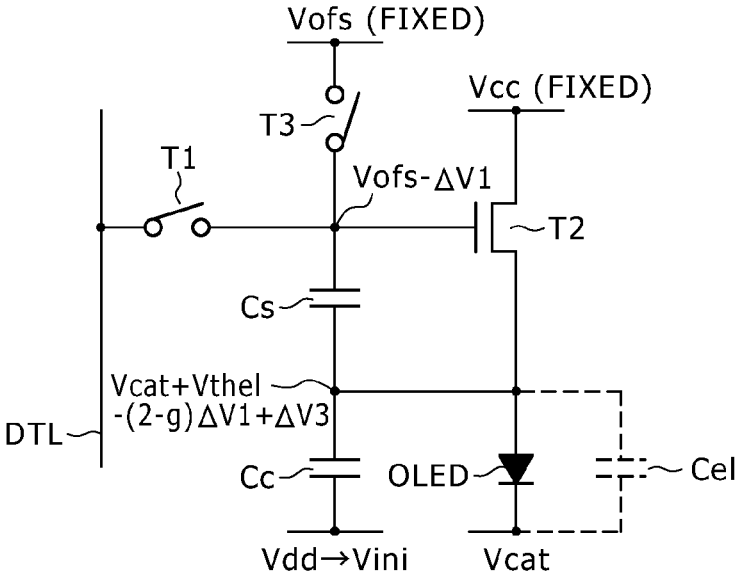
FIG. 43 is an explanatory circuit diagram to be referred to in description of a still further operating state of the pixel circuit according to the third embodiment.

As the threshold-voltage compensation preparation process is ended, the second sampling transistor T3 is controlled to enter a state of being turned off, putting the gate electrode of the driving transistor T2 in a state of being floated again. In this state, the electric potential appearing on the capacitor control line CNTL is controlled to change from the high-level electric potential Vdd to the low-level electric potential Vini in a time period t6 shown in the timing diagram of FIG. 37. That is to say, with the gate electrode of the driving transistor T2 put in a state of being floated, the electric potential appearing on the capacitor control line CNTL is subjected to a coupling driving operation carried out in the negative direction. FIG. 43 is a circuit diagram showing an operating state of the pixel circuit 71 at this point of time.

Figure 44:
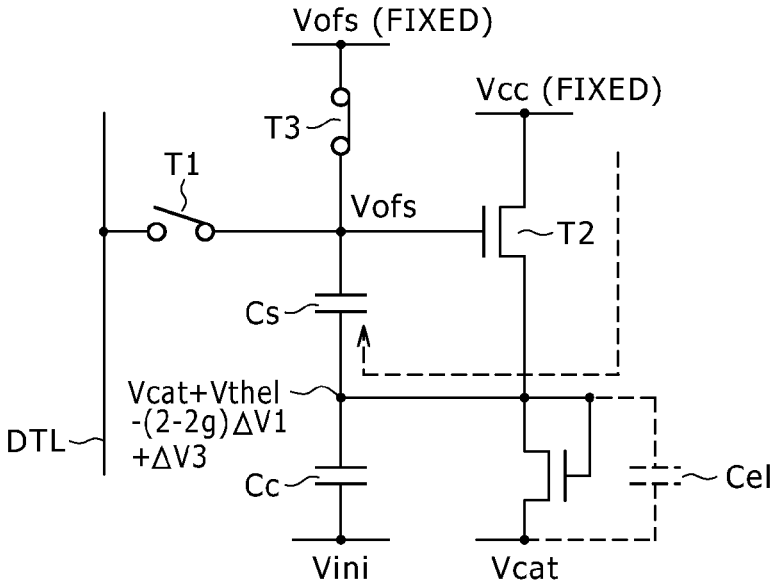
FIG. 44 is an explanatory circuit diagram to be referred to in description of a still further operating state of the pixel circuit according to the third embodiment.

Later on, in a time period t7 shown in the timing diagram of FIG. 37, the threshold-voltage compensation process is commenced. To put it in detail, in a state of setting the electric potential appearing on the capacitor control line CNTL at the low-level electric potential Vini, the threshold-voltage compensation process is commenced by putting the second sampling transistor T3 in a state of being turned on. FIG. 44 is a circuit diagram showing an operating state of the pixel circuit 71 at this point of time. In this operating state, the gate-source voltage Vgs of the driving transistor T2 is greater than the threshold voltage Vth of the driving transistor T2.

Thus, the driving transistor T2 is put in a state of being turned on and operating. As shown by a dashed-line arrow in the circuit diagram of FIG. 44, in this state, a driving current Ids is flowing from the current supply line to the signal holding capacitor Cs. A portion of the driving current Ids is also used for electrically charging the parasitic capacitor Cel of the organic EL device OLED. Thus, the anode electric potential Vel of the organic EL device OLED rises with the lapse of time. However, the relation Vel≤(Vcat+Vthel) is satisfied. Thus, the organic EL device OLED by no means emits light. In due course of time, the gate-source voltage Vgs of the driving transistor T2 becomes equal to the threshold voltage Vth of the driving transistor T2. At that time, the driving transistor T2 is automatically put in a state of being turned off, cutting off the flow of the driving current Ids.

Figure 45:
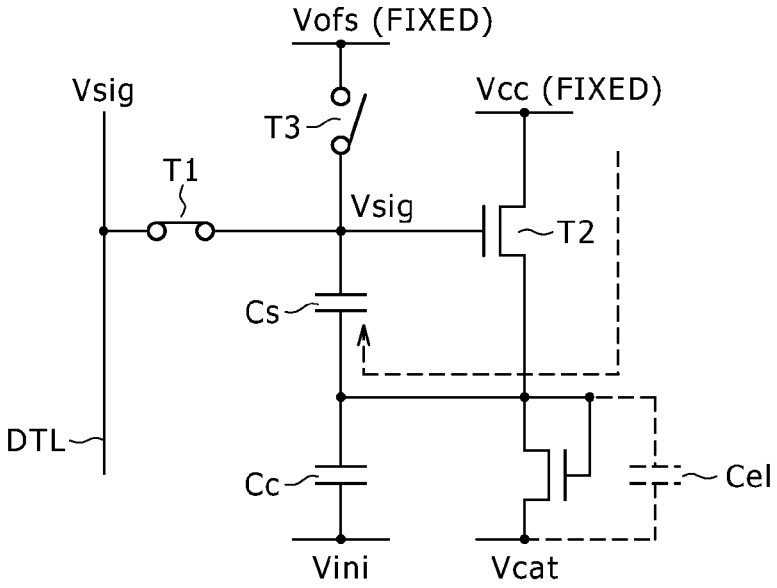
FIG. 45 is an explanatory circuit diagram to be referred to in description of a still further operating state of the pixel circuit according to the third embodiment.

When the threshold-voltage compensation process is ended as described above, the first sampling transistor T1 is controlled to again enter a state of being turned on, starting an operation to store the signal electric potential Vsig from the signal line DTL into the signal holding capacitor Cs in a time period t8 shown in the timing diagram of FIG. 37. Then, the operation to store the signal electric potential Vsig from the signal line DTL into the signal holding capacitor Cs and a mobility compensation process are carried out at the same time. FIG. 45 is a circuit diagram showing an operating state of the pixel circuit 71 at this point of time.

Figure 46:
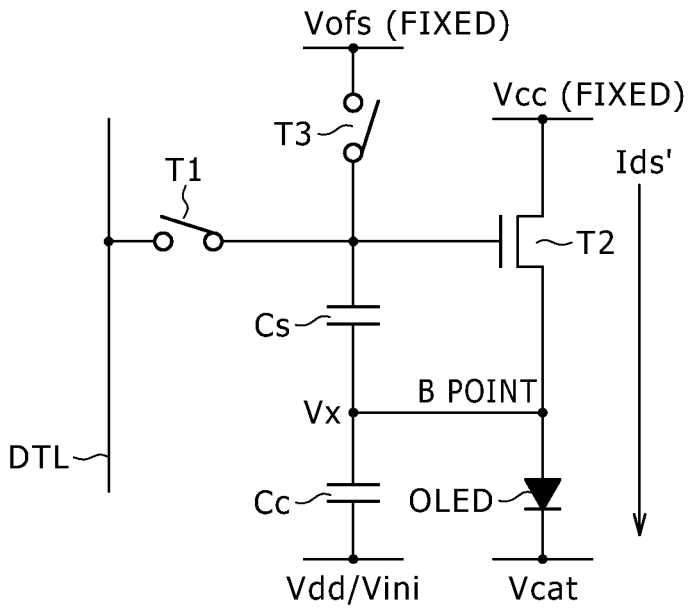
FIG. 46 is an explanatory circuit diagram to be referred to in description of a still further operating state of the pixel circuit according to the third embodiment.

Finally, when the first sampling transistor T1 is controlled to enter a state of being turned off in order to terminate the operation to store the signal electric potential Vsig in the signal holding capacitor Cs in a time period t9 shown in the timing diagram of FIG. 37, the organic EL device OLED starts an operation to emit light. That is to say, a new light emission period is begun. FIG. 46 is a circuit diagram showing an operating state of the pixel circuit 71 at this point of time.

(D-3): Conclusion

As described above, even though the signal electric potential Vsig is stored in the signal holding capacitor Cs from the signal line DTL by turning on and off a thin-film transistor serving as the first sampling transistor T1 provided separately from a thin-film transistor serving as the second sampling transistor T3 through which the offset electric potential Vofs conveyed by the offset signal line OFSL is also to be stored in the signal holding capacitor Cs, it is possible to produce the same effects as the second embodiment.

(E): Fourth Embodiment

(E-1): System Configuration

A fourth embodiment is a typical implementation of the second embodiment. To be more specific, the fourth embodiment includes a new driving circuit 83 for controlling a new thin-film transistor T3 utilized for supplying a driving current to a pixel circuit 91.

Figure 47:
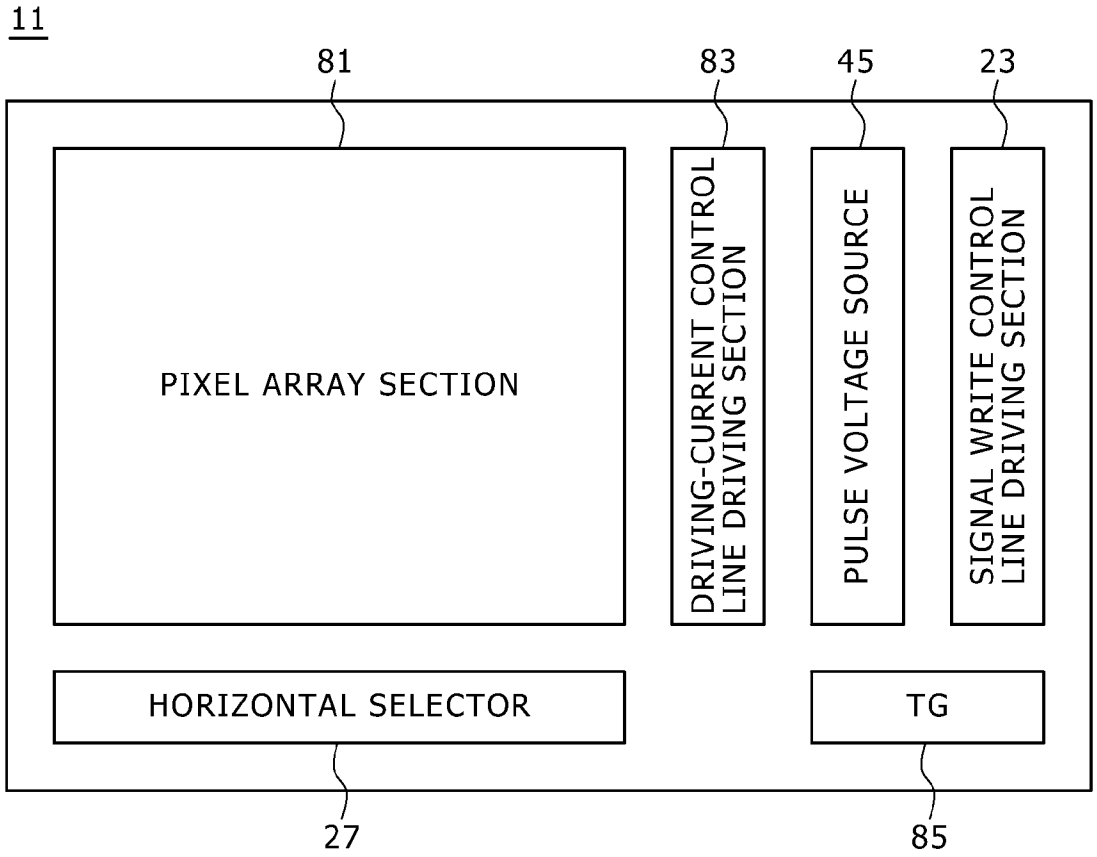
FIG. 47 is a block diagram showing a typical system configuration of an organic EL display panel according to a fourth embodiment.

FIG. 47 is a block diagram showing a typical system configuration of the organic EL display panel 11. Elements employed in this typical system configuration as elements identical with their respective counterparts included in the system configuration shown in the block diagram of FIG. 18 are denoted by the same reference numerals and reference notations as the counterparts. The organic EL display panel 11 shown in the block diagram of FIG. 47 employs a pixel array section 81, a signal-write control line driving section 23, a pulse voltage source 45, a driving-current control line driving section 83, a horizontal selector 27 and a timing generator 85.

The layout of pixel circuits 91 in the pixel array section 81 is identical with the layout in the second embodiment. Thus, the pixel array section 81 also has a matrix structure including sub-pixel circuits each located at an intersection of a signal line DTL and a write control line WSL. Also in the case of the fourth embodiment, the signal line DTL is shared by the signal electric potential Vsig and the offset electric potential Vofs on a time-sharing basis.

Figure 48:
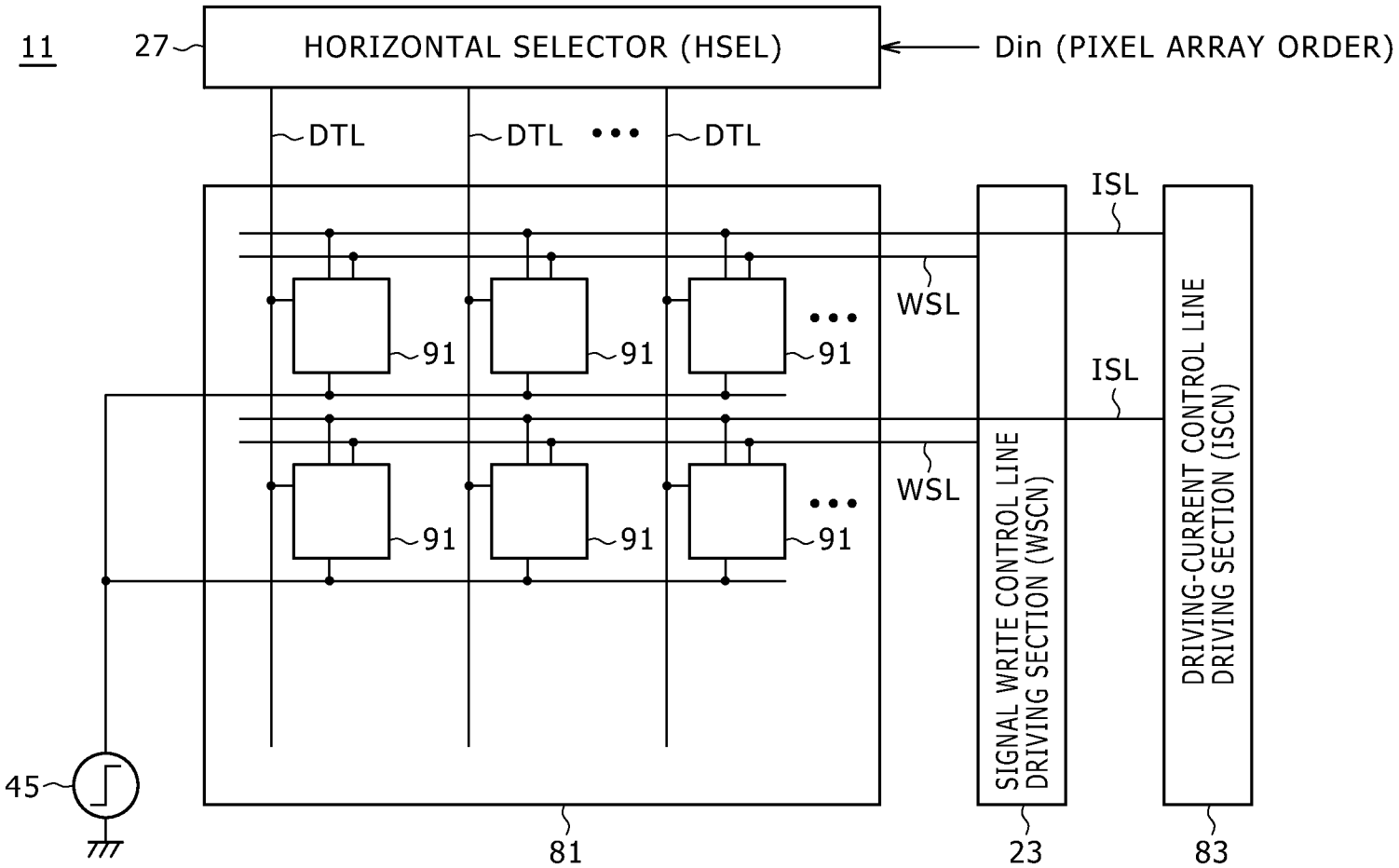
FIG. 48 is a block diagram showing wiring connections between pixel circuits each serving as a sub-pixel circuit in a pixel array section and a signal-write control line driving section, a horizontal selector, a pulse voltage source as well as a driving-current control line driving section which each function as a driving circuit in the organic EL display panel according to the fourth embodiment.
Figure 49:
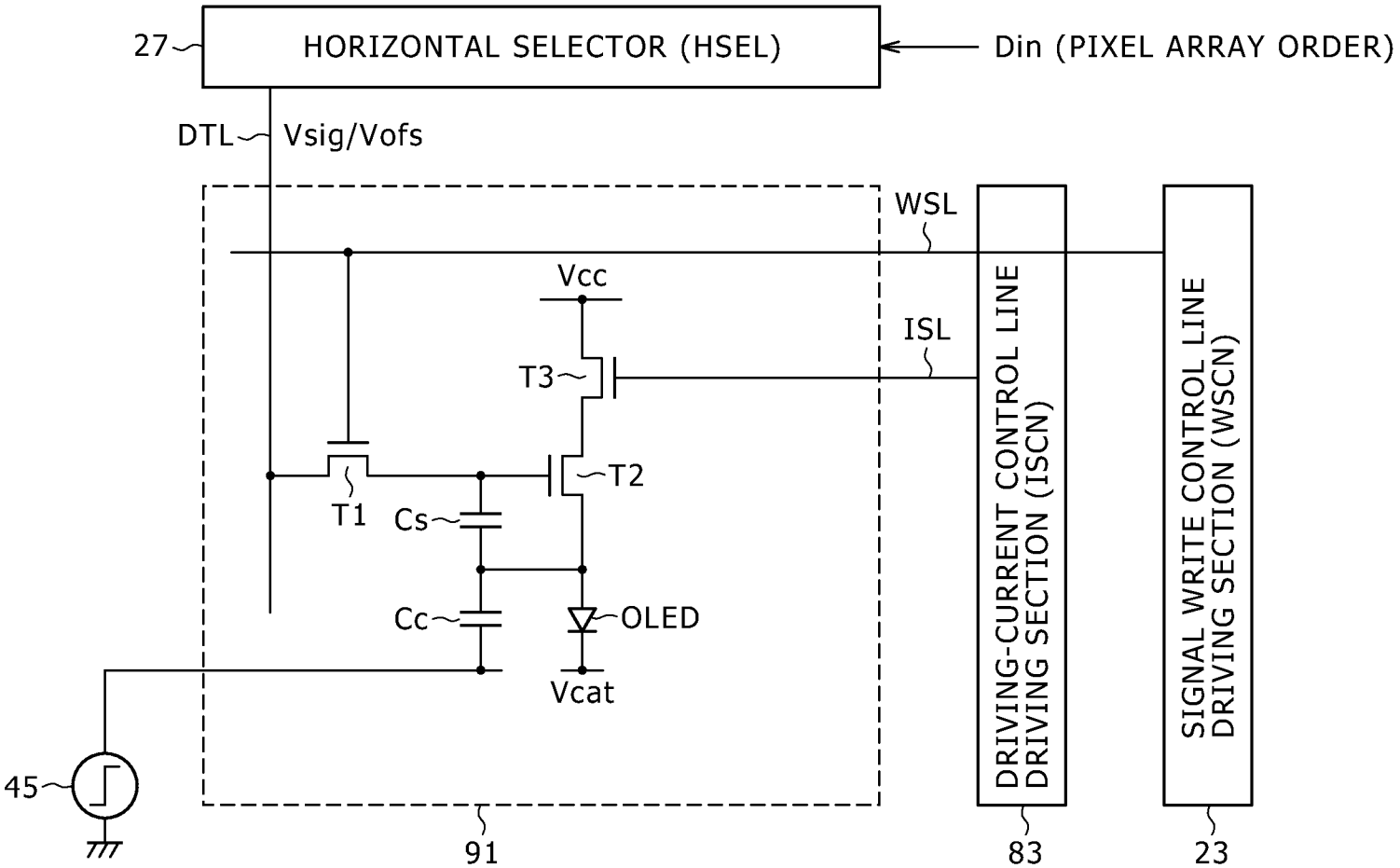
FIG. 49 is a block diagram showing wiring connections between the pixel circuit according to the fourth embodiment and the signal-write control line driving section, the horizontal selector, the pulse voltage source as well as the driving-current control line driving section by focusing on the internal configuration of the pixel circuit.

FIG. 48 is a block diagram showing wiring connections between the pixel circuits 91 each serving as a sub-pixel circuit in the pixel array section 81 and the driving-current control line driving section 83, the pulse voltage source 45, the signal-write control line driving section 23 as well as the horizontal selector 27 which each function as a driving circuit. FIG. 49 is a block diagram showing wiring connections between a pixel circuit 91 and the driving-current control line driving section 83, the pulse voltage source 45, the signal-write control line driving section 23 as well as the horizontal selector 27 by focusing on the internal configuration of the pixel circuit 91. As shown in the block diagram of FIG. 49, the pixel circuit 91 employs a sampling transistor T1, a driving transistor T2, a driving-current control transistor T3, a signal holding capacitor Cs, a coupling capacitor Cc and an organic EL device OLED. Each of the sampling transistor T1, the driving transistor T2 and the driving-current control transistor T3 is a thin-film transistor of the N-channel type.

The driving-current control transistor T3 is connected in series between the current supply line and the driving transistor T2. An operation to supply the driving current Ids to the organic EL device OLED by way of the driving transistor T2 is controlled by putting the driving-current control transistor T3 in a state of being turned on or turned off.

The operation to put the driving-current control transistor T3 in a state of being turned on or turned off is controlled by the driving-current control line driving section 83 through a driving-current control line ISL. It is to be noted that the driving-current control line driving section 83 can be designed into the same configuration as the signal-write control line driving section 23.

The timing generator 85 is a section for generating timing pulses desired for driving the write control line WSL, the driving-current control line ISL, the capacitor control line CNTL and the signal line DTL.

(E-2): Typical Driving Operations

FIG. 50 is a timing diagram showing a plurality of timing charts of signals relevant to operations to drive the pixel circuit 91 included in the typical configuration shown in the block diagram of FIG. 49. Incidentally, also in the timing diagram of FIG. 50, reference notation Vdd denotes the high-level electric potential of the two power-supply electric potentials applied to the capacitor control line CNTL whereas reference notation Vini denotes the low-level electric potential of the two power-supply electric potentials.

Figures 50A, 50B, 50C, 50D, 50E, 50F:
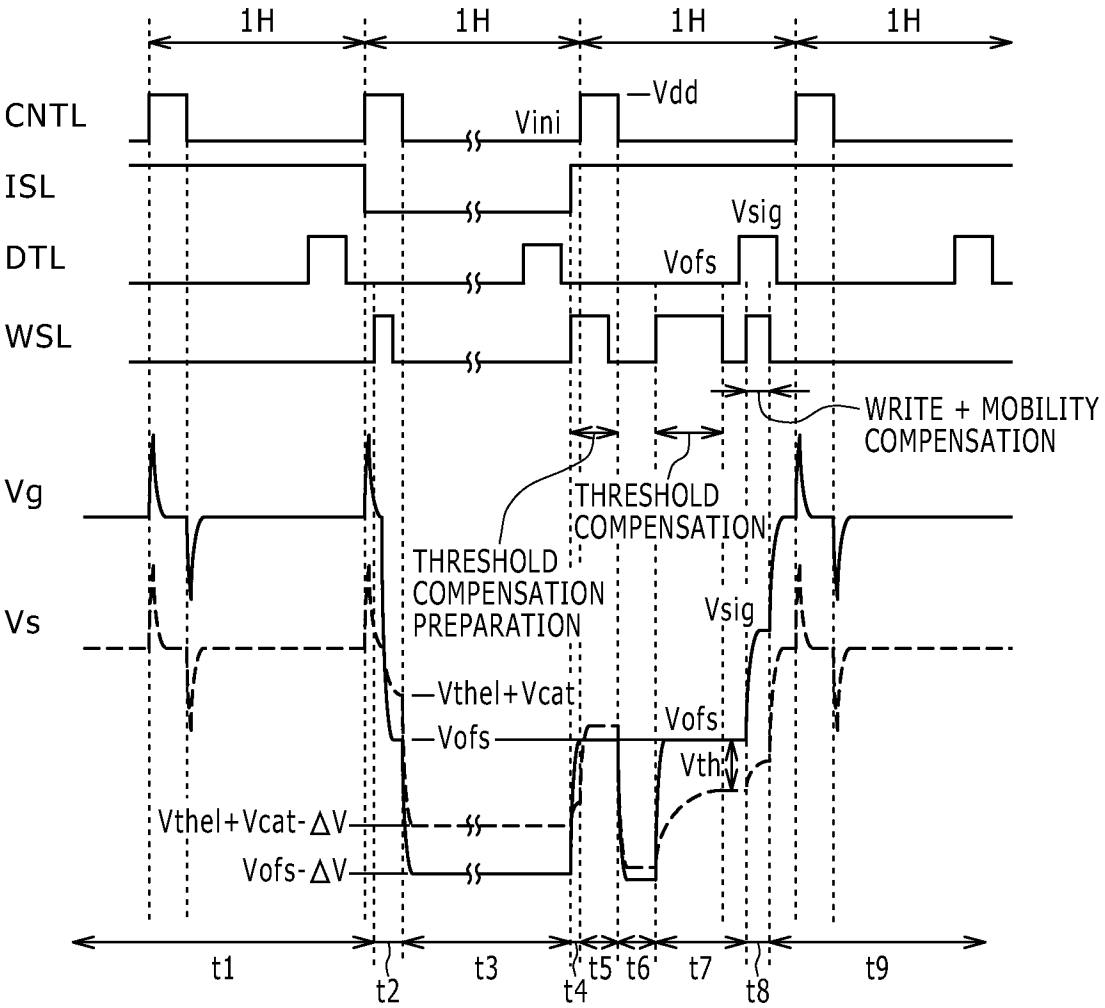
FIGS. 50A, 50B, 50C, 50D, 50E, and 50F reflect a timing diagram showing a plurality of timing charts of signals relevant to operations to drive the pixel circuit according to the fourth embodiment.

To be more specific, FIG. 50A is a diagram showing a waveform representing the timing chart of an electric potential appearing on the capacitor control line CNTL. FIG. 50B is a diagram showing a waveform representing the timing chart of an electric potential appearing on the driving-current control line ISL. FIG. 50C is a diagram showing a waveform representing the timing chart of an electric potential appearing on the signal line DTL. FIG. 50D is a diagram showing a waveform representing the timing chart of an electric potential appearing on the write control line WSL. FIG. 50E is a diagram showing a waveform representing the timing chart of the gate electric potential Vg of the driving transistor T2. FIG. 50F is a diagram showing a waveform representing the timing chart of the source electric potential Vs of the driving transistor T2.

Figure 51:
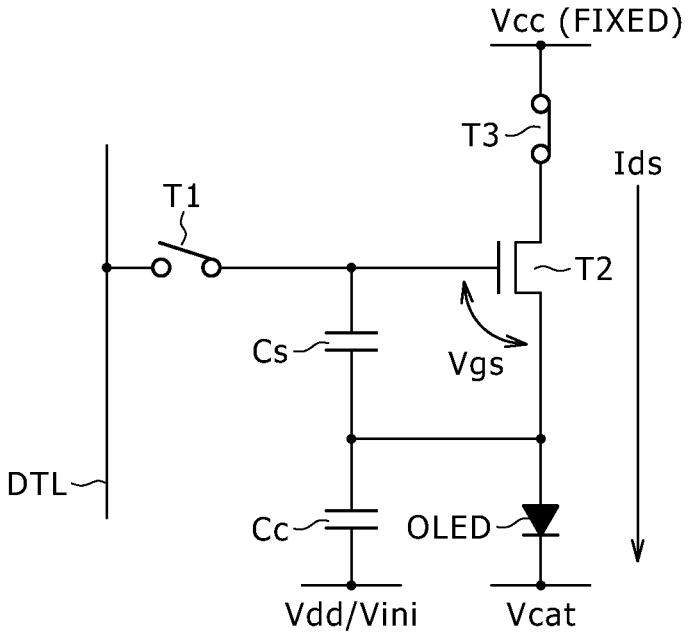
FIG. 51 is an explanatory circuit diagram to be referred to in description of an operating state of the pixel circuit according to the fourth embodiment.

First of all, the operation of the pixel circuit 91 in a light emission state is explained by referring to a circuit diagram of FIG. 51. At that time, the sampling transistor T1 is in a state of being turned off but the driving-current control transistor T3 is in a state of being turned on.

Thus, the gate electrode of the driving transistor T2 is operating as an electrode put in a state of being floated. However, the driving transistor T2 is operating in a state of being electrically connected to the current supply line.

As a result, every time the electric potential appearing on the capacitor control line CNTL rises to a high level within a horizontal scan period in a periodical operation, a positive-direction coupling waveform is introduced during a time period t1 shown in the timing diagram of FIG. 50 into a signal shown by the timing chart E of the timing diagram of FIG. 50 to represent the gate electric potential Vg of the driving transistor T2 and a signal shown by the timing chart F of the timing diagram of FIG. 50 to represent the source electric potential Vs of the driving transistor T2. Every time the electric potential appearing on the capacitor control line CNTL falls to a low level within a horizontal scan period in a periodical operation, on the other hand, a negative-direction coupling waveform is introduced during the time period t1 shown in the timing diagram of FIG. 50 into the signal shown by the timing chart E of the timing diagram of FIG. 50 to represent the gate electric potential Vg of the driving transistor T2 and the signal shown by the timing chart F of the timing diagram of FIG. 50 to represent the source electric potential Vs of the driving transistor T2.

It is to be noted that, since the gate electrode of the driving transistor T2 is operating as an electrode put in a state of being floated, the gate-source voltage Vgs of the driving transistor T2 is sustained at a fixed magnitude as it is in spite of the introduction of the coupling waveforms. Thus, the operation carried out by the driving transistor T2 in the saturated region is continued. As a result, the organic EL device OLED maintains the light emission state of emitting light with a luminance according to the driving current Ids determined by the gate-source voltage Vgs of the driving transistor T2 throughout one horizontal scan period.

Figure 52:
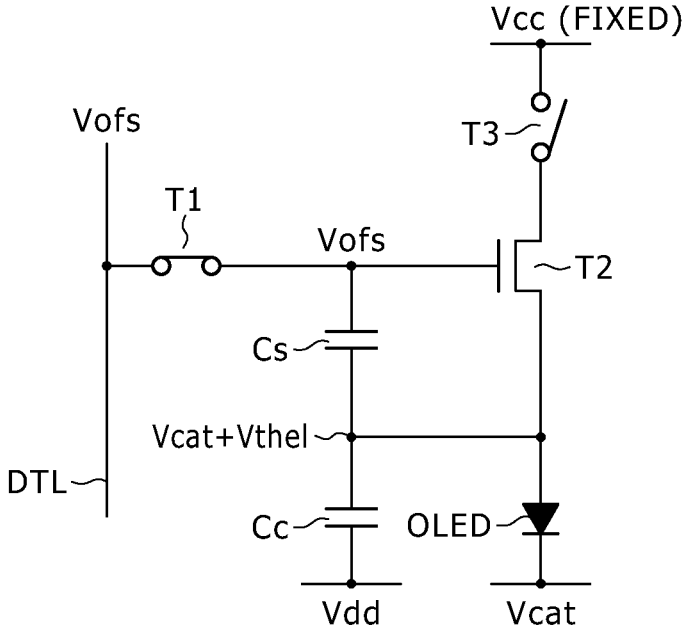
FIG. 52 is an explanatory circuit diagram to be referred to in description of another operating state of the pixel circuit according to the fourth embodiment.

Next, operations in a no-light emission state are explained. The no-light emission state is started when the driving-current control transistor T3 is controlled to enter a state of being turned off in a time period t2 shown in the timing diagram of FIG. 50. FIG. 52 is a circuit diagram showing an operating state of the pixel circuit 91 at this point of time. At that time, the source electric potential Vs of the driving transistor T2 falls toward an electric potential of light extinction. Accompanying the falling of the source electric potential Vs of the driving transistor T2, the gate electric potential Vg of the driving transistor T2 also decreases as well in the same way.

In the case of the fourth embodiment, however, by putting the sampling transistor T1 in a state of being turned on, the gate electric potential Vg of the driving transistor T2 can be controlled to change to the offset electric potential Vofs as shown by the timing chart of FIG. 50E. It is to be noted that the source electric potential Vs of the driving transistor T2 becomes equal to (Vthel+Vcat) as shown by the timing chart of FIG. 50F.

FIG. 52 is a circuit diagram showing an operating state of the pixel circuit 91. In this operating state, the source electric potential Vs of the driving transistor T2 becomes equal to (Vthel+Vcat). It is to be noted that the offset electric potential Vofs is not greater than the sum of the threshold voltage Vthel of the organic EL device OLED, the cathode voltage Vcat of the organic EL device OLED and the threshold voltage Vth of the driving transistor T2.

When the operation to store the offset electric potential Vofs in the signal holding capacitor Cs is completed, the sampling transistor T1 is controlled to again enter a state of being turned off in a time period t3 of the timing diagram of FIG. 50. With the sampling transistor T1 put in the state of being turned off, the gate electrode of the driving transistor T2 is put in a state of being floated.

Figure 53:
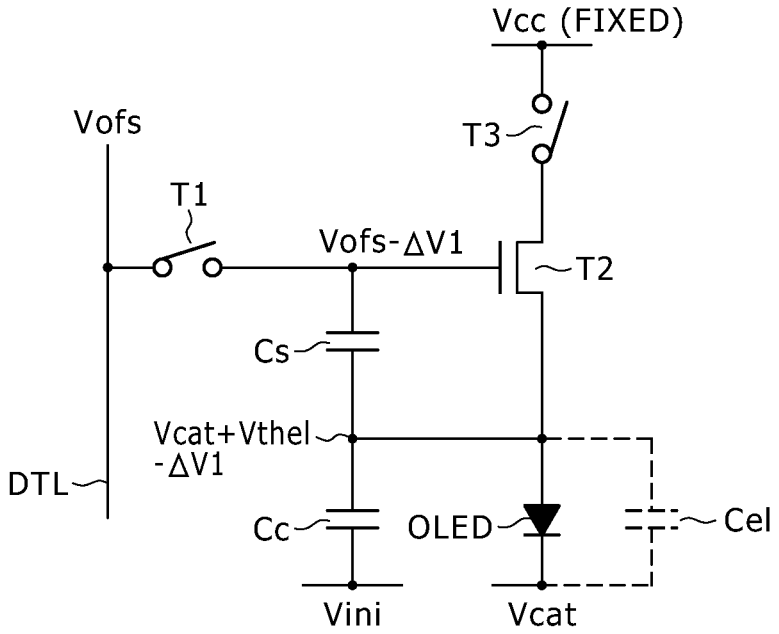
FIG. 53 is an explanatory circuit diagram to be referred to in description of a further operating state of the pixel circuit according to the fourth embodiment.

Later on, the electric potential appearing on the capacitor control line CNTL is controlled to change from the high-level electric potential Vdd to the low-level electric potential Vini. At that time, a negative-direction coupling component ΔV1 is superposed on each of the gate electric potential Vg and the source electric potential Vs which appear respectively on the gate and source electrodes of the driving transistor T2. FIG. 53 is a circuit diagram showing an operating state of the pixel circuit 91 at this point of time.

Figure 54:
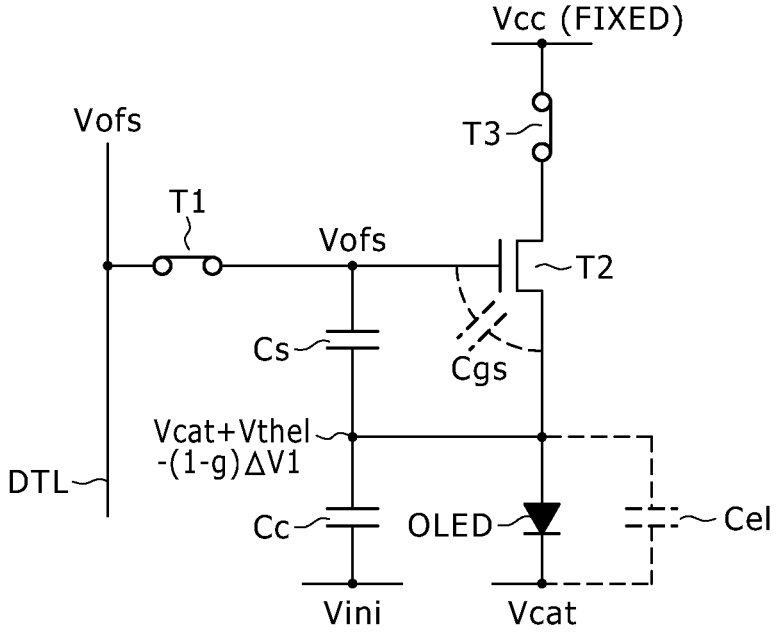
FIG. 54 is an explanatory circuit diagram to be referred to in description of a still further operating state of the pixel circuit according to the fourth embodiment.

In due course of time, in time periods t4 and t5 shown in the timing diagram of FIG. 50, the period of the threshold-voltage compensation preparation process is commenced. To put it in detail, in the time period t4 shown in the timing diagram of FIG. 50, in a state of setting the electric potential appearing on the capacitor control line CNTL at the low-level electric potential Vini, the threshold-voltage compensation preparation process is commenced by putting the driving-current control transistor T3 and the sampling transistor T1 in a state of being turned on at the same time. FIG. 54 is a circuit diagram showing an operating state of the pixel circuit 91 at this point of time.

It is to be noted that, at this point of time, the gate-source voltage Vgs of the driving transistor T2 is controlled to enter a reversed-bias state. Thus, even if the driving-current control transistor T3 is controlled to enter a state of being turned on, the driving current Ids does not flow to the organic EL device OLED. Thus, the organic EL device OLED remains in a no-light emission state as it is.

Figure 55:
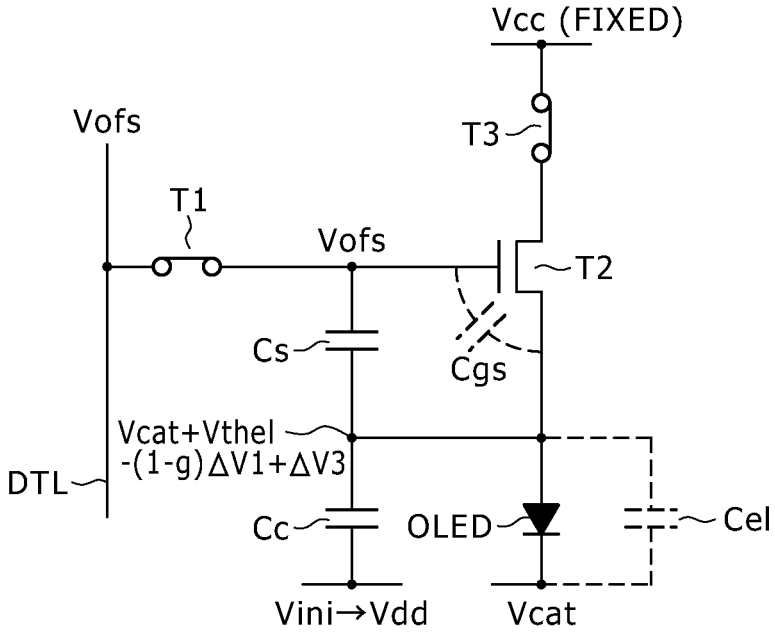
FIG. 55 is an explanatory circuit diagram to be referred to in description of a still further operating state of the pixel circuit according to the fourth embodiment.

In this case, in the time period t5 shown in the timing diagram of FIG. 50, the electric potential appearing on the capacitor control line CNTL is controlled to change from the low-level electric potential Vini back to the high-level electric potential Vdd. FIG. 55 is a circuit diagram showing an operating state of the pixel circuit 91 at this point of time.

As a result, in a state of fixing the gate electric potential Vg of the driving transistor T2 at the offset electric potential Vofs, the source electric potential Vs of the driving transistor T2 is subjected to a coupling driving operation. Thus, the gate-source voltage Vgs of the driving transistor T2 is controlled to enter a reversed-bias state.

Figure 56:
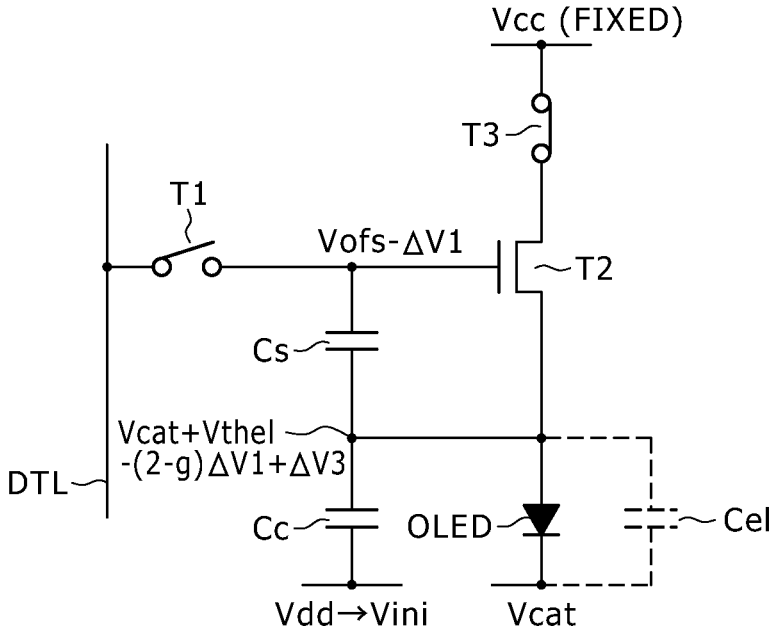
FIG. 56 is an explanatory circuit diagram to be referred to in description of a still further operating state of the pixel circuit according to the fourth embodiment.

As the threshold-voltage compensation preparation process is ended, the sampling transistor T1 is controlled to enter a state of being turned off, putting the gate electrode of the driving transistor T2 in a state of being floated again. In this state, the electric potential appearing on the capacitor control line CNTL is controlled to change from the high-level electric potential Vdd to the low-level electric potential Vini in a time period t6 shown in the timing diagram of FIG. 50. That is to say, with the gate electrode of the driving transistor T2 put in a state of being floated, the electric potential appearing on the capacitor control line CNTL is subjected to a coupling driving operation carried out in the negative direction. FIG. 56 is a circuit diagram showing an operating state of the pixel circuit 91 at this point of time.

Figure 57:
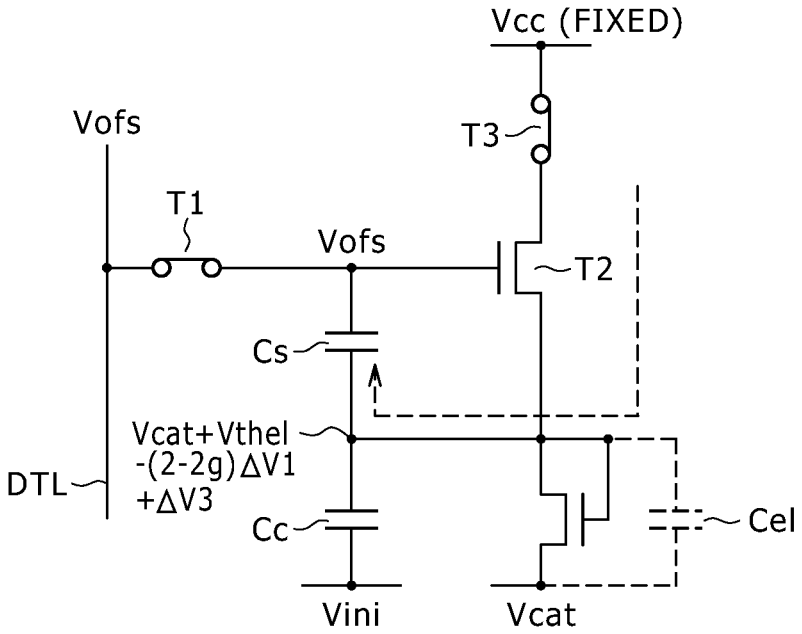
FIG. 57 is an explanatory circuit diagram to be referred to in description of a still further operating state of the pixel circuit according to the fourth embodiment.

Later on, in a time period t7 shown in the timing diagram of FIG. 50, the threshold-voltage compensation process is commenced. To put it in detail, in a state of setting the electric potential appearing on the capacitor control line CNTL at the low-level electric potential Vini, the threshold-voltage compensation process is commenced by putting the sampling transistor T1 in a state of being turned on. FIG. 57 is a circuit diagram showing an operating state of the pixel circuit 91 at this point of time. In this operating state, the gate-source voltage Vgs of the driving transistor T2 is greater than the threshold voltage Vth of the driving transistor T2.

Thus, the driving transistor T2 is put in a state of being turned on and operating. As shown in the circuit diagram of FIG. 57, in this state, a driving current Ids is flowing from the current supply line to the signal holding capacitor Cs. A portion of the driving current Ids is also used for electrically charging the parasitic capacitor Cel of the organic EL device OLED. Thus, the anode electric potential Vel of the organic EL device OLED rises with the lapse of time. However, the relation Vel≤(Vcat+Vthel) is satisfied. Thus, the organic EL device OLED by no means emits light. In due course of time, the gate-source voltage Vgs of the driving transistor T2 becomes equal to the threshold voltage Vth of the driving transistor T2. At that time, the driving transistor T2 is automatically put in a state of being turned off, cutting off the flow of the driving current Ids.

Figure 58:
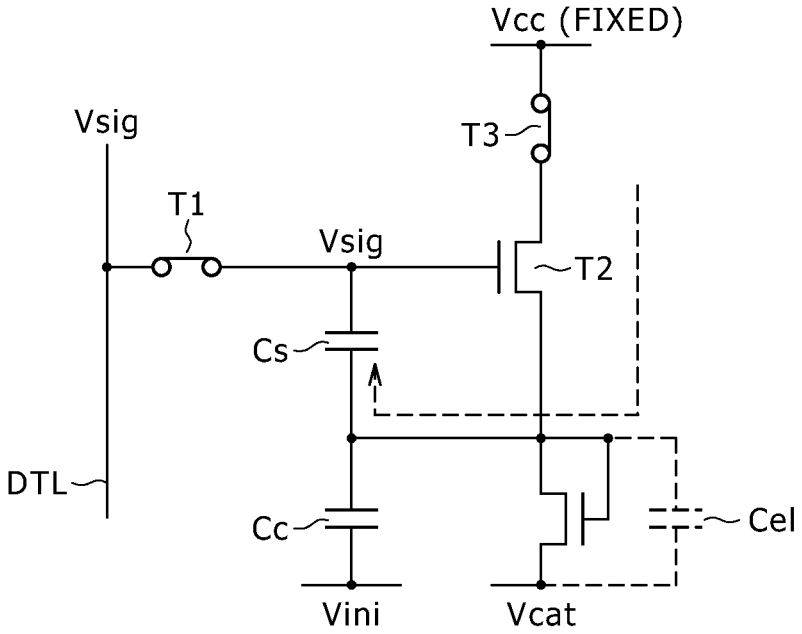
FIG. 58 is an explanatory circuit diagram to be referred to in description of a still further operating state of the pixel circuit according to the fourth embodiment.

When the threshold-voltage compensation process is ended as described above, the sampling transistor T1 is controlled to again enter a state of being turned on, starting an operation to store the signal electric potential Vsig from the signal line DTL into the signal holding capacitor Cs in a time period t8 shown in the timing diagram of FIG. 50. Then, the operation to store the signal electric potential Vsig from the signal line DTL into the signal holding capacitor Cs and a mobility compensation process are carried out at the same time. FIG. 58 is a circuit diagram showing an operating state of the pixel circuit 71 at this point of time.

Figure 59:
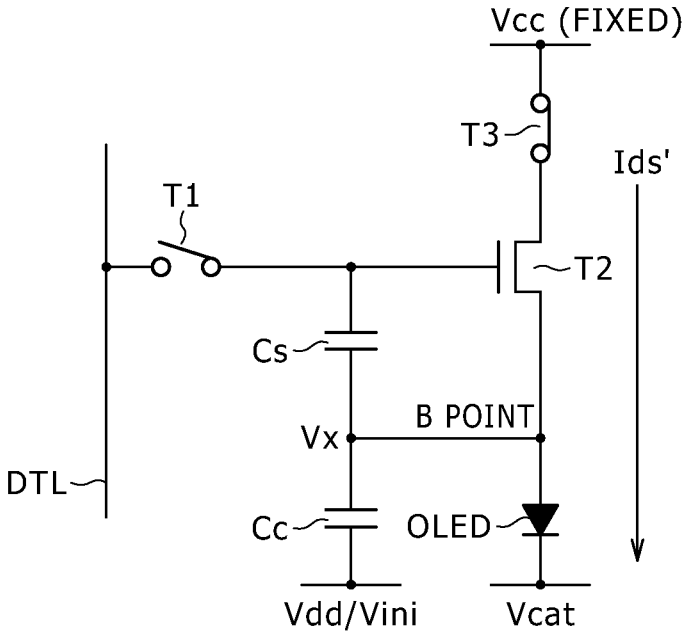
FIG. 59 is an explanatory circuit diagram to be referred to in description of a still further operating state of the pixel circuit according to the fourth embodiment.

Finally, when the sampling transistor T1 is controlled to enter a state of being turned off in order to terminate the operation to store the signal electric potential Vsig in the signal holding capacitor Cs in a time period t9 shown in the timing diagram of FIG. 50, the organic EL device OLED starts an operation to emit light. That is to say, a new light emission period is begun. FIG. 59 is a circuit diagram showing an operating state of the pixel circuit 71 at this point of time.

(E-3): Conclusion

As described above, also in the case of an organic EL display panel in which an operation to supply the driving current Ids to the organic EL device OLED from the signal line DTL is carried out by putting the driving-current control transistor T3 in a state of being turned on whereas an operation to stop the driving-current supplying operation is carried out by putting the driving-current control transistor T3 in a state of being turned off, it is possible to produce the same effects as the second embodiment. It is to be noted that, in the configuration including the driving-current control transistor T3, the operation to supply the driving current Ids to the organic EL device OLED by way of the driving-current control transistor T3 and the driving transistor T2 and the operation to stop the driving-current supplying operation can be controlled independently of each other during a light emission period. If this function is carried out, the length of a light emission period in 1 frame period can be controlled to any arbitrary value so that this function can be used in an effort to enhance the responsiveness of a moving picture.

(F): Other Embodiments (F-1): Wiring Structure

In the case of the embodiments described so far, one of the ends of each capacitor control line CNTL is created as a wiring pattern driven by the pulse voltage source 45 as a wiring pattern common to all pixel circuits.

However, it is also possible to provide a configuration in which one of the ends of each of a plurality of capacitor control lines CNTL is created as a wiring pattern common to the same plurality of matrix rows and every wiring pattern common to the same plurality of rows is driven by the pulse voltage source 45.

(F-2): Typical Products (a): Electronic Apparatus

As described before, an organic EL display panel is used as a typical application of the embodiments of the present invention. However, the organic EL display panel described so far is also made available in the market in the form of a commodity implemented in a variety of electronic apparatus 101.

Figure 60:
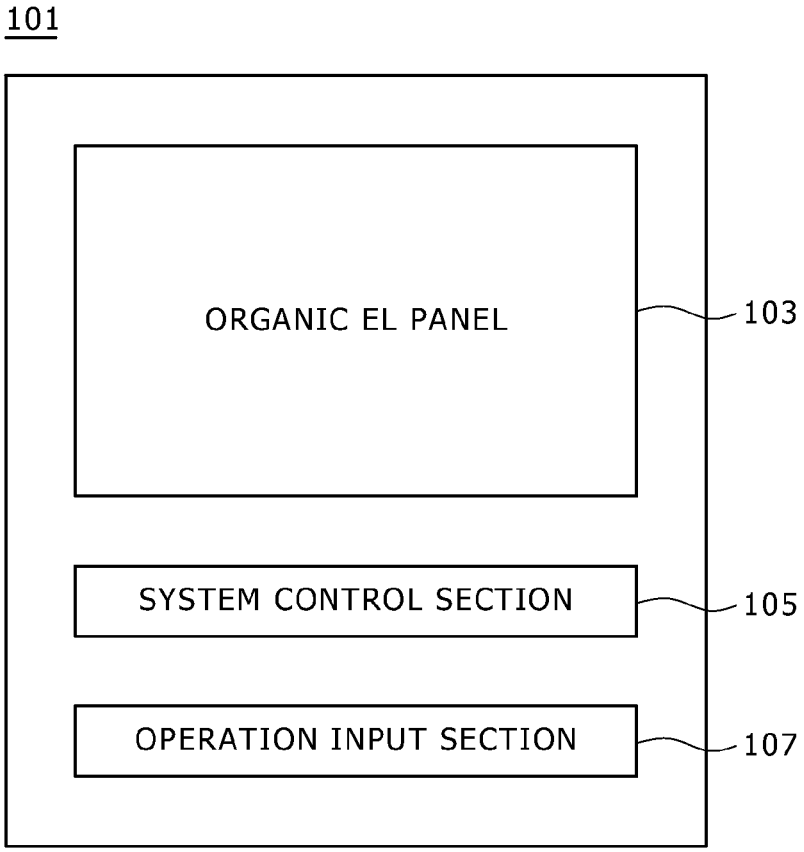
FIG. 60 is a block diagram showing a typical conceptual configuration of an electronic apparatus.

FIG. 60 is a block diagram showing a typical conceptual configuration of an electronic apparatus 101. As shown in the block diagram of FIG. 60, the electronic apparatus 101 includes an organic EL panel 103, a system control section 105 and an operation input section 107. Processing carried out by the system control section 105 varies in accordance with the commodity form of the electronic apparatus 101. The operation input section 107 is a device for receiving an operation input entered by the user to the system control section 105. The operation input section 107 involves interfaces such as mechanical and graphical interfaces. The mechanical interfaces include switches and buttons.

It is to be noted that the electronic apparatus 101 is by no means limited to apparatus pertaining to a specific field. That is to say, the electronic apparatus 101 can be any apparatus as long as the apparatus has a function to display a picture and/or a video on a display section. The picture and/or the video can be generated internally or received from an external source.

Figure 61:
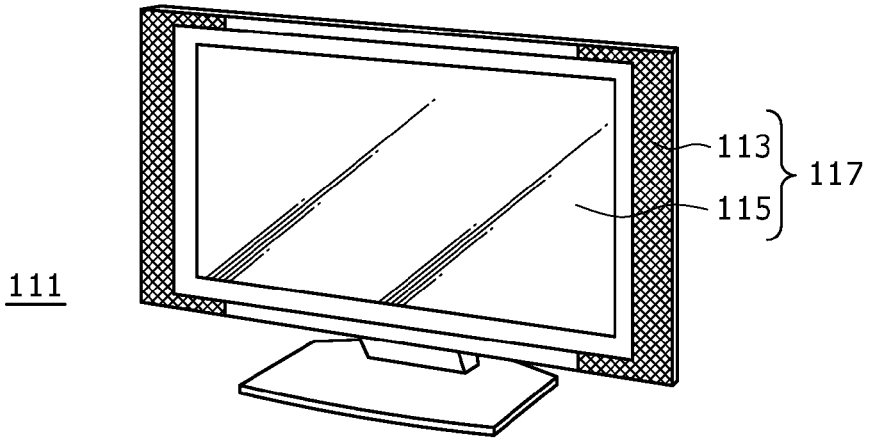
FIG. 61 is a diagram showing an external appearance of a TV receiver which serves as a typical electronic apparatus.

FIG. 61 is a diagram showing an external appearance of a TV receiver 111 which serves as a typical electronic apparatus 101. The case front face of the TV receiver 111 is a display screen 117 including a front panel 113 and a filter glass plate 115. The display screen 117 corresponds to the organic EL display panel implemented by any one of the embodiments described earlier.

Figure 62A:
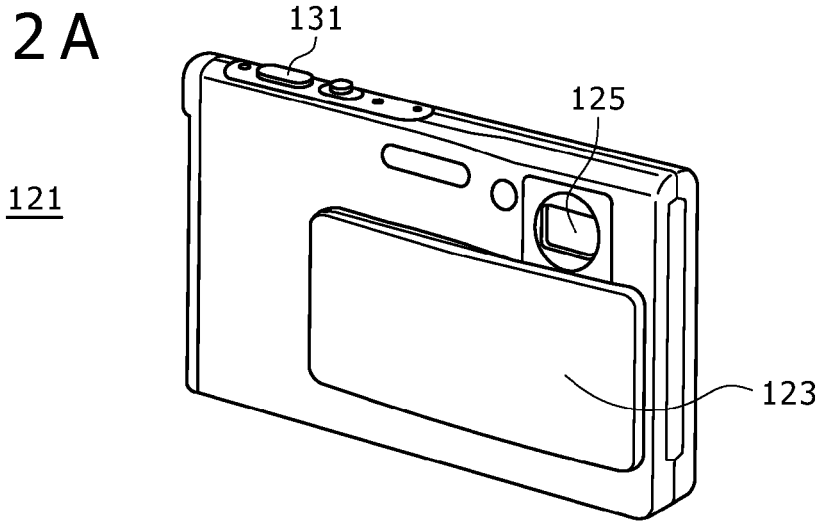
FIGS. 62A and 62B are diagrams each showing an external appearance of a digital camera.
Figure 62B:
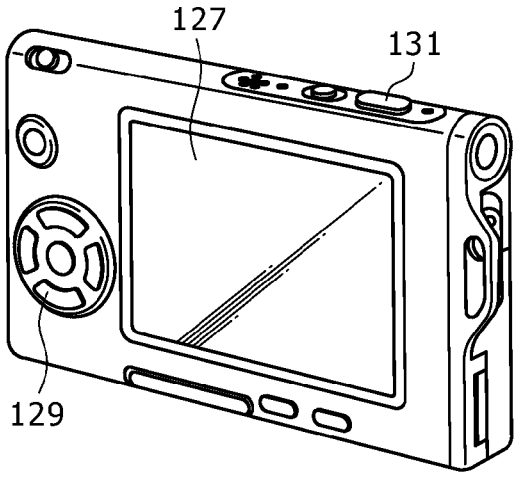

Another typical electronic apparatus 101 that can be assumed is a digital camera 121. FIG. 62 is a plurality of diagrams each showing an external appearance of the digital camera 121. To be more specific, FIG. 62A is a diagram showing the front-face side (or the photographing-subject side) of the external appearance of the digital camera 121 whereas FIG. 62B is a diagram showing the rear-face side (or the photographer side) of the external appearance of the digital camera 121.

As shown in the diagrams of FIG. 62, the digital camera 121 employs a protection cover 123, a photographing lens section 125, a display screen 127, a control switch 129 and a shutter button 131. The shutter button 131 corresponds to the organic EL display panel implemented by any one of the embodiments described earlier.

Figure 63:
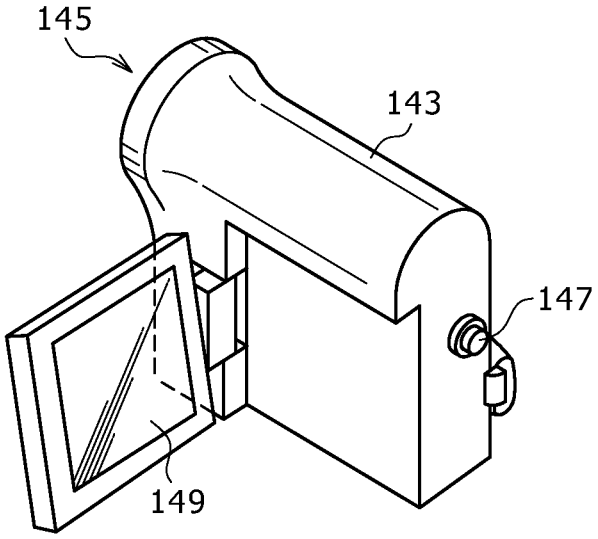
FIG. 63 is a diagram showing an external appearance of a digital camera.

A further typical electronic apparatus 101 that can be assumed is a video camera 141. FIG. 63 is a diagram showing an external appearance of the video camera 141.

As shown in the diagram of FIG. 63, the video camera 141 employs a main unit 143, a photographing lens 145, a start/stop switch 147 and a display screen 149. The display screen 149 corresponds to the organic EL display panel implemented by any one of the embodiments described earlier.

Figure 64A:
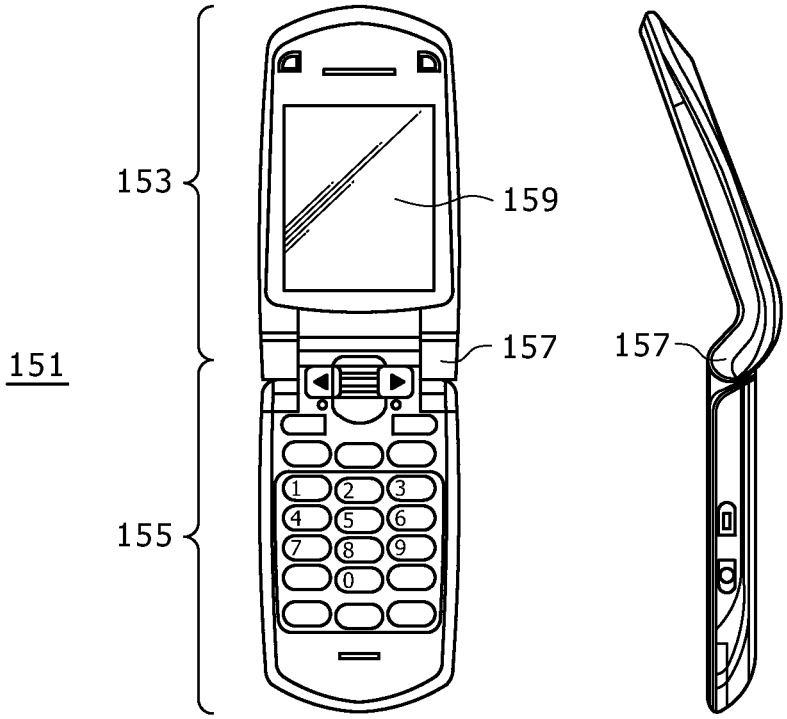
FIGS. 64A and 64B are diagrams each showing an external appearance of a cellular phone.
Figure 64B:
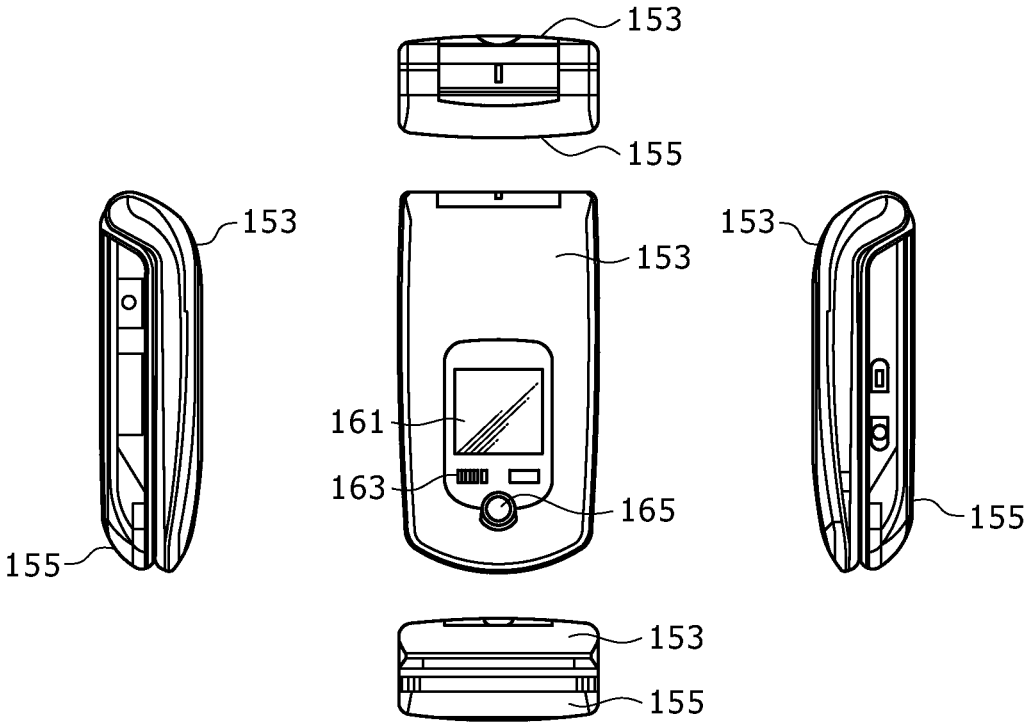

A still further typical electronic apparatus 101 that can be assumed is a cellular phone 151. FIG. 64 is a plurality of diagrams each showing an external appearance of the cellular phone 151. The cellular phone 151 shown in the diagrams of FIG. 64 is a cellular phone of a fold-back type. To be more specific, FIG. 64A is a plurality of diagrams each showing the external appearance of the cellular phone 151 with the case of the cellular phone 151 put in a state of being opened whereas FIG. 64B is a plurality of diagrams each showing the external appearance of the cellular phone 151 with the case of the cellular phone 151 put in a state of being closed.

As shown in the diagrams of FIG. 64, the cellular phone 151 employs an upper-side case 153, a lower-side case 155, a link section 157, a display screen 159, an auxiliary display screen 161, a picture light 163 and a photographing lens 165. In the case of the cellular phone 151, the link section 157 is a hinge. Each of the display screen 159 and the auxiliary display screen 161 corresponds to the organic EL display panel implemented by any one of the embodiments described earlier.

Figure 65:
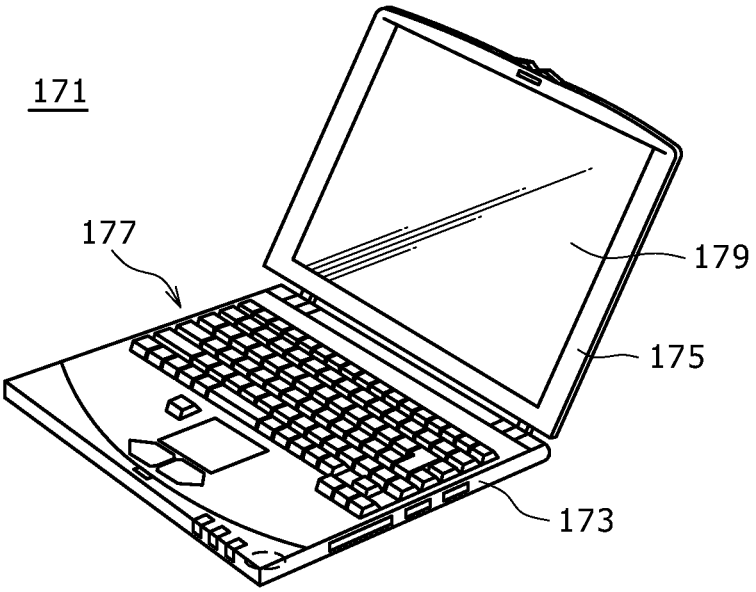
FIG. 65 is a diagram showing an external appearance of a notebook computer.

A still further typical electronic apparatus 101 that can be assumed is a notebook computer 171. FIG. 65 is a diagram showing an external appearance of the notebook computer 171. As shown in the diagram of FIG. 65, the notebook computer 171 employs a lower case 173, an upper case 175, a keyboard 177 and a display screen 179. The display screen 179 corresponds to the organic EL display panel implemented by any one of the embodiments described earlier.

Still further typical electronic apparatus 101 include an audio reproduction apparatus, a game machine, an electronic book and an electronic dictionary.

(F-3): Other Typical Display Devices

Each of the embodiments described above implements an organic EL display panel. However, the driving technology according to the embodiments can also be applied to other EL display apparatus. For example, the driving technology can be applied to a display apparatus including LEDs (Light Emitting Diodes) laid out to form a matrix on the screen thereof or a display apparatus including light emitting devices laid out to form a matrix on the screen thereof. The light emitting device has a structure different from the LED. The driving technology can also be applied to an inorganic EL display panel.

(F-4): Others

The embodiments described above may be modified in various manners without departing from the spirit and scope of the present invention. Also various modifications and applications may be created or combined based on the disclosure of the present invention.

It should be understood by those skilled in the art that various modifications, combinations, sub-combinations and alterations may occur depending on design requirements and other factor in so far as they are within the scope of the appended claims or the equivalents thereof.

What is claimed is:

1. An electronic device including a luminescence display panel configured for active-matrix driving, the luminescence display panel comprising:

(i) a plurality of pixel circuits each including:

a driving transistor configured to control a driving current for a light luminescence device, a signal holding capacitor configured to output a driving voltage to the gate electrode of the driving transistor, a coupling capacitor connected to the signal holding capacitor; and a sampling transistor configured to control an operation to store a signal electric potential in the signal holding capacitor from a signal line;

(ii) a capacitor control line connected to the coupling capacitors of a plurality of the pixel circuits; and (iii) a peripheral unit configured to control an electric potential of at least the capacitor control line and the signal line, wherein the peripheral unit being operable to:

change an electric potential of the capacitor control line from a first potential to a second potential after the beginning of a reset period, the reset period being a period in which a reference electric potential is applied to the holding capacitors of the plurality of the pixel circuits, and change an electric potential of the capacitor control line from the second potential to the first potential after the end of the reset period, wherein the peripheral unit comprising a vertical unit and a horizontal unit, the each signal line respectively connected to the plurality of the pixel circuits, is controlled by the horizontal unit, and the capacitor control line is controlled by the vertical unit wherein the reference electric potential is provided through the horizontal unit, wherein the peripheral unit is operable to:

change an electric potential of the capacitor control line from the first potential to the second potential while the reference electric potential is being applied to the plurality of the pixel circuits through the horizontal unit, and wherein the peripheral unit is configured to execute threshold voltage compensation process, and after the electric potential of the capacitor control line is changed from the second potential to the first potential, a signal stored in the signal holding capacitor is set to include a signal information and a threshold voltage information of the driving transistor.

2. The electronic device according to claim 1, wherein the horizontal unit comprising a horizontal selector configured to selectively output the signal electric potential and the reference electric potential, so that the signal electric potential and the reference electric potential are time-divisionally applied to the signal line.

3. The electronic device according to claim 1, wherein the vertical unit comprises:

a signal-write control line driving section configured to control the each sampling transistor, of the plurality of the pixel circuits through a scan line, and a pulse voltage source configured to control the capacitor control line.

4. The electronic device according to claim 1, wherein the threshold-voltage compensation process is executed by extracting a current from the driving transistor and feeding back the extracted current to the signal holding capacitor.

5. The electronic device according to claim 4, wherein the mobility compensation process is executed by extracting a current from the driving transistor and feeding back the extracted current to the signal holding capacitor while the signal electric potential is being applied to the signal holding capacitor.

6. The electronic device according to claim 1, wherein the peripheral unit is further configured to execute mobility compensation process, and after the electric potential of the capacitor control line is changed from the second potential to the first potential, a signal stored in the signal holding capacitor is set to further include a mobility information of the driving transistor.

7. The electronic device according to claim 1, wherein the light luminescence device comprises an organic electroluminescence element.

8. The electronic device according to claim 1, wherein the second potential is higher than the first potential.

9. The electronic device according to claim 1, wherein a thin-film transistor of an N-channel type is employed as the driving transistor.

10. The electronic device according to claim 1, wherein the electronic device is an electronic apparatus selected from the group consisting of a computer and a TV receiver.

11. A luminescence display panel configured for active-matrix driving, the display panel comprising:

pixel circuits each including at least:

a driving transistor for controlling a driving current for a light luminescence device, a signal holding capacitor connected to output a driving voltage to the gate electrode of the driving transistor, a coupling capacitor connected to the signal holding capacitor, and a sampling transistor for controlling an operation to store a signal electric potential into the signal holding capacitor from a signal line;

a capacitor control line connected to the coupling capacitors of at least a plurality of the pixel circuits; and a peripheral unit for controlling an electric potential of at least the capacitor control line and the signal line;

the peripheral unit being operable to:

change an electric potential of the capacitor control line from a first potential to a second potential after the beginning of a reset period, the reset period being a period in which a reference electric potential is being applied to the each signal holding capacitor of the plurality of the pixel circuits, and change an electric potential of the capacitor control line from the second potential to the first potential after the end of reset period, and wherein the peripheral unit is configured to execute threshold voltage compensation process such that a signal stored in the signal holding capacitor is dependent on both of a signal information provided from the signal line and a threshold voltage information of the driving transistor, after the electric potential of the capacitor control line is changed from the second potential to the first potential.

12. An electronic device comprising the luminescence display panel according to claim 11.

13. The electronic device according to claim 12, wherein the electronic device is a mobile phone.

14. The electronic device according to claim 12, wherein the electronic device is a camera.

15. The electronic device according to claim 12, wherein the electronic device is a portable computer.

16. An electronic device comprising a luminescence display panel which includes:

(i) a plurality of pixel circuits, each of the pixel circuits including:

a driving transistor configured to control a driving current for a light luminescence device, a signal holding capacitor configured to provide a driving voltage to the gate electrode of the driving transistor, a coupling capacitor connected to the signal holding capacitor, and a sampling transistor configured to control an operation to store a signal electric potential in the signal holding capacitor from a signal line, (ii) a capacitor control line connected to the coupling capacitors of the pixel circuits; and (iii) a peripheral circuitry configured to control an electric potential of at least the capacitor control line and the signal line, wherein the peripheral circuitry being operable to:

change an electric potential of the capacitor control line from a first potential to a second potential after the beginning of a reset period, the reset period being a period in which a reference electric potential is applied to the holding capacitors of the pixel circuits; and change an electric potential of the capacitor control line from the second potential to the first potential after the end of the reset period, wherein the peripheral circuitry is configured to execute threshold voltage compensation process, and wherein the peripheral circuitry is configured to execute threshold voltage compensation process such that a signal stored in the signal holding capacitor is dependent on both of a signal information provided from the signal line and a threshold voltage information of the driving transistor, after the electric potential of the capacitor control line is changed from the second potential to the first potential.

17. The electronic device according to claim 16, wherein the peripheral circuitry comprising a vertical circuitry and a horizontal circuitry, the each signal line respectively connected to the plurality of the pixel circuits, is controlled by the horizontal circuitry, and the capacitor control line is controlled by the vertical circuitry.

18. The electronic device according to claim 17, wherein the reference electric potential is provided through the horizontal circuitry.

19. The electronic device according to claim 18, wherein the peripheral circuitry is operable to:

change an electric potential of the capacitor control line from the first potential to the second potential while the reference electric potential is being applied to the plurality of the pixel circuits through the horizontal circuitry.

20. The electronic device according to claim 16, wherein the peripheral circuitry is operable to:

change an electric potential of the capacitor control line from the first potential to the second potential while the reference electric potential is being applied to the plurality of the pixel circuits through the horizontal circuitry.

21. The electronic device according to claim 16, wherein the threshold voltage compensation process is executed by extracting a current from the driving transistor and feeding back the extracted current to the signal holding capacitor.

22. The electronic device according to claim 16, wherein the light luminescence device comprises an organic electroluminescence element.

23. The electronic device according to claim 16, wherein the second potential is higher than the first potential.

24. The electronic device according to claim 16, wherein the electronic device is an electronic apparatus selected from the group consisting of a computer and a TV receiver.

* * * * *